US011769943B2

(12) United States Patent
Ito

(10) Patent No.: US 11,769,943 B2
(45) Date of Patent: Sep. 26, 2023

(54) ANTENNA DEVICE AND COMMUNICATION DEVICE

(71) Applicant: Sony Corporation, Tokyo (JP)

(72) Inventor: Takayoshi Ito, Tokyo (JP)

(73) Assignee: SONY CORPORATION, Tokyo (JP)

( * ) Notice: Subject to any disclaimer, the term of this patent is extended or adjusted under 35 U.S.C. 154(b) by 224 days.

(21) Appl. No.: 17/262,226

(22) PCT Filed: Jul. 30, 2018

(86) PCT No.: PCT/JP2018/028498
§ 371 (c)(1),
(2) Date: Jan. 22, 2021

(87) PCT Pub. No.: WO2020/026312
PCT Pub. Date: Feb. 6, 2020

(65) Prior Publication Data

US 2021/0305691 A1 Sep. 30, 2021

(51) Int. Cl.
*H01Q 1/52* (2006.01)
*H01Q 9/04* (2006.01)

(52) U.S. Cl.
CPC ..... *H01Q 1/52* (2013.01); *H01Q 9/0457* (2013.01)

(58) Field of Classification Search
CPC ..... H01Q 1/52; H01Q 9/0457; H01Q 1/243; H01Q 19/108; H01Q 9/065; H01Q 1/38
See application file for complete search history.

(56) References Cited

U.S. PATENT DOCUMENTS 6,549,169 B1 * 4/2003 Matsuyoshi ..... H01Q 21/28 343/702
7,330,161 B2 2/2008 Matsugatani
(Continued)

FOREIGN PATENT DOCUMENTS

JP 9-93029 A 4/1997
JP 2001-189615 A 7/2001
(Continued)

OTHER PUBLICATIONS

International Search Report and Written Opinion dated Sep. 11, 2018, received for PCT Application PCT/JP2018/028498, Filed on Jul. 30, 2018, 6 pages including English Translation.
(Continued)

*Primary Examiner* — David E Lotter
(74) *Attorney, Agent, or Firm* — XSENSUS LLP

(57) ABSTRACT

To implement an antenna device capable of further reducing an influence of proximity to a metal and feeding power to an antenna element in a more suitable manner.

An antenna device includes: a substantially-flat-plate-shaped dielectric substrate; a metal base plate arranged on a first surface of the dielectric substrate; substantially-flat-plate-shaped first and second antenna elements arranged on a second surface of the dielectric substrate that is opposite to the first surface and on an opposite side of the dielectric substrate from the metal base plate so that a slit is formed; a first feeding pin that feeds power to the first antenna element; and a second feeding pin that feeds power to the second antenna element, in which a phase difference between feeding signals supplied to the first and second feeding pins, respectively, is approximately 180 degrees.

18 Claims, 33 Drawing Sheets

(56) References Cited

U.S. PATENT DOCUMENTS

| | | | | |
|---|---|---|---|---|
| 2008/0198065 | A1 | 8/2008 | Voigtlander | |
| 2008/0252543 | A1 | 10/2008 | Pettus | |
| 2018/0040955 | A1 | 2/2018 | Vouvakis | |
| 2019/0036220 | A1* | 1/2019 | Paulotto | H01Q 9/045 |
| 2020/0127387 | A1* | 4/2020 | Park | H01Q 9/0414 |
| 2020/0303821 | A1* | 9/2020 | Lee | H01Q 9/0414 |

FOREIGN PATENT DOCUMENTS

| | | | |
|---|---|---|---|
| JP | 2016-34052 | A | 3/2016 |
| JP | 2016-146558 | A | 8/2016 |

OTHER PUBLICATIONS

Anonymous:"Standard FR4 TG135 Datasheet", Aug. 23, 2022, pp. 1-1, XP055954229.

* cited by examiner

ANTENNA DEVICE AND COMMUNICATION DEVICE

CROSS-REFERENCE TO RELATED APPLICATION

The present application is based on PCT filing PCT/JP2018/028498, filed Jul. 30, 2018, the entire contents of which are incorporated herein by reference.

FIELD

The present disclosure relates to an antenna device and a communication device.

BACKGROUND

With development of a wireless communication technology, a device such as a smartphone, which is configured to be capable of transmitting and receiving information to and from another device via a wireless communication path, has become widespread. In recent years, in particular, a technology called Internet of Things (IoT) that connects various things to a network has attracted attention, and not only a typical wireless communication device such as a smartphone, but also various devices including a so-called home appliance such as a television receiver have become capable of performing communication via a wireless communication path.

Against this background, the shape and size of the antenna device for realizing wireless communication have been diversified, and in particular, in recent years, various antenna devices that can be built in a housing of a device have been proposed. For example, Patent Literature 1 discloses, as an example of such an antenna device, an example of a small and thin antenna device.

CITATION LIST

Patent Literature

Patent Literature 1: Japanese Laid-open Patent Publication No. 2016-146558

SUMMARY

Technical Problem

On the other hand, in a case where an antenna device is built in a housing of a communication device, a situation can be assumed in which the antenna device is installed in a limited space in the housing. In such a situation, the antenna device may be installed close to another metal component in the communication device, and thus it is desired to implement an antenna device capable of further reducing an influence on a radiation pattern that results from proximity to the metal component. In addition, in a situation where the antenna device is installed in a limited space in the housing, it can be assumed that a method of arranging a feeding point or feeding line for feeding power to an antenna element of the antenna device is limited. In particular, it is preferable that the feeding line is arranged so that the influence (for example, distortion of the radiation pattern) on the radiation pattern formed by the antenna device can be further suppressed.

In view of such a situation, the present disclosure proposes a technology for implementing an antenna device capable of further reducing an influence of proximity to a metal and feeding power to an antenna element in a more suitable manner.

Solution to Problem

According to the present disclosure, an antenna device is provided that includes: a substantially-flat-plate-shaped dielectric substrate; a metal base plate arranged on a first surface of the dielectric substrate; substantially-flat-plate-shaped first and second antenna elements arranged on a second surface of the dielectric substrate that is opposite to the first surface and on an opposite side of the dielectric substrate from the metal base plate so that a slit is formed; a first feeding portion that feeds power to the first antenna element; and a second feeding portion that feeds power to the second antenna element, wherein a phase difference between feeding signals supplied to the first and second feeding portions, respectively, is approximately 180 degrees.

Moreover, according to the present disclosure, a communication device is provided that includes: an antenna device; and a communication unit that transmits or receives a wireless signal via the antenna device, wherein the antenna device includes: a substantially-flat-plate-shaped dielectric substrate; a metal base plate arranged on a first surface of the dielectric substrate; substantially-flat-plate-shaped first and second antenna elements arranged on a second surface of the dielectric substrate that is opposite to the first surface and on an opposite side of the dielectric substrate from the metal base plate so that a slit is formed; a first feeding portion that feeds power to the first antenna element; and a second feeding portion that feeds power to the second antenna element, and a phase difference between feeding signals supplied to the first and second feeding portions, respectively, is approximately 180 degrees.

Advantageous Effects of Invention

As described above, according to the present disclosure, a technology for implementing an antenna device capable of further reducing an influence of proximity to a metal and feeding power to an antenna element in a more suitable manner is provided.

Note that the above effects are not necessarily limitative, and any of the effects described in the present specification, or other effects that can be understood from the present specification can be obtained in addition to or in place of the above effects.

DESCRIPTION OF EMBODIMENTS

Hereinafter, preferred embodiments of the present disclosure will be described in detail with reference to the accompanying drawings. Note that, in the present specification and the drawings, constituent elements having substantially the same functional configuration are designated by the same reference signs, and an overlapping description is omitted.

The description will be provided in the following order.

1. Schematic Configuration
2. Study on Configuration and Characteristics of Antenna Device
3. Technical Features
3.1. Configuration of Antenna Device
3.2. Functional Configuration of Wireless Communication Unit
3.3. Example: Antenna Characteristic Simulation
3.4. Modified Example
4. Application Example
5. Conclusion

1. SCHEMATIC CONFIGURATION

First, an example of a schematic functional configuration of a communication device according to an embodiment of the present disclosure will be described. The communication device according to the present embodiment is configured to be able to perform communication with another device (for example, another communication device such as a base station or a terminal device) via a wireless communication path. For example, FIG. 1 is a block diagram illustrating an example of a schematic functional configuration of the communication device according to the embodiment of the present disclosure.

Figure 1:
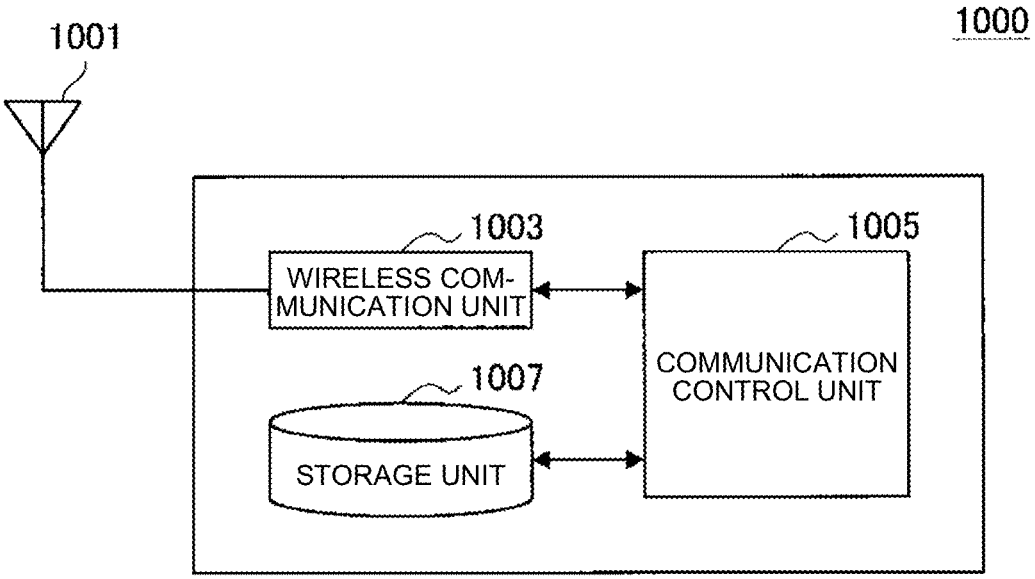
FIG. 1 is a block diagram illustrating an example of a schematic functional configuration of a communication device according to an embodiment of the present disclosure.

As illustrated in FIG. 1, a communication device 1000 according to the present embodiment includes an antenna unit 1001, a wireless communication unit 1003, a storage unit 1007, and a communication control unit 1005.

(1) Antenna Unit 1001

The antenna unit 1001 radiates, as a radio wave, a signal output by the wireless communication unit 1003 into a space. Further, the antenna unit 1001 converts a radio wave in the space into a signal and outputs the signal to the wireless communication unit 1003. Note that details of an example of an antenna device configuring the antenna unit 1001 will be described later.

(2) Wireless Communication Unit 1003

The wireless communication unit 1003 performs communication with another communication device via the antenna unit 1001. For example, the wireless communication unit 1003 may generate a transmission signal by modulating data to be transmitted based on a predetermined modulation method, and may transmit the transmission signal to another communication device via the antenna unit 1001. Further, the wireless communication unit 1003 may demodulate data transmitted from another communication device by acquiring a reception result of a signal transmitted from another communication device via the antenna unit 1001, and performing demodulation processing on the reception result.

(3) Storage Unit 1007

The storage unit 1007 temporarily or permanently stores a program and various data for operation of the communication device 1000.

(4) Communication Control Unit 1005

The communication control unit 1005 controls operation of the wireless communication unit 1003 to control communication with another communication device. For example, the communication control unit 1005 may control the operation of the wireless communication unit 1003 so that desired data is transmitted to another communication device. Further, the communication control unit 1005 may control the operation of the wireless communication unit 1003 so that data transmitted from another communication device is demodulated.

Hereinabove, the example of the schematic functional configuration of the communication device according to the embodiment of the present disclosure has been described with reference to FIG. 1.

2. STUDY ON CONFIGURATION AND CHARACTERISTICS OF ANTENNA DEVICE

Next, an example of a configuration of the antenna device will be described as a comparative example, and then a technical problem in implementing the communication device according to the embodiment of the present disclosure will be described, particularly focusing on a part related to the antenna device.

As described above, in recent years, a technology called Internet of Things (IoT) that connects various things to a network has attracted attention, and not only a typical wireless communication device such as a smartphone, but also various devices have been proposed as a communication device capable of performing communication via a wireless communication path. Such devices also include a device called a home appliance such as a television receiver. The shape and size of the antenna device for realizing wireless communication have been diversified, and in particular, in recent years, various antenna devices that can be built in a housing of a device have been proposed.

On the other hand, in a case where an antenna device is built in a housing of a communication device, a situation can be assumed in which the antenna device is installed in a limited space in the housing. In such a situation, the antenna device may be installed close to another metal component in the communication device, and thus, in this situation, a radiation pattern formed by the antenna device may be distorted due to an influence of the metal component. Therefore, in a case of assuming a situation in which the antenna device can be positioned close to another metal component, such as a case where the antenna device is built in the housing of the communication device, it is desired to implement an antenna device capable of further reducing an influence on the radiation pattern.

In addition, in a situation where the antenna device is installed in a limited space in the housing, it can be assumed that a method of arranging a feeding point or feeding line for feeding power to an antenna element of the antenna device is limited. Specifically, depending on a position of a feeding point of an antenna element (for example, a radiation metal plate) for the antenna device to transmit or receive a wireless signal, positions where a feeding pin and a feeding line for feeding, to the feeding point, a feeding signal from a feeding circuit (for example, a component corresponding to the wireless communication unit 1003 illustrated in FIG. 1) may be limited. In particular, when the feeding pin or feeding line is positioned in a radiation direction of the antenna element, the radiation pattern formed by the antenna element may be distorted. Therefore, in view of such a situation, it is more preferable that the feeding pin or feeding line is arranged so that the influence on the radiation pattern formed by the antenna element can be further reduced.

Comparative Example 1

Here, in order to make features of the antenna device according to the embodiment of the present disclosure easier to understand, an example of the antenna device will be described as a comparative example. For example, FIGS. 2 to 5 are diagrams for describing an example of a configuration of the antenna device according to Comparative Example 1, and illustrate an example of a configuration of the antenna device capable of further reducing the influence on the radiation pattern even in a situation where the antenna device can be positioned close to a metal component. Note that, in the following description, the antenna device according to Comparative Example 1 illustrated in FIGS. 2 to 5 is also referred to as an "antenna device 700" for convenience in order to distinguish the antenna device from an antenna device having a different configuration.

Figure 2:
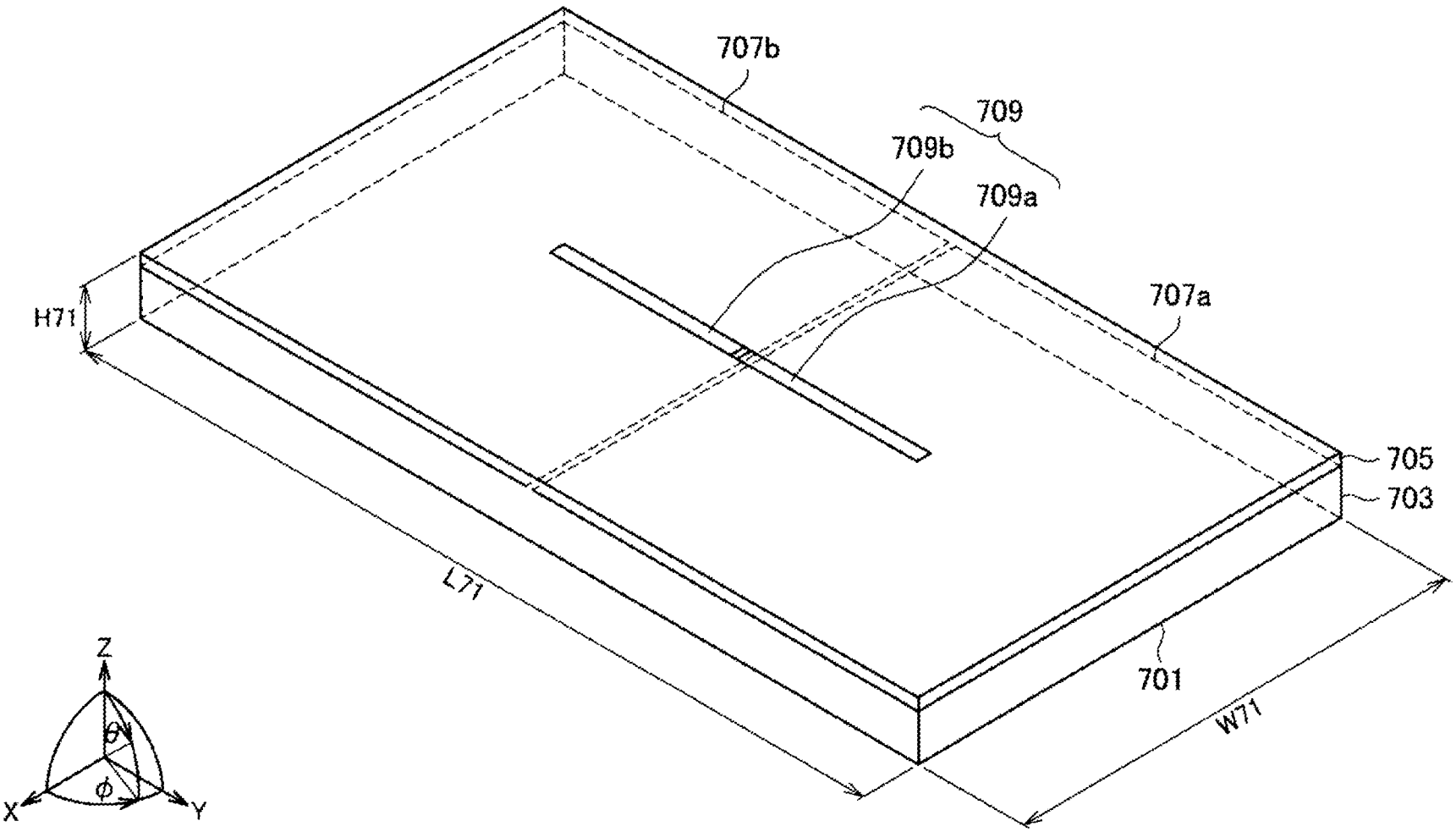
FIG. 2 is a view for describing an example of a configuration of an antenna device according to Comparative Example 1.

For example, FIG. 2 illustrates a schematic perspective view of the antenna device according to Comparative Example 1. As illustrated in FIG. 2, the antenna device 700 according to Comparative Example 1 has a substantially flat plate shape. In the following description, a normal direction of a plane (for example, an upper surface) of the substantially-flat-plate-shaped antenna device 700 will be referred to as a "Z direction". Further, two directions (that is, a direction parallel to the plane of the substantially-flat-plate-shaped antenna device 700) orthogonal to the Z direction and orthogonal to each other are referred to as an "X direction" and a "Y direction", respectively. Further, FIG. 3 is a side view of the antenna device 700 illustrated in FIG. 2, and illustrates the example of the schematic configuration of the antenna device 700 when viewed from the X direction.

Figure 3:
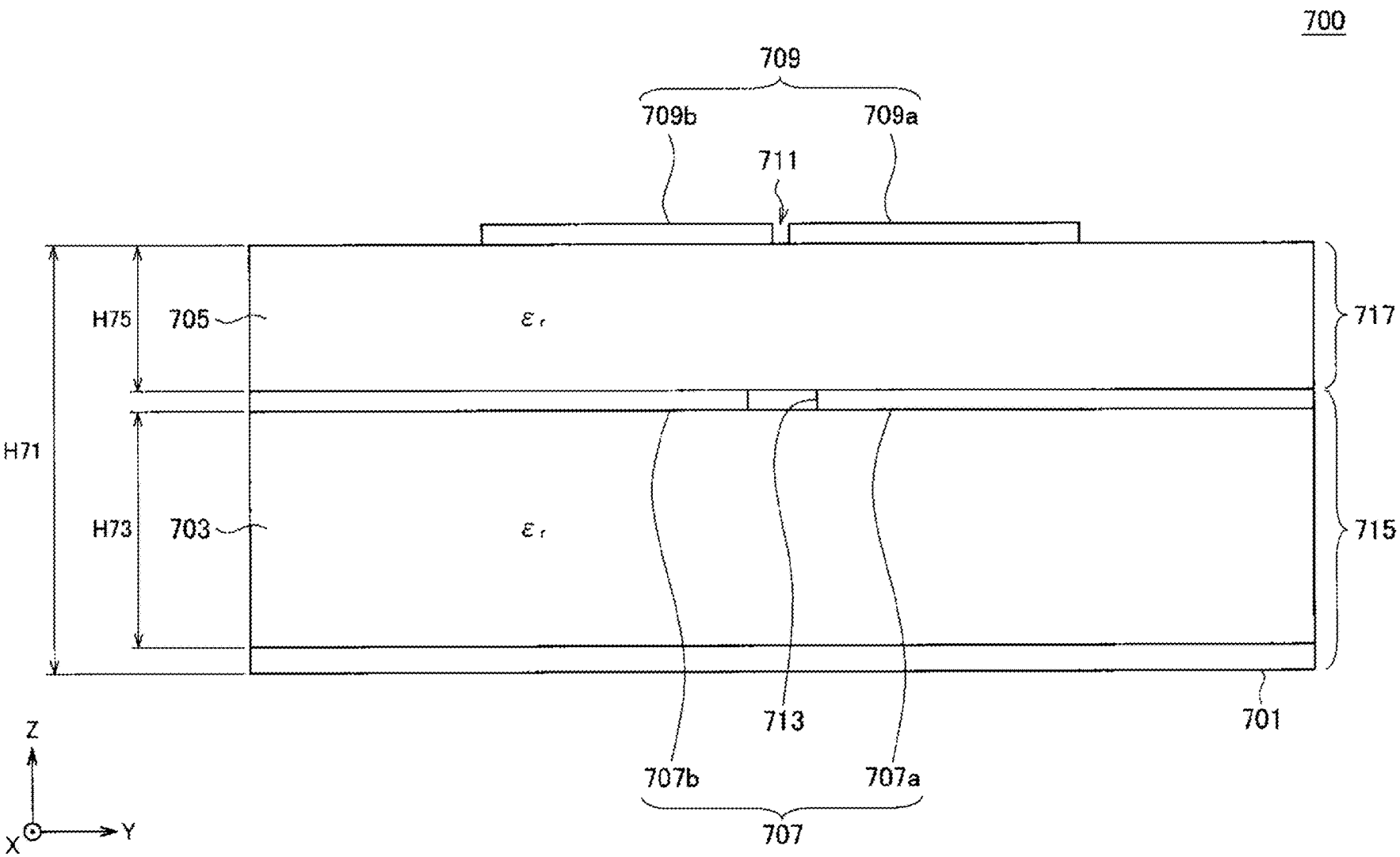
FIG. 3 is a view for describing the example of the configuration of the antenna device according to Comparative Example 1.

As illustrated in FIGS. 2 and 3, the antenna device 700 includes a metal layer 701, dielectric layers 703 and 705, a radiating element layer 707, and a non-contact feeding element 709. Note that, in the following description, Reference Sign H71 indicates the thickness of the antenna device 700 in the Z direction. Further, Reference Sign H73 indicates the thickness of the dielectric layer 703 in the Z direction. Similarly, Reference Sign H75 indicates the thickness of the dielectric layer 705 in the Z direction.

The dielectric layer 703 is formed in a substantially flat plate shape, and has one surface (a surface in the −z direction) on which the substantially-flat-plate-shaped metal layer 701 is formed so as to cover substantially the entire surface. Further, the radiating element layer 707 is provided on the other surface (a surface in the +z direction) of the dielectric layer 703. Note that, in the following description, the +Z direction is also referred to as "upward" and the −Z direction is also referred to as "downward" for convenience. That is, among the respective surfaces of the dielectric layer 703, the surface in the +Z direction is also referred to as an "upper surface", and the surface in the −Z direction is also referred to as a "lower surface". The same applies to other layers (for example, the metal layer 701, the dielectric layer 705, and the radiating element layer 707) included in the antenna device 700. Further, in the following description, a portion of the antenna device 700 that is configured by stacking the metal layer 701, the dielectric layer 703, and the radiating element layer 707 is also referred to as a "lower layer portion 715" for convenience.

Figure 4:
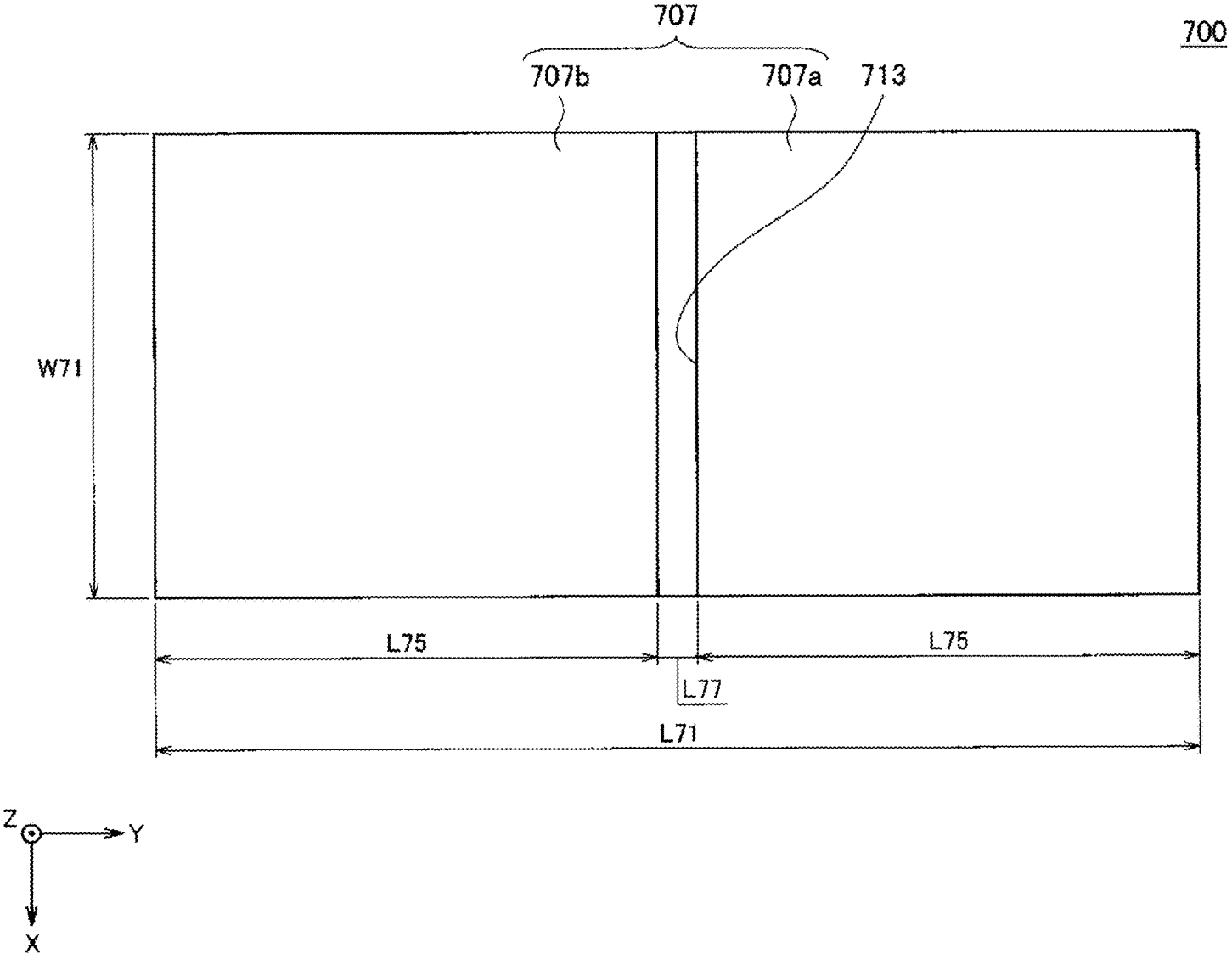
FIG. 4 is a view for describing the example of the configuration of the antenna device according to Comparative Example 1.

For example, FIG. 4 schematically illustrates a plan view of a portion corresponding to the lower layer portion 715 of the antenna device 700, which corresponds to an example of a configuration of the portion corresponding to the lower layer portion 715 when viewed from the +Z direction. Note that, in the following description, Reference Sign W71 indicates the width of the antenna device 700 in the X direction. Further, Reference Sign L71 indicates the width of the antenna device 700 in the Y direction.

As illustrated in FIGS. 3 and 4, the radiating element layer 707 has a configuration corresponding to a so-called plate-shaped dipole antenna. That is, the radiating element layer 707 includes conductive antenna elements 707*a* and 707*b* each formed in a substantially flat plate shape. More specifically, the antenna elements 707*a* and 707*b* are arranged side by side along the Y direction above the upper surface (the surface in the +Z direction) of the dielectric layer 703 so that a slit 713 extending in the X direction is formed. Note that Reference Sign L75 indicates the width of each of the antenna elements 707*a* and 707*b* in the Y direction. Further, Reference Sign L77 indicates the width of the slit 713 in the Y direction.

Further, as illustrated in FIGS. 2 and 3, the substantially-flat-plate-shaped dielectric layer 705 is stacked on the upper surface (the surface in the +Z direction) of the radiating element layer 707, and the non-contact feeding element 709 is arranged on the upper surface of the dielectric layer 705. Note that, in the following description, a portion of the antenna device 700 that is arranged on the upper surface of the lower layer portion 715, that is, a portion including the dielectric layer 705 and the non-contact feeding element 709 is also referred to as an "upper layer portion 717" for convenience.

Figure 5:
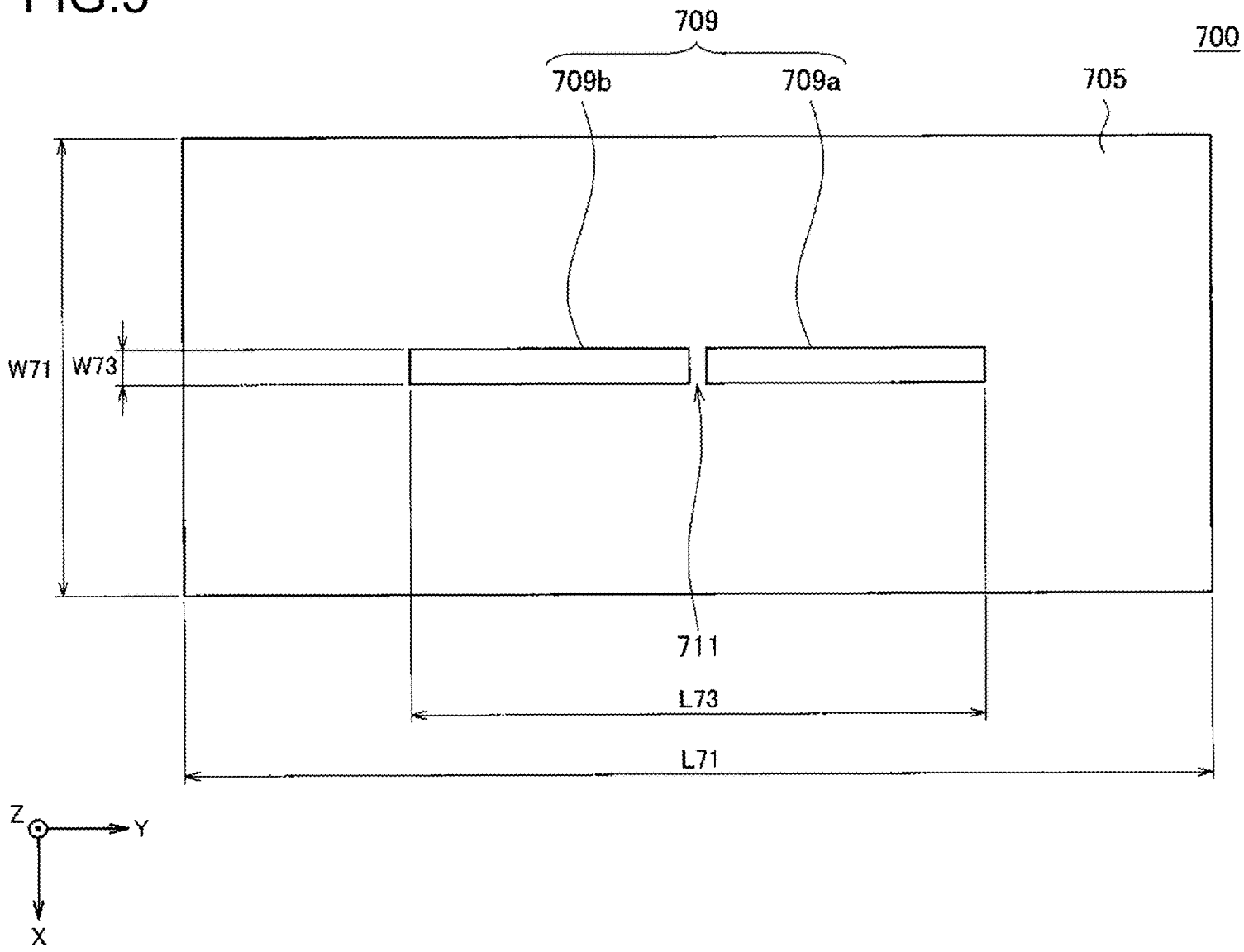
FIG. 5 is a view for describing the example of the configuration of the antenna device according to Comparative Example 1.

For example, FIG. 5 schematically illustrates a plan view of a portion corresponding to the upper layer portion 717 of the antenna device 700, which corresponds to an example of a configuration of the portion corresponding to the upper layer portion 717 when viewed from the +Z direction. As illustrated in FIGS. 3 and 5, the non-contact feeding element 709 has a configuration corresponding to a so-called dipole antenna, and is operated as a feeding element of the antenna device 700. Specifically, the non-contact feeding element 709 includes conductive antenna elements 709*a* and 709*b* which are elongated so as to extend in a direction (Y direction) orthogonal to the direction (X direction) in which the slit 713 extends. Further, a position corresponding to the center of the non-contact feeding element 709 (that is, a position corresponding to between the antenna elements 709*a* and 709*b*) is a feeding point 711 of the antenna device 700. Reference Sign W73 indicates the width of the non-contact feeding element 709 in the X direction. Further, Reference Sign L73 indicates the width of the non-contact feeding element 709 in the Y direction.

Next, an example of a characteristic simulation result of the antenna device 700 according to Comparative Example 1 will be described.

First, simulation conditions will be described below. In this simulation, each condition is set under the assumption that the antenna device 700 transmits or receives a 2.45 GHz wireless signal. Specifically, as the dimensions of the antenna device 700, the width W71 in the X direction is 30 mm, the width L71 in the Y direction is 55 mm, and the thickness H71 in the Z direction is 4 mm. Note that the widths of the metal layer 701, the dielectric layer 703, the dielectric layer 705, and the radiating element layer 707 in the X direction and the Y direction are substantially equal to the width W71 of the antenna device 700 in the X direction and the width L71 of the antenna device 700 in the Y direction, respectively. As the dimension of each of the antenna elements 707*a* and 707*b* included in the radiating element layer 707, the width L75 in the Y direction is 27.25 mm. As the dimension of the dielectric layer 703, the thickness H73 is 3.2 mm. As the dimension of the dielectric layer 705, the thickness H75 is 0.8 mm. Further, as the dielectric layers 703 and 705, those having a relative permittivity $\varepsilon_r$ of 2.65 are used. As for the non-contact feeding element 709, the width W73 in the X direction is 1 mm and the width L73 in the Y direction is 26 mm.

Under the above conditions, a simulation was performed for each characteristic of the antenna device 700 according to Comparative Example 1. FIGS. 6 to 10 are diagrams each illustrating an example of a simulation result for each characteristic of the antenna device 700 according to Comparative Example 1.

Figure 6:
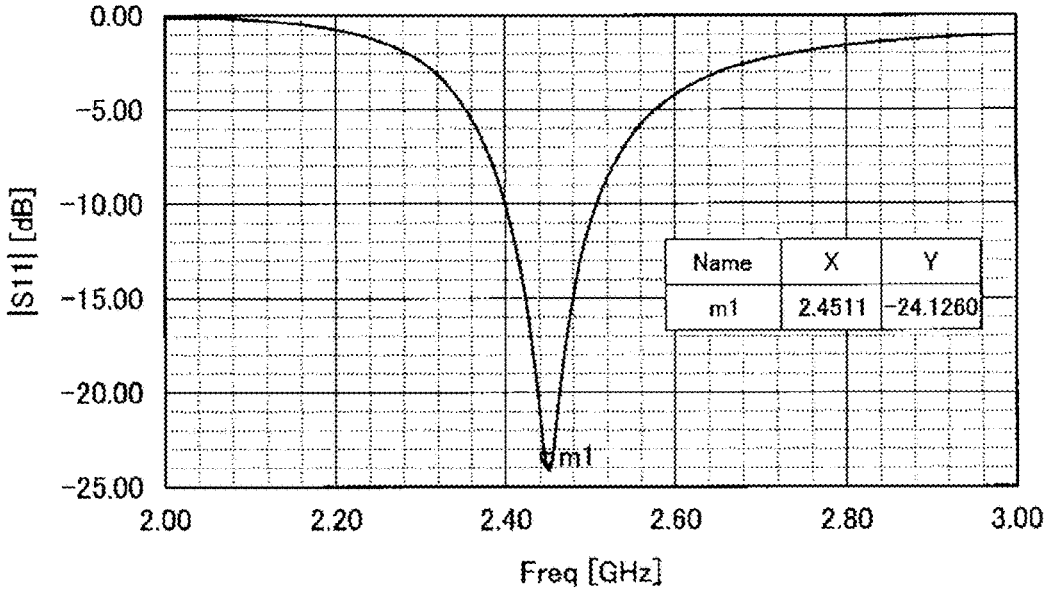
FIG. 6 is a diagram illustrating an example of a reflection characteristic simulation result of the antenna device according to Comparative Example 1.

Specifically, FIG. 6 is a diagram illustrating an example of a reflection characteristic simulation result of the antenna device 700 according to Comparative Example 1. In FIG. 6, a horizontal axis represents frequency (GHz) and a vertical axis represents reflection coefficient S11 (dB). As illustrated in FIG. 6, it can be seen that reflection (reflection coefficient S11) is significantly reduced at a frequency near 2.45 GHz, and the antenna device 700 according to Comparative Example 1 shows a favorable characteristic in a case where transmission or reception of a 2.45 GHz wireless signal is assumed.

Figure 7:
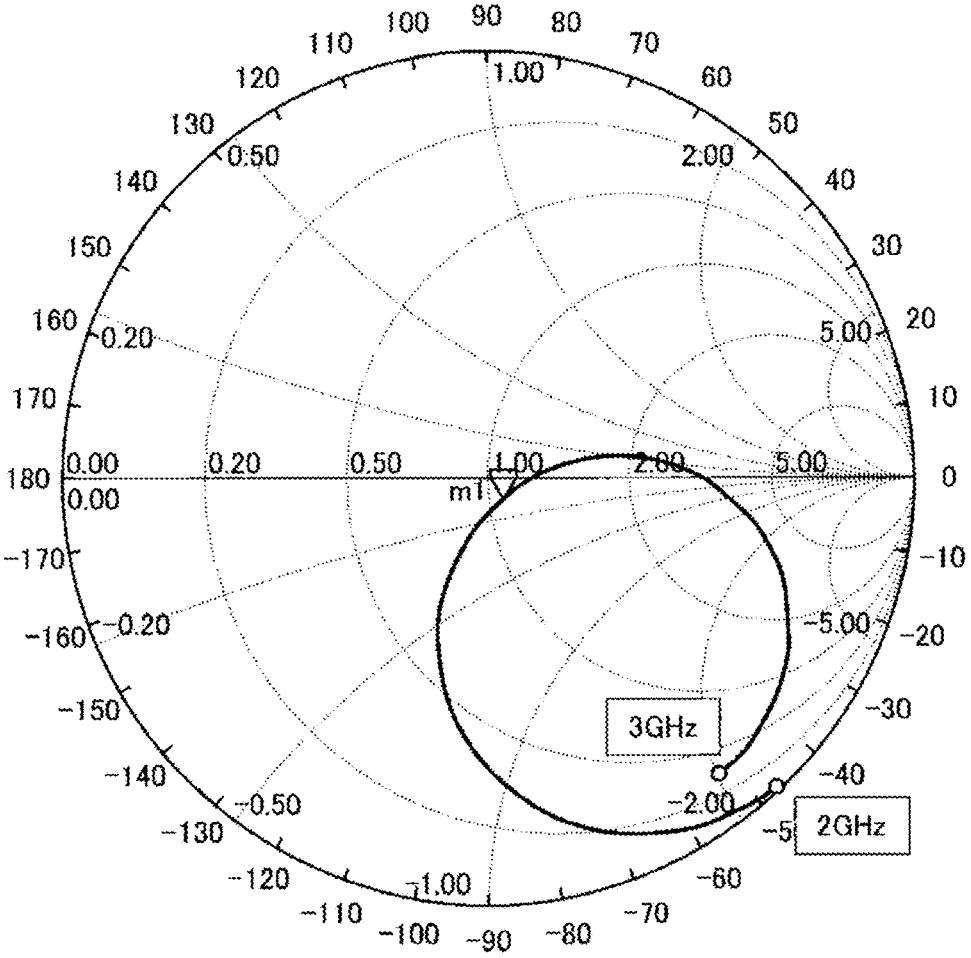
FIG. 7 is a Smith chart illustrating an example of an impedance characteristic simulation result of the antenna device according to Comparative Example 1.

FIG. 7 is a Smith chart illustrating an example of an impedance characteristic simulation result of the antenna device 700 according to Comparative Example 1. As illustrated in FIG. 7, it can be seen that the antenna device 700 according to Comparative Example 1 shows a capacitive characteristic.

Figure 8:
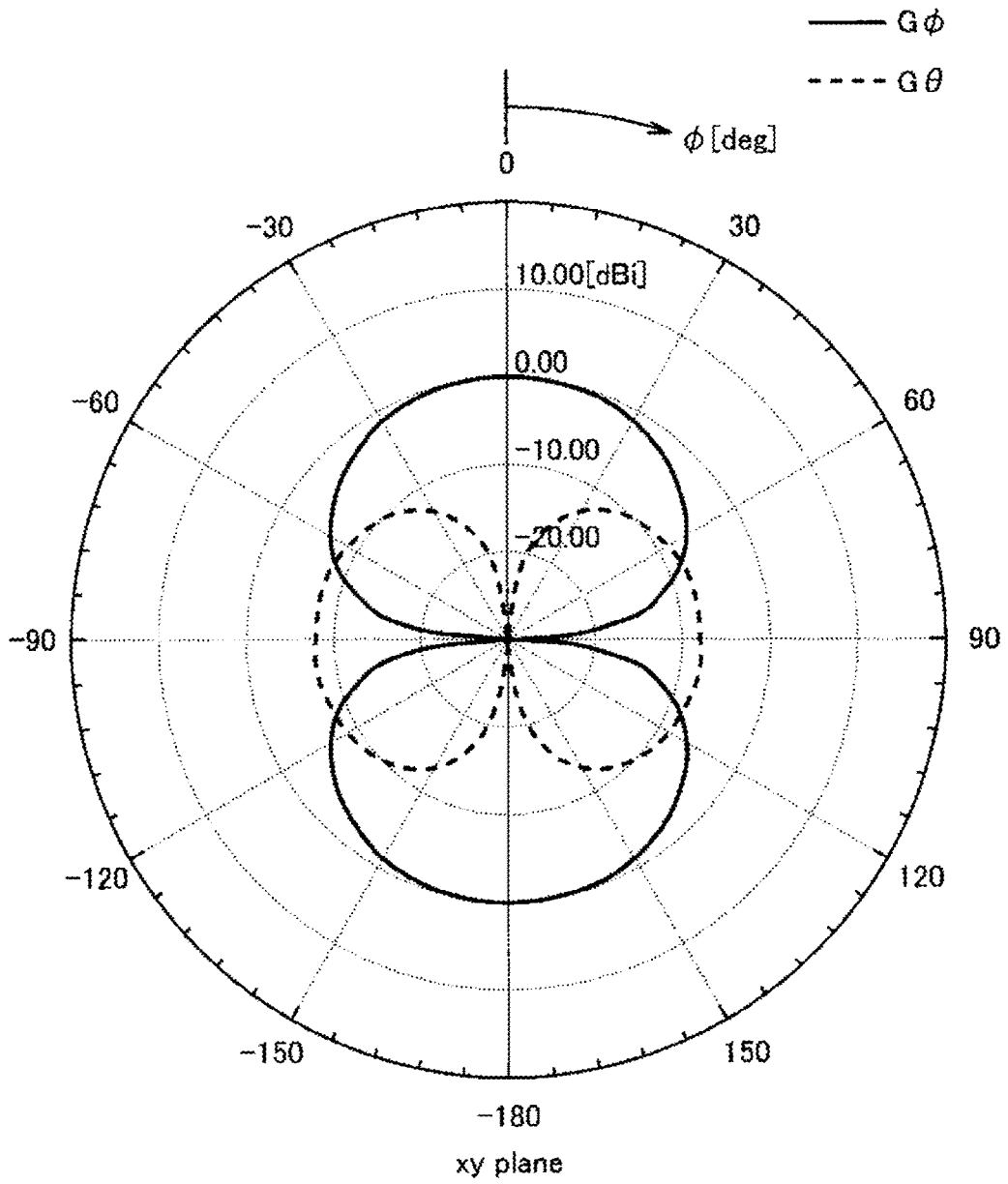
FIG. 8 is a diagram illustrating an example of a radiation pattern simulation result of the antenna device according to Comparative Example 1.
Figure 9:
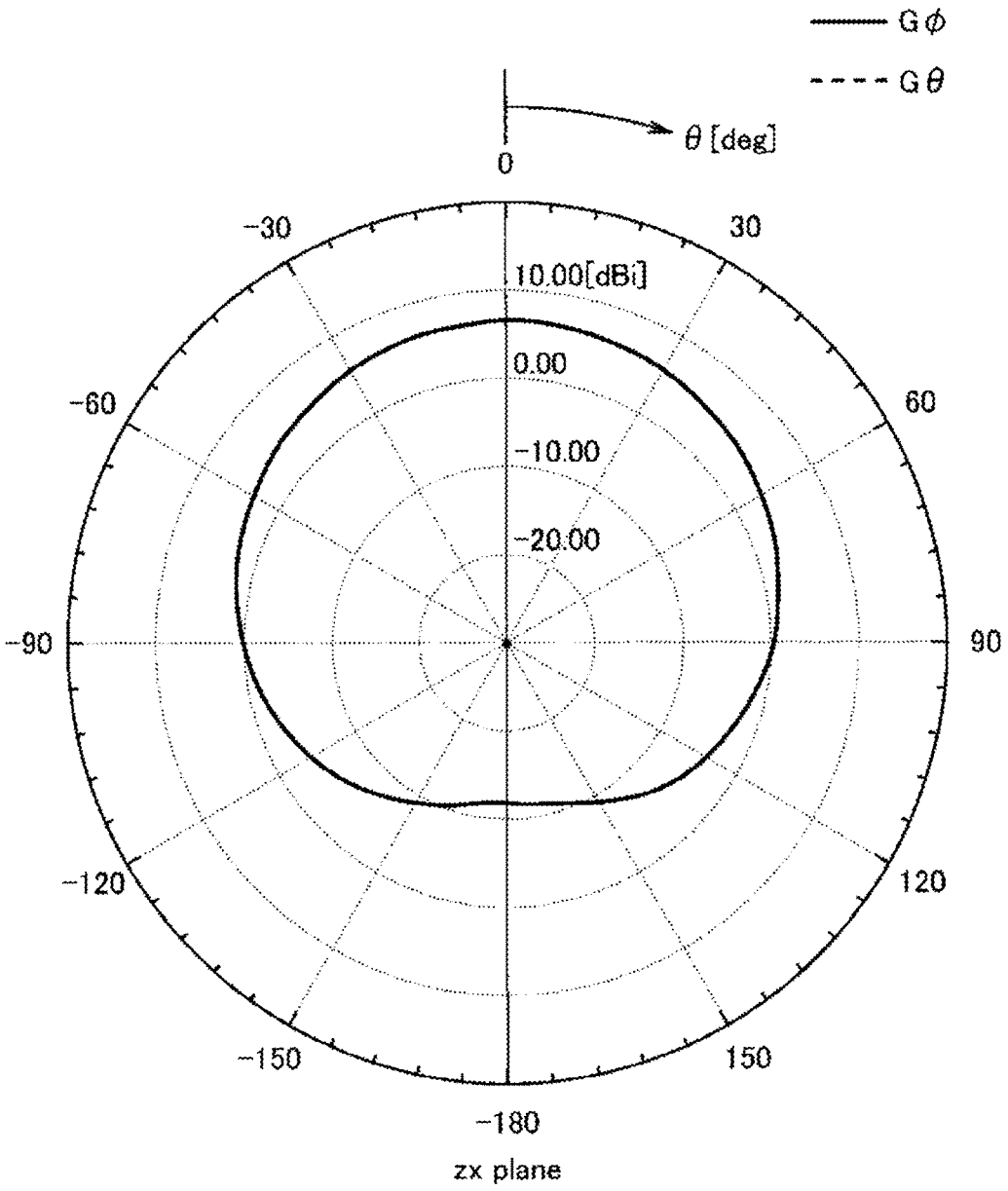
FIG. 9 is a diagram illustrating an example of a radiation pattern simulation result of the antenna device according to Comparative Example 1.
Figure 10:
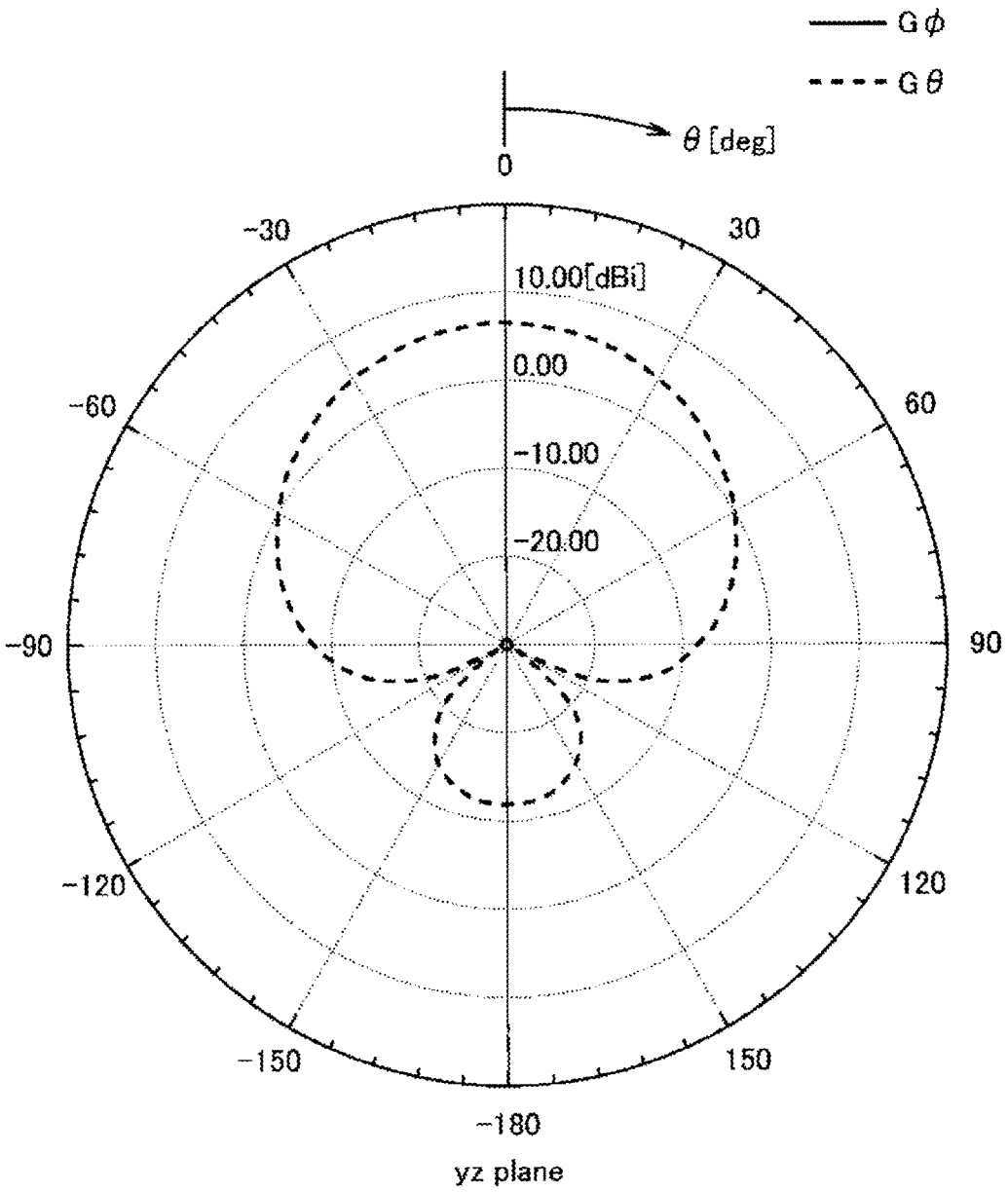
FIG. 10 is a diagram illustrating an example of a radiation pattern simulation result of the antenna device according to Comparative Example 1.

FIGS. 8 to 10 are diagrams each illustrating an example of a radiation pattern simulation result of the antenna device 700 according to Comparative Example 1. In each of FIGS. 8 to 10, a circumferential direction represents an angle (deg), a radial direction represents an operation gain (dBi), a solid line represents a θ component of the operation gain, and a broken line represents a ϕ component of the operation gain. Specifically, FIG. 8 illustrates an example of the radiation pattern in a case where the radiation pattern of the antenna device 700 is cut along a plane parallel to an XY plane in FIG. 2. FIG. 9 illustrates an example of the radiation pattern in a case where the radiation pattern of the antenna device 700 is cut along a plane parallel to an XZ plane in FIG. 2. FIG. 10 illustrates an example of the radiation pattern in a case where the radiation pattern of the antenna device 700 is cut along a plane parallel to a YZ plane in FIG. 2. As illustrated in FIGS. 8 to 10, it can be seen that the antenna device 700 according to Comparative Example 1 ideally forms a favorable radiation pattern with little distortion.

Comparative Example 2

Figure 11:
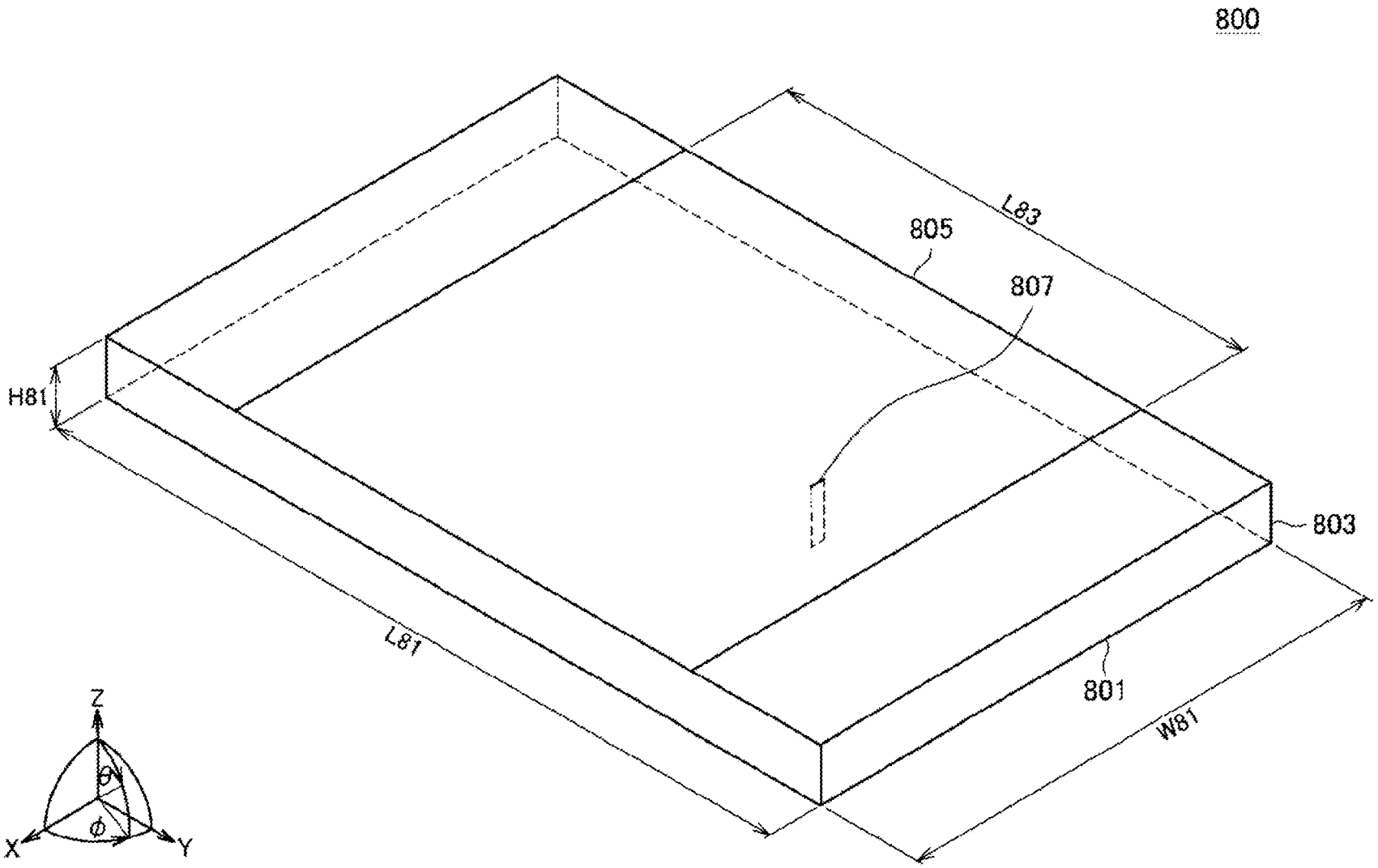
FIG. 11 is a schematic perspective view of an antenna device according to Comparative Example 2.

Next, an example of another antenna device having characteristics relatively similar to those of Comparative Example 1 will be described as Comparative Example 2. For example, FIG. 11 is a schematic perspective view of an antenna device according to Comparative Example 2, and is a view illustrating an example of a configuration of an antenna device configured as a so-called patch antenna. In the following description, a normal direction of a plane (for example, an upper surface) of a substantially-flat-plate-shaped antenna device 800 will be referred to as a "Z direction". Further, two directions (that is, a direction parallel to the plane of the substantially-flat-plate-shaped antenna device 800) orthogonal to the Z direction and orthogonal to each other are referred to as an "X direction" and a "Y direction", respectively. In the following description, the +Z direction is also referred to as "upward" and the −Z direction is also referred to as "downward" for convenience. Further, in the following description, the antenna device according to Comparative Example 2 illustrated in FIG. 11 is also referred to as the "antenna device 800" for convenience in order to distinguish the antenna device from an antenna device having a different configuration.

As illustrated in FIG. 11, the antenna device 800 according to Comparative Example 2 includes a metal base plate 801, a dielectric substrate 803, an antenna element 805, and a feeding portion 807. Note that, in the following description, Reference Signs W81, L81, and H81 denote the width of the antenna device 800 in the X direction, the width of the antenna device 800 in the Y direction, and the thickness of the antenna device 800 in the Z direction, respectively.

The dielectric substrate 803 is formed in a substantially flat plate shape, and the substantially-flat-plate-shaped metal base plate 801 is provided so as to cover substantially an entire lower surface (a surface in the −z direction). Further, the conductive antenna element 805 (that is, a radiation metal plate) formed in a flat plate shape is provided on an upper surface (a surface in the +z direction) of the dielectric substrate 803. Reference Sign L83 indicates the width of the antenna element 805 in the Y direction. Further, the feeding portion 807 is provided so that a part of the antenna element 805 is used as a feeding point and power is fed from the lower surface side (that is, a side facing the dielectric substrate 803) of the antenna element 805 to the feeding point. The feeding portion 807 includes, for example, a feeding pin and a feeding line that supplies a feeding signal from a feeding circuit to the feeding pin. It is a matter of course that a configuration of the feeding portion 807 is not particularly limited as long as power can be fed to the feeding point.

Next, an example of a characteristic simulation result of the antenna device 800 according to Comparative Example 2 will be described.

First, simulation conditions will be described below. In this simulation, each condition is set under the assumption that the antenna device 800 transmits or receives a 2.45 GHz wireless signal. Specifically, as the dimensions of the antenna device 800, the width W81 in the X direction is 35 mm, the width L71 in the Y direction is 55 mm, and the thickness H71 in the Z direction is 4 mm. Note that the widths of the metal base plate 801 and the dielectric substrate 803 in the X direction and the Y direction are substantially equal to the width W81 of the antenna device 800 in the X direction and the width L81 of the antenna device 800 in the Y direction, respectively. Further, the width of the antenna element 805 in the X direction is substantially equal to the width W81 of the antenna device 800 in the X direction, and the width L83 in the Y direction is 35 mm. Further, as the dielectric substrate 803, one having a relative permittivity $\varepsilon_r$ of 2.65 is used.

Under the above conditions, a simulation was performed for each characteristic of the antenna device 800 according to Comparative Example 2. FIGS. 12 to 16 each illustrate an example of a simulation result for each characteristic of the antenna device 800 according to Comparative Example 2.

Figure 12:
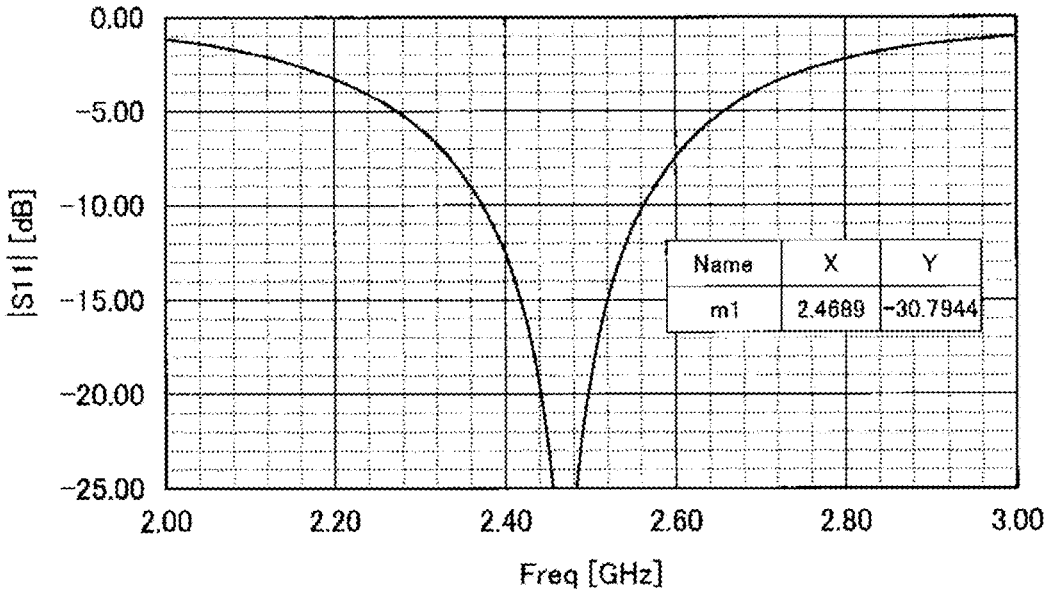
FIG. 12 is a diagram illustrating an example of a reflection property simulation result of the antenna device according to Comparative Example 2.

Specifically, FIG. 12 is a diagram illustrating an example of a reflection characteristic simulation result of the antenna device 800 according to Comparative Example 2. In FIG. 12, a horizontal axis represents frequency (GHz) and a vertical axis represents reflection coefficient S11 (dB). As illustrated in FIG. 12, it can be seen that reflection (reflection coefficient S11) is significantly reduced at a frequency near 2.45 GHz, and the antenna device 800 according to Comparative Example 2 shows a favorable characteristic in a case where transmission or reception of a 2.45 GHz wireless signal is assumed. Further, as can be seen by comparing the simulation result illustrated in FIG. 12 with the simulation result illustrated in FIG. 6, the antenna device 800 according to Comparative Example 2 and the above-described antenna device 700 according to Comparative Example 1 have similar reflection characteristics.

Figure 13:
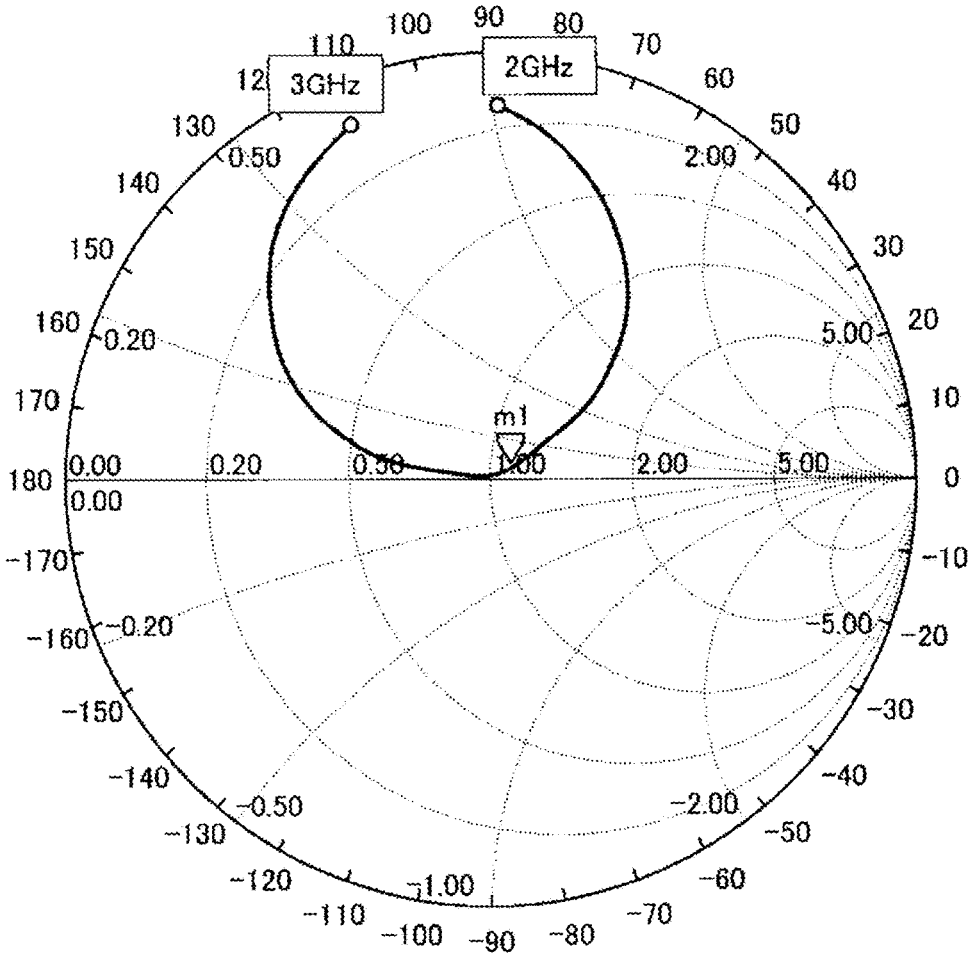
FIG. 13 is a Smith chart illustrating an example of an impedance characteristic simulation result of the antenna device according to Comparative Example 2.

FIG. 13 is a Smith chart illustrating an example of an impedance characteristic simulation result of the antenna device 800 according to Comparative Example 2. As illustrated in FIG. 8, it can be seen that the antenna device 800 according to Comparative Example 2 shows an inductive characteristic.

Figure 14:
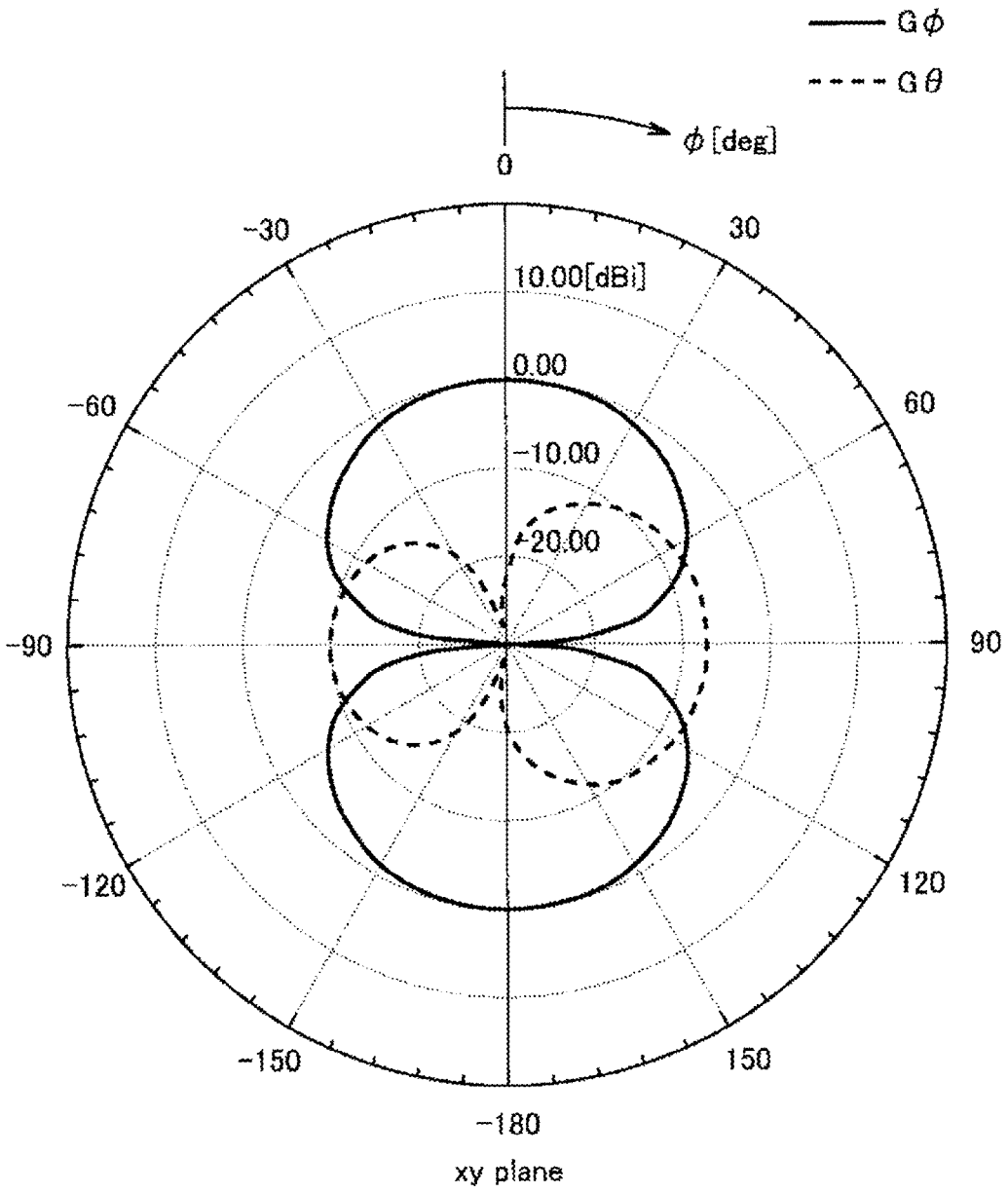
FIG. 14 is a diagram illustrating an example of a radiation pattern simulation result of the antenna device according to Comparative Example 2.
Figure 15:
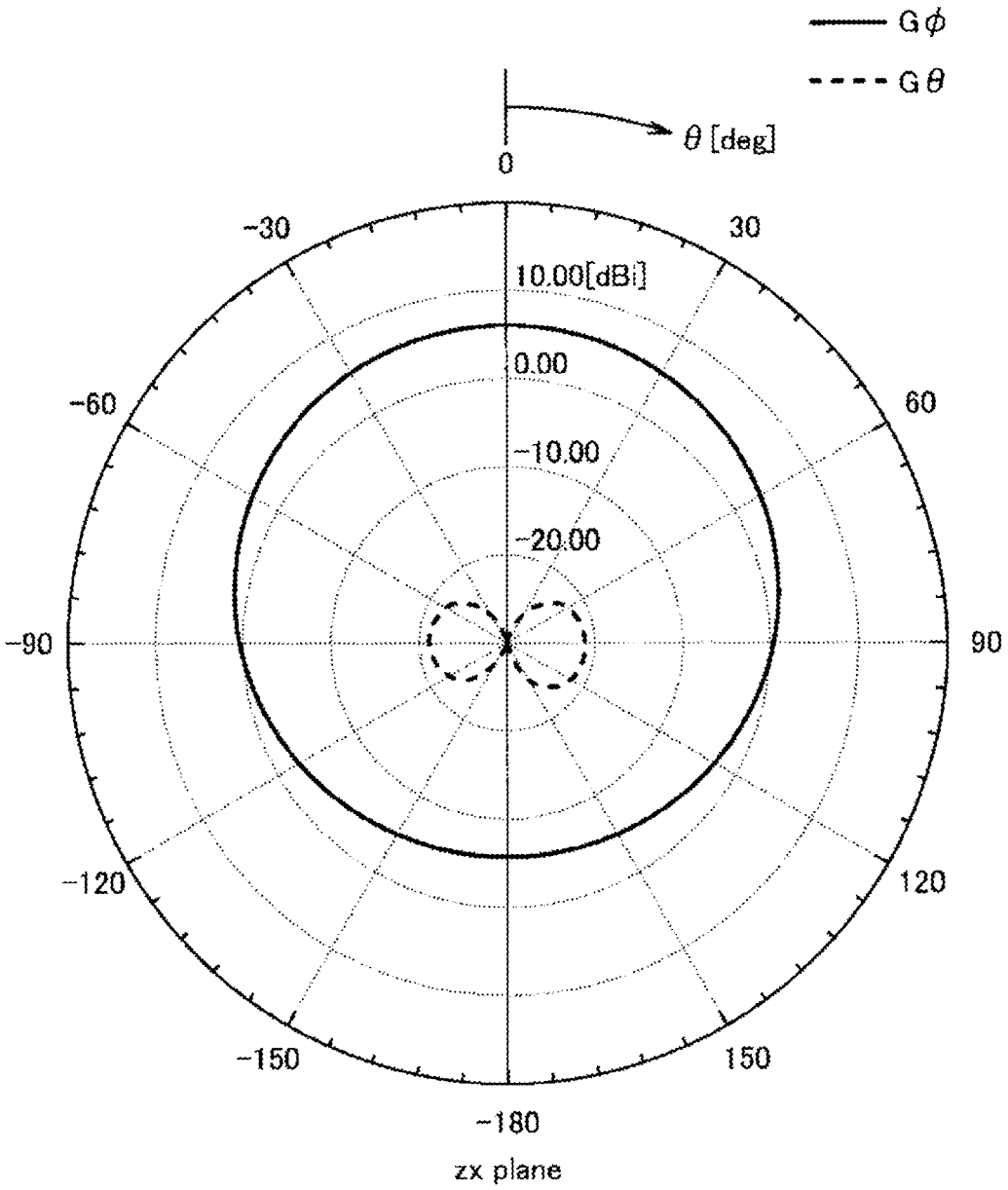
FIG. 15 is a diagram illustrating an example of a radiation pattern simulation result of the antenna device according to Comparative Example 2.
Figure 16:
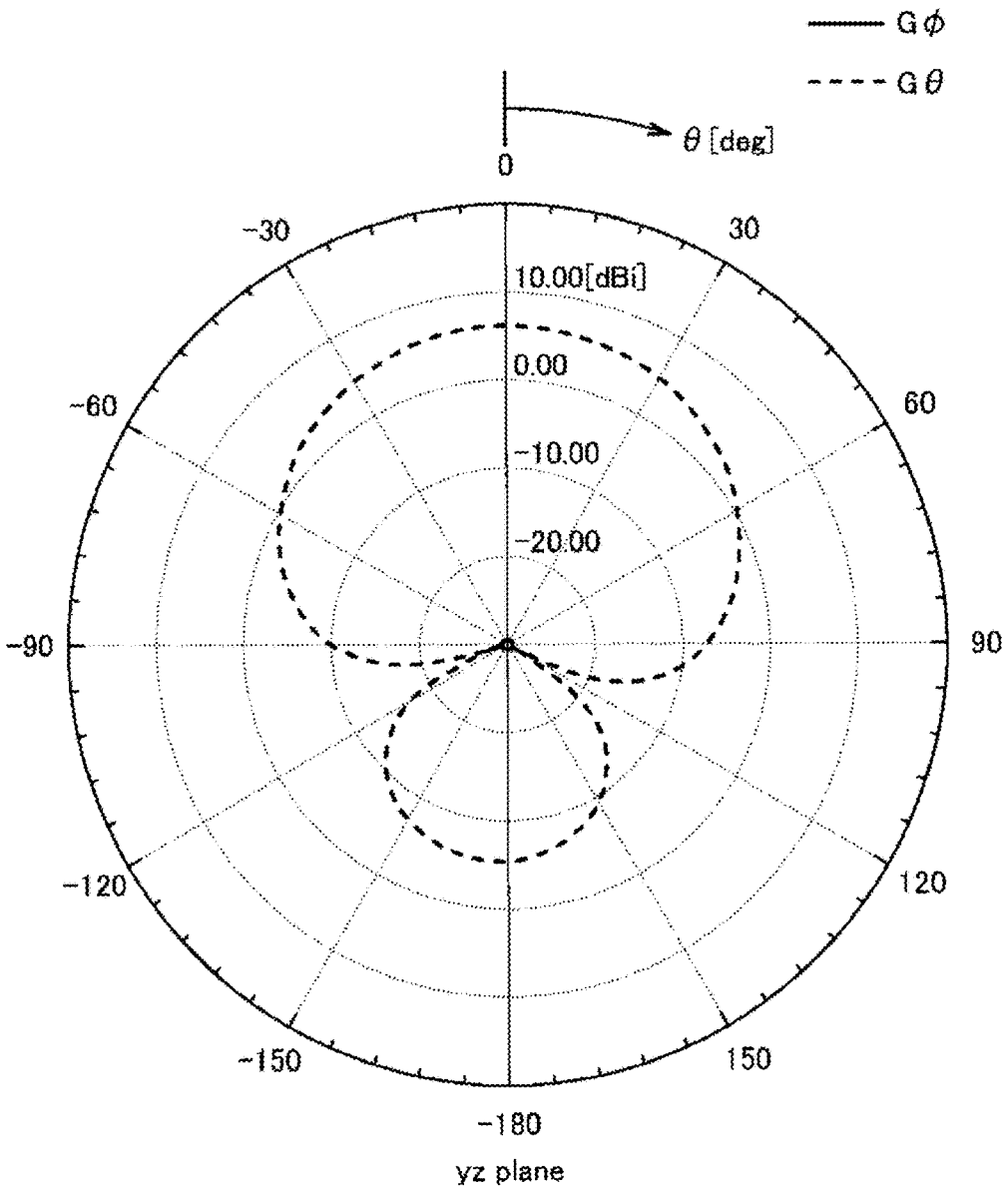
FIG. 16 is a diagram illustrating an example of a radiation pattern simulation result of the antenna device according to Comparative Example 2.

FIGS. 14 to 16 are diagrams each illustrating an example of a radiation pattern simulation result of the antenna device 800 according to Comparative Example 2. In each of FIGS. 14 to 16, a circumferential direction represents an angle (deg), a radial direction represents an operation gain (dBi), a solid line represents a θ component of the operation gain, and a broken line represents a ϕ component of the operation gain. Specifically, FIG. 14 illustrates an example of the radiation pattern in a case where the radiation pattern of the antenna device 800 is cut along a plane parallel to an XY plane in FIG. 11. FIG. 15 illustrates an example of the radiation pattern in a case where the radiation pattern of the antenna device 800 is cut along a plane parallel to an XZ plane in FIG. 11. FIG. 16 illustrates an example of the radiation pattern in a case where the radiation pattern of the antenna device 800 is cut along a plane parallel to a YZ plane in FIG. 11. As can be seen by comparing the radiation pattern simulation results illustrated in FIGS. 14 to 16 with the radiation pattern simulation results illustrated in FIGS. 8 to 10, the antenna device 800 according to Comparative Example 2 and the above-described antenna device 700 according to Comparative Example 1 form similar radiation patterns.

As described above, the antenna device 700 according to Comparative Example 1 and the antenna device 800 according to Comparative Example 2 have substantially the same dimensions and relatively similar characteristics, except for the impedance characteristic.

(Influence of Proximity to Metal on Characteristics)

Next, simulation results of an influence on characteristics when each of the antenna device 700 according to Comparative Example 1 and the antenna device 800 according to Comparative Example 2 is brought close to a metal will be described below.

Figure 17:
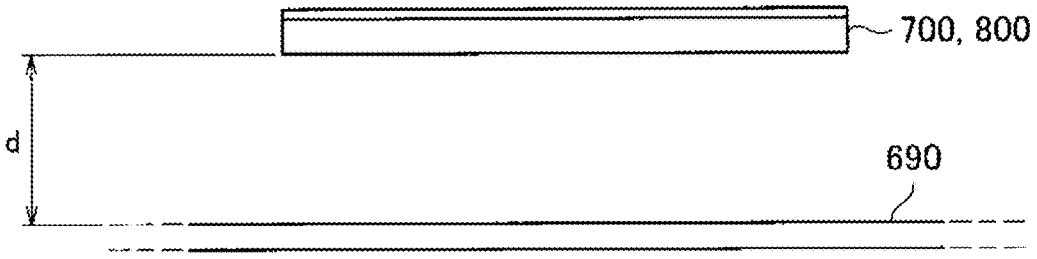
FIG. 17 is a diagram for describing an outline of a method of simulating a behavior when an antenna device is brought close to a metal.

First, an outline of a simulation method will be described with reference to FIG. 17. FIG. 17 is a diagram for describing an outline of a method of simulating a behavior when an antenna device is brought close to a metal. Specifically, a simulation is performed to check, in a case where a metal plate 690 is disposed below an antenna device (that is, the antenna device 700 or 800) as a simulation target, how the characteristics of the antenna device are changed depending on a distance d between the antenna device and the metal plate 690. Note that the metal plate 690 is assumed to be an electrically perfect conductor having an infinite size in an XY plane direction. Further, the simulation for each characteristic of the antenna device is performed when the distance d is 0 mm, 10 mm, 20 mm, and 30 mm, respectively.

Figure 18:
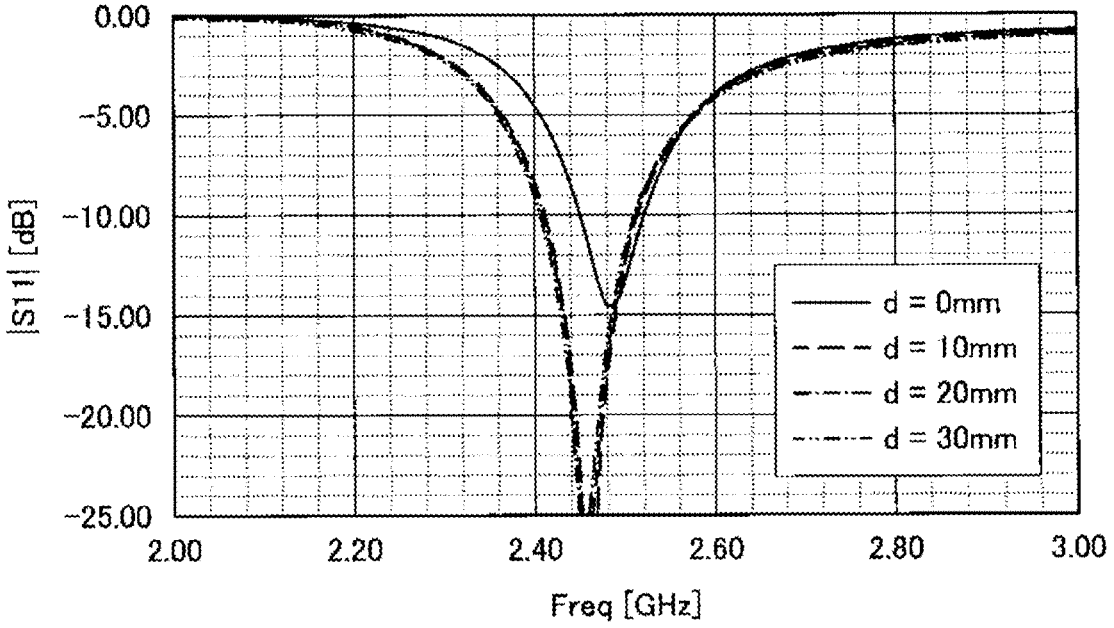
FIG. 18 is a diagram illustrating an example of a reflection characteristic simulation result of the antenna device according to Comparative Example 1.

First, a result of a simulation of a change in reflection characteristic of the antenna device when a metal is brought close to the antenna device will be described. For example, FIG. 18 is a diagram illustrating an example of a reflection characteristic simulation result of the antenna device 700 according to Comparative Example 1. Note that a vertical axis and a horizontal axis in FIG. 18 are the same as those in the examples illustrated in FIGS. 6 and 12. As illustrated in FIG. 18, it can be seen that the characteristic of the antenna device 700 according to Comparative Example 1 is hardly changed regardless of proximity to the metal plate 690, except for a case where the distance d is 0 mm (that is, a case where the antenna device 700 and the metal plate 690 are in contact with each other).

Figure 19:
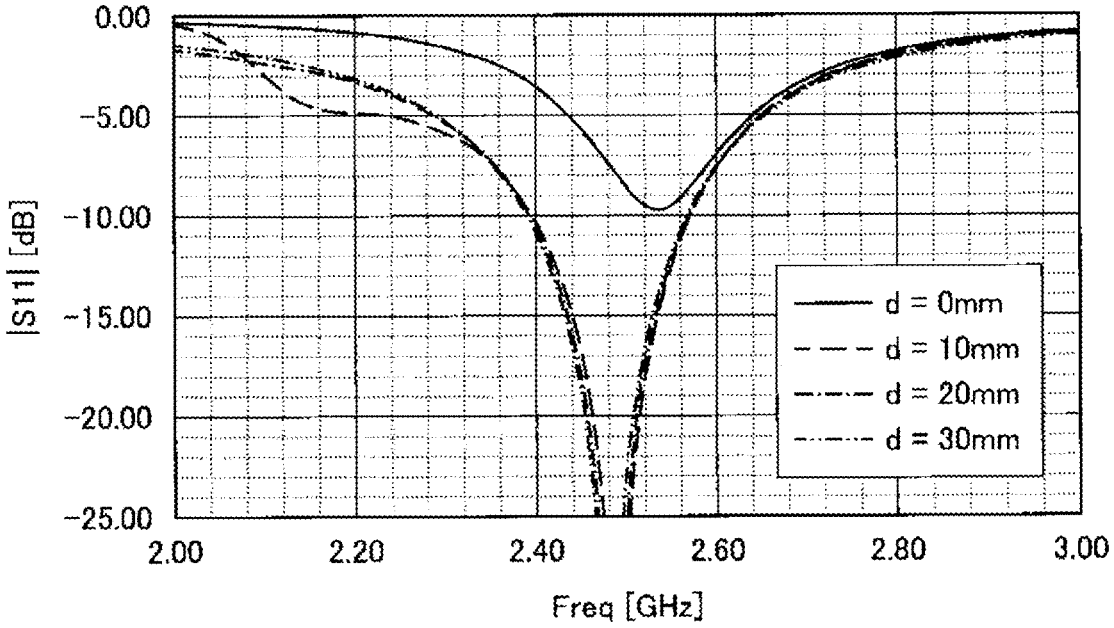
FIG. 19 is a diagram illustrating an example of a reflection characteristic simulation result of the antenna device according to Comparative Example 2.

FIG. 19 is a diagram illustrating an example of a reflection characteristic simulation result of the antenna device 800 according to Comparative Example 2. Note that a vertical axis and a horizontal axis in FIG. 19 are the same as those in the example illustrated in FIG. 18. As illustrated in FIG. 19, it can be seen that the characteristic of the antenna device 800 according to Comparative Example 2 is hardly changed regardless of proximity to the metal plate 690, except for a case where the distance d is 0 mm (that is, a case where the antenna device 800 and the metal plate 690 are in contact with each other). That is, as can be seen by comparing FIGS. 18 and 19, the antenna device 700 according to Comparative Example 1 and the antenna device 800 according to Comparative Example 2 are similar in respect to an aspect of the change in reflection characteristic (that is, an influence on the reflection characteristic) when the metal plate 690 is brought close to the antenna device 700 according to Comparative Example 1 and the antenna device 800 according to Comparative Example 2.

Figure 20:
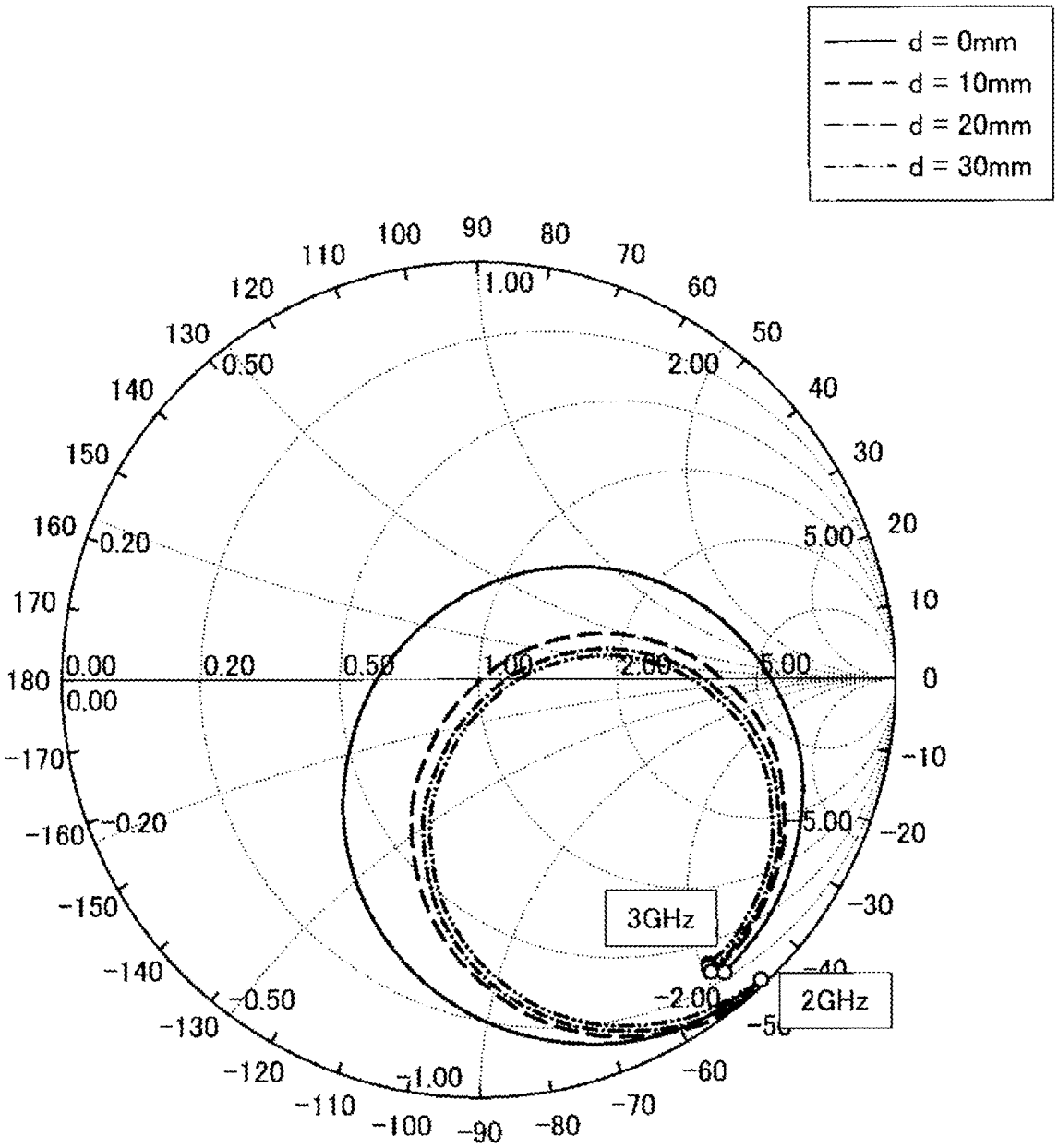
FIG. 20 is a diagram illustrating an example of an impedance characteristic simulation result of the antenna device according to Comparative Example 1.

Next, a result of a simulation of a change in impedance characteristic of the antenna device when a metal is brought close to the antenna device will be described. For example, FIG. 20 is a diagram illustrating an example of an impedance characteristic simulation result of the antenna device 700 according to Comparative Example 1. As illustrated in FIG. 18, it can be seen that the characteristic of the antenna device 700 according to Comparative Example 1 is hardly changed regardless of proximity to the metal plate 690, except for a case where the distance d is 0 mm.

Figure 21:
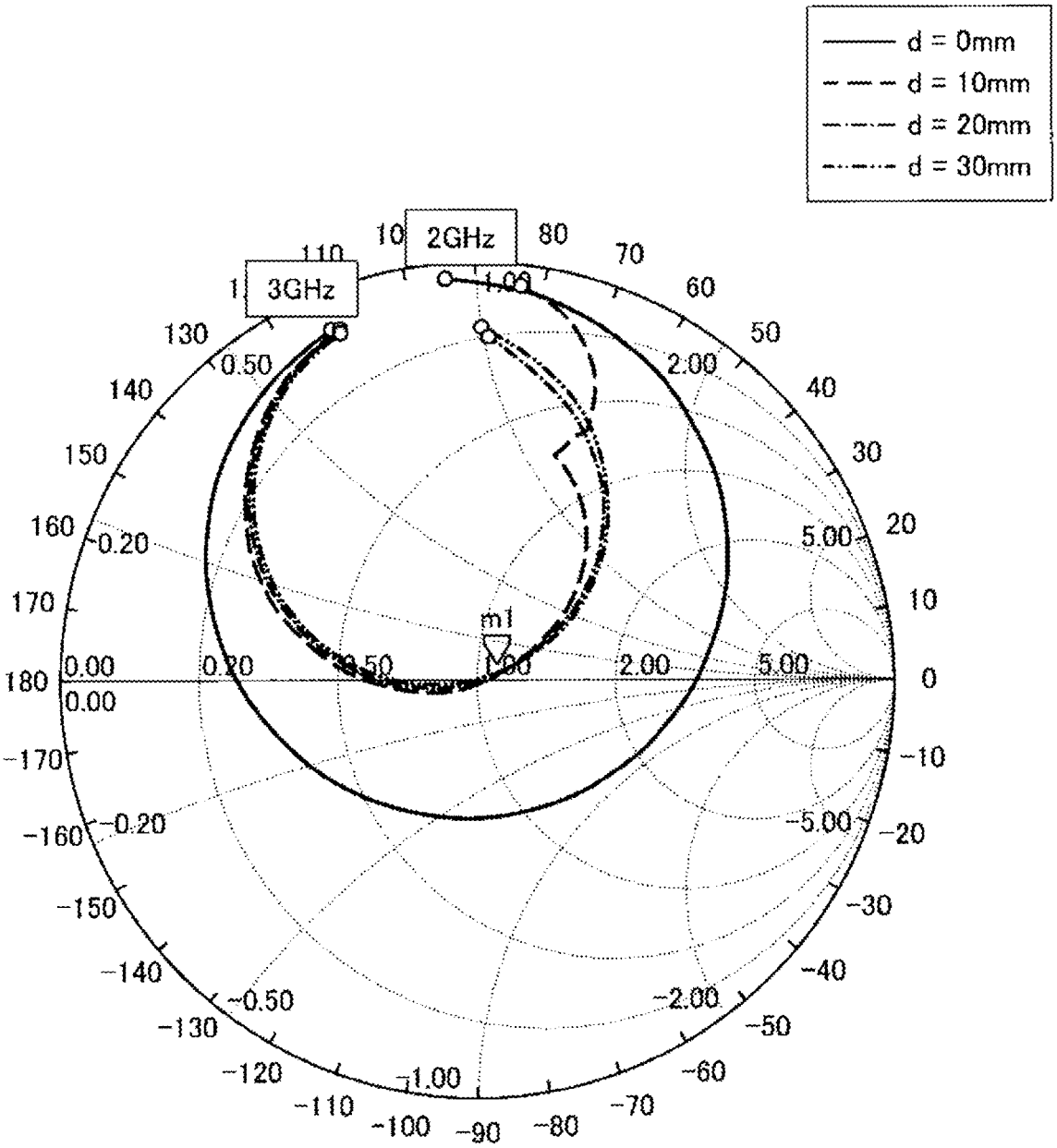
FIG. 21 is a diagram illustrating an example of an impedance characteristic simulation result of the antenna device according to Comparative Example 2.

Further, FIG. 21 is a diagram illustrating an example of an impedance characteristic simulation result of the antenna device 800 according to Comparative Example 2. As illustrated in FIG. 21, it can be seen that the characteristic of the antenna device 800 according to Comparative Example 2 is hardly changed regardless of proximity to the metal plate 690, except for a case where the distance d is 0 mm. That is, as can be seen by comparing FIGS. 20 and 21, the antenna device 700 according to Comparative Example 1 and the antenna device 800 according to Comparative Example 2 are similar in respect to an aspect of the change in impedance characteristic (that is, an influence on the impedance characteristic) when the metal plate 690 is brought close to the antenna device 700 according to Comparative Example 1 and the antenna device 800 according to Comparative Example 2.

(Study on Power Feeding Method)

Next, a power feeding method of the antenna device 700 according to Comparative Example 1 will be studied. As described with reference to FIGS. 2 to 5, it is necessary for the antenna device 700 according to Comparative Example 1 to perform power feeding by connecting two feeding lines to the feeding point 711 positioned at the center of the non-contact feeding element 709 provided on the upper surface of the dielectric layer 705, and supplying, to the two feeding lines, feeding signals whose phases are inverted (that is, balanced power feeding). In the antenna device 700, it is necessary to select the power feeding method in consideration of such configuration characteristics. For example, FIG. 22 is a diagram for describing an outline of an example of a power feeding method of the antenna device 700 according to Comparative Example 1.

Figure 22:
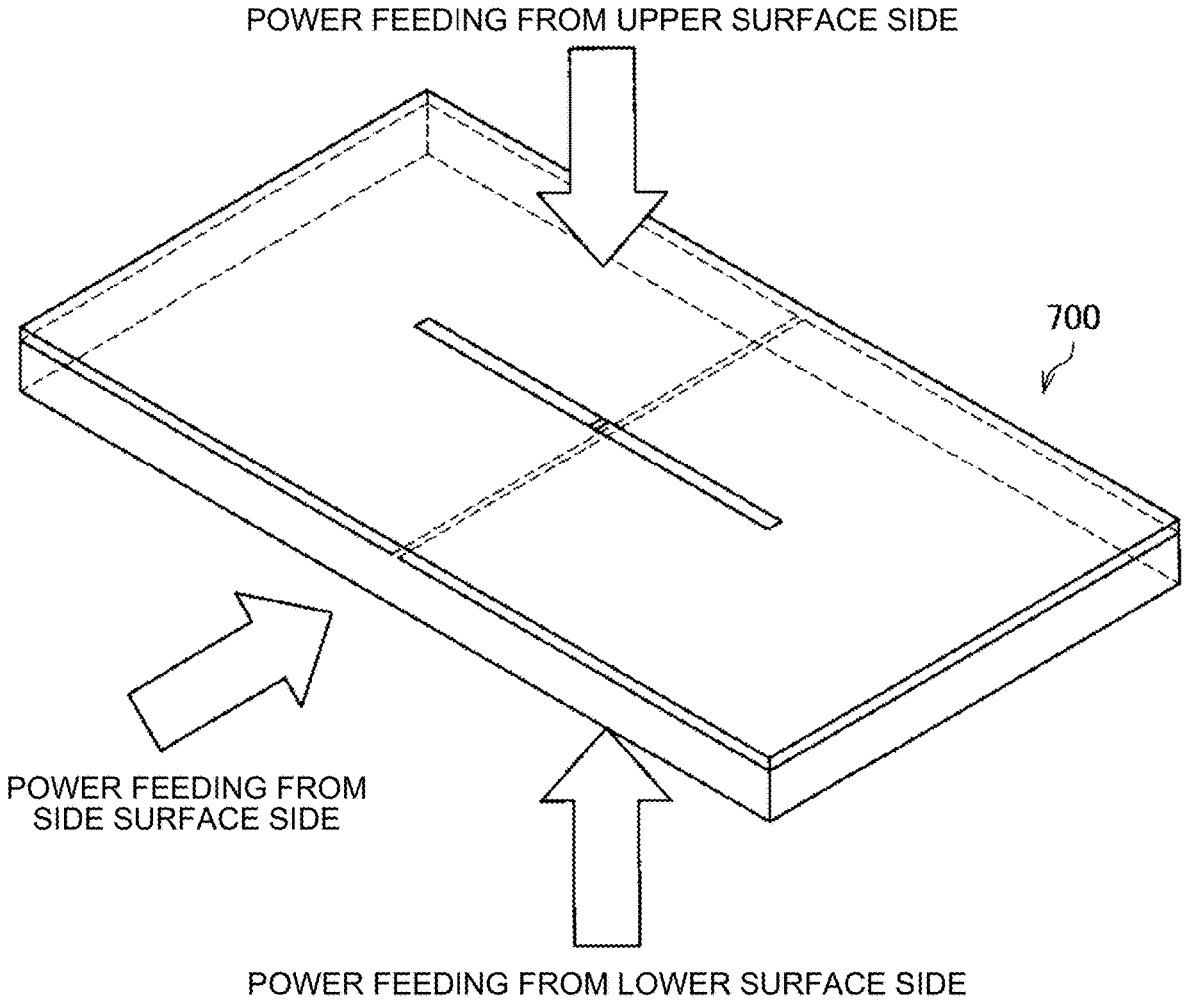
FIG. 22 is a diagram for describing an outline of an example of a power feeding method of the antenna device according to Comparative Example 1.

As illustrated in FIG. 22, in consideration of the above-described configuration characteristics, examples of the power feeding method of the antenna device 700 according to Comparative Example 1 include "a method of feeding power from the upper surface side", "a method of feeding power from the lower surface side", and "a method of feeding power from the side surface side". Therefore, an outline of each power feeding method will be described below.

First, the "method of feeding power from the upper surface side" will be described. In this method, the feeding line is arranged so as to be positioned on the upper surface side (+Z direction side) of the antenna device 700, and power is fed from the upper surface side of the antenna device 700 to the feeding point 711 via the feeding line. Due to such characteristics, in a case of adopting this method, at least a part of a radiation pattern of a wireless signal that is formed by the antenna device 700 is blocked by the feeding line, which may disturb the radiation pattern.

Next, the "method of feeding power from the lower surface side" will be described. In this method, the feeding line is arranged so as to be positioned on the lower surface side (−Z direction side) of the non-contact feeding element 709, and power is fed from the lower surface side of the non-contact feeding element 709 to the feeding point 711 via the feeding line. Due to such characteristics, in a case of adopting this method, for example, the feeding line is arranged so as to penetrate through the radiating element layer 707 in the Z direction, and a part of the feeding line is interposed between the radiating element layer 707 and the non-contact feeding element 709. Therefore, a part of the feeding line may interfere with a radiating electric field formed by the radiating element layer 707, and may affect the radiation pattern.

Next, the "method of feeding power from the side surface side" will be described. In this method, the feeding line is arranged so as to be positioned on the side surface side (for example, X direction side) of the non-contact feeding element 709, and power is fed from the side surface side of the non-contact feeding element 709 to the feeding point 711 via the feeding line. Due to such characteristics, in a case of adopting this method, it is possible to prevent a situation where the radiation pattern is blocked by the feeding line. On the other hand, since the feeding line is arranged so as to extend from the feeding point 711 toward any side in the X direction, the radiation pattern may be disturbed due to asymmetry in the X direction.

Further, as described above, the antenna device 700 according to Comparative Example 1 needs to perform balanced power feeding, and has a low affinity with a power feeding method using a so-called microstrip line.

As described above, the antenna device 700 according to Comparative Example 1 is characterized in that the characteristics are hardly changed even in a situation where a metal is brought close to the antenna device 700. However, from the viewpoint of the power feeding method, the degree of freedom in design may be decreased in a case of application to the communication device according to the embodiment of the present disclosure.

In view of the above situation, the present disclosure proposes a technology for implementing an antenna device capable of further reducing an influence of proximity to a metal and feeding power to an antenna element in a more suitable manner.

3. TECHNICAL FEATURES

Hereinafter, the technical features of the communication device according to the embodiment of the present disclosure will be described, particularly focusing on a configuration of an antenna device.

3.1. Configuration of Antenna Device

Figure 23:
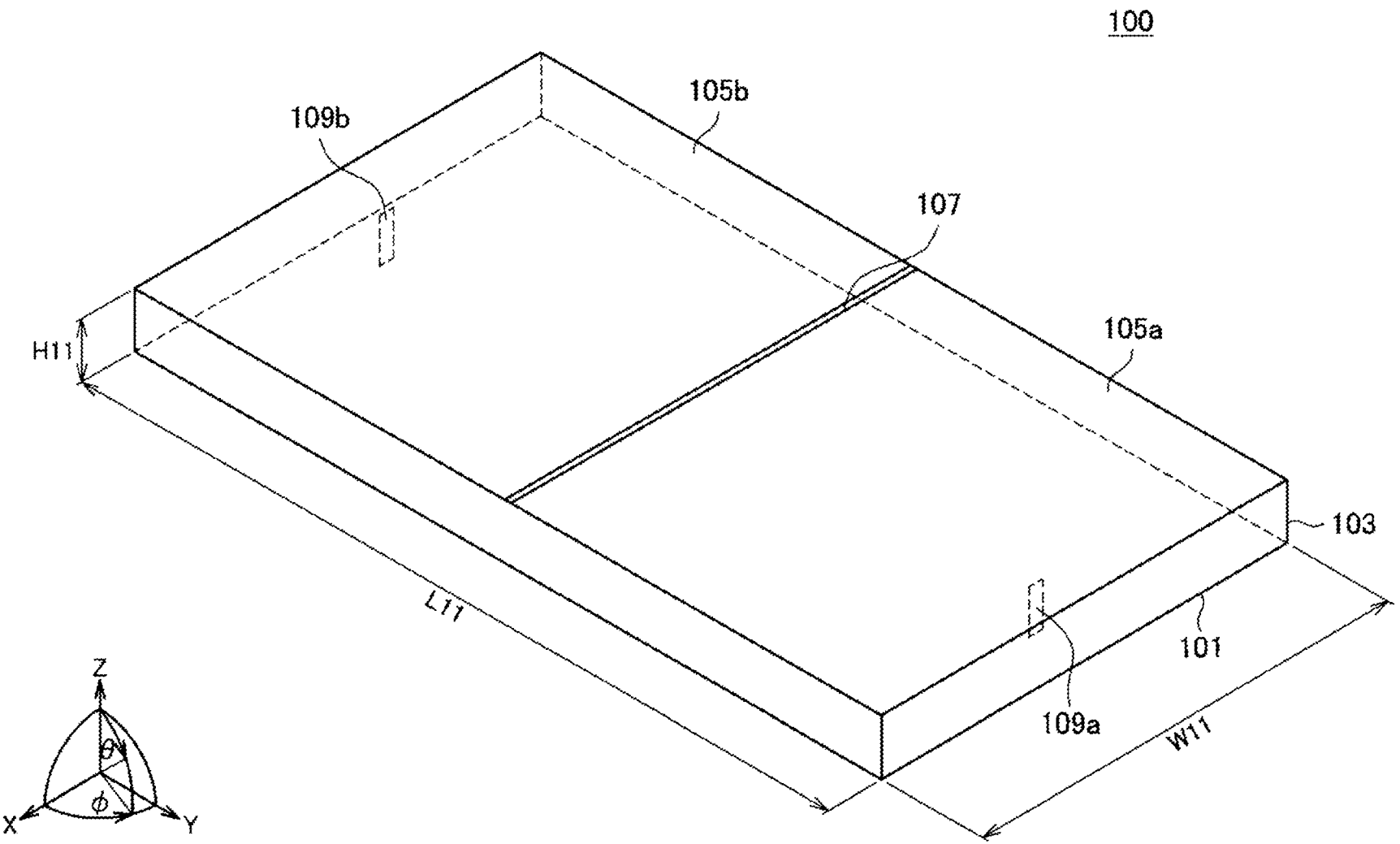
FIG. 23 is a schematic perspective view of the antenna device according to the embodiment.
Figure 24:
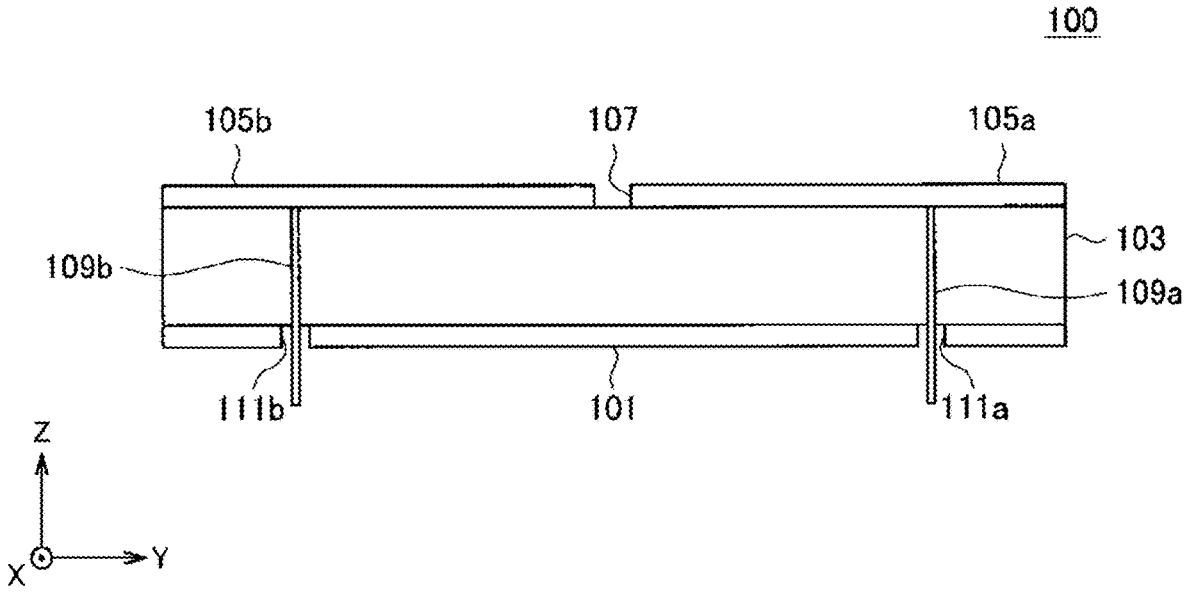
FIG. 24 is a schematic cross-sectional view of the antenna device illustrated in FIG. 23.

First, an example of the configuration of the antenna device according to the embodiment of the present disclosure will be described with reference to FIGS. 23 and 24. FIGS. 23 and 24 are views for describing the configuration of the antenna device according to the embodiment of the present disclosure. Note that, in the following description, the antenna device according to the present embodiment illustrated in FIGS. 23 and 24 is also referred to as an "antenna device 100" for convenience in order to distinguish the antenna device from an antenna device having a different configuration.

For example, FIG. 23 is a schematic perspective view of the antenna device according to the embodiment of the present disclosure. As illustrated in FIG. 23, the antenna device 100 according to the present embodiment has a substantially flat plate shape. In the following description, a normal direction of a plane (for example, an upper surface) of a substantially-flat-plate-shaped antenna device 100 will be referred to as a "Z direction". Further, two directions (that is, a direction parallel to the plane of the substantially-flat-plate-shaped antenna device 100) orthogonal to the Z direction and orthogonal to each other are referred to as an "X direction" and a "Y direction", respectively.

As illustrated in FIG. 23, the antenna device 100 according to the present embodiment includes a metal base plate 101, a dielectric substrate 103, antenna elements 105*a* and 105*b*, and feeding portions 109*a* and 109*b*. Note that, in the following description, Reference Signs W11, L11, and H11 denote the width of the antenna device 100 in the X direction, the width of the antenna device 100 in the Y direction, and the thickness of the antenna device 100 in the Z direction, respectively.

The dielectric substrate 103 is formed in a substantially flat plate shape, and the substantially-flat-plate-shaped metal base plate 101 is provided so as to cover substantially an entire lower surface (a surface in the −z direction). Further, the conductive antenna elements 105*a* and 105*b* (that is, radiation metal plates) formed in a flat plate shape are provided on an upper surface (a surface in the +z direction) of the dielectric substrate 103 so that a slit 107 is formed. Specifically, in the example illustrated in FIG. 23, the antenna elements 105*a* and 105*b* are arranged side by side in the Y direction so that the slit 107 extending in the X direction is formed. Here, the antenna elements 105*a* and 105*b* are arranged so as to be electrically separated from each other. As a specific example, in the example illustrated in FIG. 23, the antenna elements 105*a* and 105*b* are arranged so as to be spatially separated along the Y direction, and thus are electrically separated from each other. Note that, in the following description, the antenna elements 105*a* and 105*b* may be simply referred to as an "antenna element 105" unless otherwise distinguished. Further, among the respective surfaces (that is, the upper surface and the lower surface) of the dielectric substrate 103 formed in a substantially flat plate shape, a surface (lower surface) on which the metal base plate 101 is provided corresponds to an example of a "first surface", and a surface (upper surface) on which the antenna elements 105*a* and 105*b* are arranged corresponds to an example of a "second surface".

Further, in the antenna device 100 according to the present embodiment, the antenna elements 105*a* and 105*b* are arranged so that the width of the slit 107 (that is, the width in the Y direction) is at least smaller than ½ of a wavelength of a wireless signal transmitted or received by the antenna elements 105*a* and 105*b*. At least in this respect, the configuration of the antenna device 100 is different from a so-called array antenna. Further, more preferably, the antenna elements 105*a* and 105*b* are preferably arranged so that the width of the slit 107 is 1/40 or less of the wavelength of the wireless signal transmitted or received by the antenna elements 105*a* and 105*b*. Further, the antenna elements 105*a* and 105*b* may be formed so that a surface (for example, an upper surface corresponding to a radiation surface) extending along the upper surface of the dielectric substrate 103 has a substantially rectangular shape. Here, it is more preferable that the length of the surface in the Y direction (that is, the length in a direction orthogonal to the slit 107) is substantially equal to the length $L_y$ shown in (Equation 1) below. Note that, in (Equation 1), $\lambda$ represents a wavelength of a transmitted or received wireless signal. Further, $\varepsilon_r$ represents relative permittivity of the dielectric substrate. In this case, the antenna elements 105*a* and 105*b* are preferably arranged so that the width of the slit 107 is 1/10 or less of the length of one side of the surface.

$$L_y=0.4\lambda/\sqrt{\varepsilon_r} \quad \text{(Equation 1)}$$

The feeding portion 109*a* is provided so that a part of the antenna element 105*a* is used as a feeding point and power is fed to the feeding point. The feeding portion 109*b* is provided so that a part of the antenna element 105*b* is used as a feeding point and power is fed to the feeding point. Here, each feeding point is preferably set so that a direction from one of the feeding points of the antenna elements 105*a* and 105*b* to the other and a direction in which the slit 107 extends are substantially orthogonal to each other (that is, it is preferable that the feeding portions 109*a* and 109*b* are provided). The feeding portions 109*a* and 109*b* include, for example, a feeding pin and a feeding line that supplies a feeding signal from a feeding circuit to the feeding pin. It is a matter of course that a configuration of each of the feeding portions 109*a* and 109*b* is not particularly limited as long as power can be fed to each feeding point. Note that, in the following description, the feeding portions 109*a* and 109*b* may be simply referred to as a "feeding portion 109" unless otherwise distinguished. Further, one of the antenna elements 105*a* and 105*b* corresponds to an example of a "first antenna element", and the other corresponds to an example of a "second antenna element". Further, among the feeding portions 109*a* and 109*b*, a feeding portion 109 that feeds power to the first antenna element corresponds to an example of a "first feeding portion", and a feeding portion 109 that feeds power to the second antenna element corresponds to an example of a "second power feeding portion". Further, the direction in which the slit 107 extends (for example, the X direction in the example illustrated in FIG. 23) corresponds to an example of a "first direction". A direction from one of the feeding points of the respective antenna elements 105*a* and 105*b* to the other corresponds to a "second direction".

Here, a more specific example of a method of arranging the feeding portions 109 (that is, the feeding portions 109*a* and 109*b*) that feed power to the antenna elements 105*a* and 105*b*, respectively, will be described with reference to FIG. 24. FIG. 24 is a schematic cross-sectional view of the antenna device 100 illustrated in FIG. 23, and is a cross-sectional view when viewed from the X direction in a case where the antenna device 100 is cut along a plane parallel to a ZY plane including the feeding portions 109*a* and 109*b*.

As illustrated in FIG. 24, the feeding portion 109*a* is arranged so as to be electrically connected to the lower surface side of the antenna element 105*a*. Specifically, a hole portion 111*a* penetrating in the Z direction is provided in a part of the metal base plate 101 that is positioned below the antenna element 105*a*. The feeding portion 109*a* extends from the lower surface side of the metal base plate 101 so as to penetrate the metal base plate 101 through the hole portion 111*a*, and is electrically connected to the lower surface side of the antenna element 105*a*. As a result, the feeding portion 109*a* is electrically connected to the lower surface side of the antenna element 105*a* while being separated from the metal base plate 101. Here, an upper end of the feeding portion 109*a* is positioned below the radiation surface of the antenna element 105*a*.

Similarly, the feeding portion 109*b* is arranged so as to be electrically connected to the lower surface side of the antenna element 105*b*. Specifically, a hole portion 111*b* penetrating in the Z direction is provided in a part of the metal base plate 101 that is positioned below the antenna element 105*b*. The feeding portion 109*b* extends from the lower surface side of the metal base plate 101 so as to penetrate the metal base plate 101 through the hole portion 111*b*, and is electrically connected to the lower surface side of the antenna element 105*b*. As a result, the feeding portion 109*b* is electrically connected to the lower surface side of the antenna element 105*b* while being separated from the metal base plate 101. Here, an upper end of the feeding portion 109*b* is positioned below the radiation surface of the antenna element 105*b*.

With the above configuration, in the antenna device 100 according to the present embodiment, a control is performed so that a phase difference between feeding signals supplied to the feeding portions 109*a* and 109*b*, respectively, is approximately 180 degrees. In other words, the feeding signals whose phases are different by 180 degrees are fed to the feeding points of the antenna elements 105*a* and 105*b*, respectively. As a result, the antenna device 100 forms a radiation pattern on the upper surface side (that is, +Z direction side) of each antenna element 105 based on the power feeding from each feeding portion 109.

Note that the configuration of the antenna device 100 illustrated in FIG. 24 is merely an example, and as long as it is possible to feed power to the antenna element 105, the method of arranging the feeding portion 109 is not necessarily limited to the example illustrated in FIG. 24. That is, as long as it is possible to arrange the feeding portion 109 so that the radiation pattern formed by the antenna device 100 is not blocked by the feeding portion 109, the method of arranging the feeding portion 109 is not particularly limited. As a specific example, the feeding portion 109 may be arranged so as to extend from a side portion of the dielectric substrate 103 (for example, a side portion in the X direction or the Y direction) toward the lower side of the antenna element 105, and a portion of the feeding portion 109 that is positioned below the antenna element 105 may be electrically connected to the lower surface side of the antenna element 105. Further, the feeding portion 109 may be arranged so that the feeding portion 109 is electrically connected to the side portion of the antenna element 105 (for example, the side portion in the X direction or the Y direction) on the upper surface side of the dielectric substrate 103. Note that an example of a method of arranging the feeding portion 109 will be separately described later in detail as a modified example.

Next, the position of the feeding point in the antenna element 105 (radiation metal plate) will be described in more detail. In the antenna device according to the present embodiment, the position of the feeding point is determined depending on impedance that matches input impedance $R_{in}$ to the antenna element 105.

Figure 25:
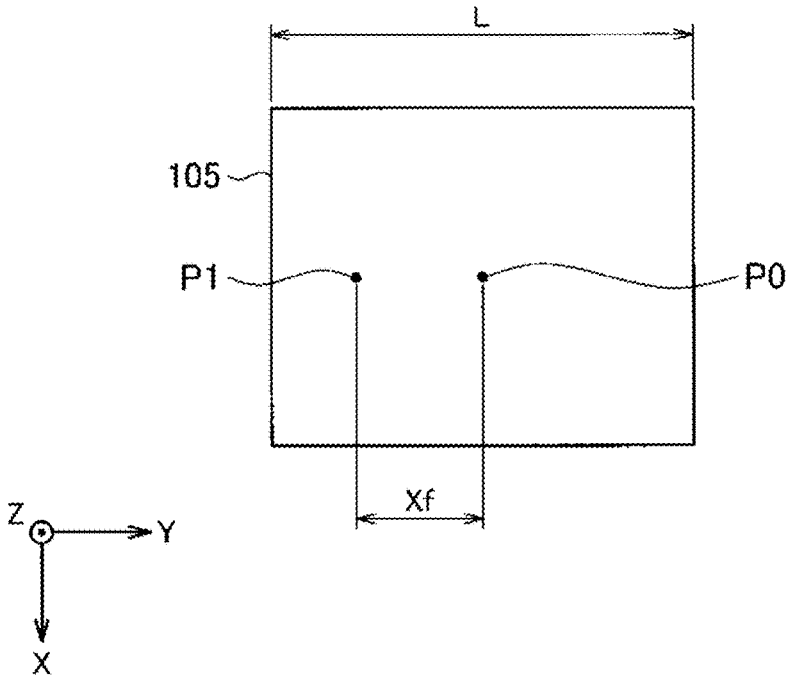
FIG. 25 is a view for describing a method of setting a position of a feeding point in the antenna device according to the embodiment.

For example, FIG. 25 is a diagram for describing a method of setting a position of a feeding point in the antenna device according to the present embodiment. Specifically, FIG. 25 is a schematic plan view of the antenna element 105 when viewed from the Z direction. In FIG. 25, Reference Sign P0 schematically indicates the center (that is, the center in the X direction and the Y direction) of the upper surface of the antenna element 105 formed in a substantially flat plate shape. Further, Reference Sign P1 schematically indicates the position of the feeding point. Here, the input impedance $R_{in}$ of the antenna element 105 in a case where the feeding point P1 is separated from the center P0 of the antenna element 105 by a distance Xf is represented by the following calculation formula (Equation 1).

$$R_{in} - R_r \sin^2\left(\frac{\pi}{L} x_f\right) \quad \text{(Equation 2)}$$

In (Equation 1) above, $R_r$ represents the input impedance of the antenna element 105 in a case where power is fed at an end (for example, an end in the Y direction) of the antenna element 105. Further, Reference Sign L schematically represents the width of the antenna element 105 in a direction in which the feeding point P1 is moved. The example illustrated in FIG. 25 shows a case where the feeding point P1 is moved so as to be separated from the center P0 of the antenna element 105 along the Y direction, in order to make the features of the antenna device according to the present embodiment easier to understand. That is, in the example illustrated in FIG. 25, L indicates the width of the antenna element 105 in the Y direction.

Note that the input impedance $R_{in}$ of the antenna element 105 is ideally calculated based on (Equation 1) above. However, in general, the position of the feeding point P1 is preferably determined (the distance $X_f$ is determined) so that the input impedance $R_{in}$ of the antenna element 105 matches a desired impedance (for example, 50Ω) by performing an electromagnetic field analysis using $X_f$ described above as a parameter.

Hereinabove, an example of the configuration of the antenna device according to the embodiment of the present disclosure has been described with reference to FIGS. 23 to 25.

3.2. Functional Configuration of Wireless Communication Unit

Next, an example of a functional configuration of a wireless communication unit that drives the antenna device according to the embodiment of the present disclosure will be described, particularly focusing on a portion related to supply of a feeding signal to the antenna device (that is, a portion corresponding to the feeding circuit). For example, FIG. 26 is a block diagram illustrating an example of a functional configuration of the wireless communication unit that drives the antenna device according to the present embodiment.

Specifically, an antenna unit 1001 and a wireless communication unit 1003 illustrated in FIG. 26 can correspond to the antenna unit 1001 and the wireless communication unit 1003 described with reference to FIG. 1. In other words, FIG. 26 illustrates an example of a functional configuration of the wireless communication unit 1003 in a case where the antenna device 100 according to the present embodiment is applied as the antenna unit 1001 of the communication device 1000 illustrated in FIG. 1. Therefore, in the example illustrated in FIG. 26, the antenna unit 1001 includes two feeding pins 1011*a* and 1011*b*. That is, the feeding pins 1011*a* and 1011*b* schematically indicate, for example, the feeding pins included in the feeding portions 109*a* and 109*b* illustrated in FIGS. 23 and 25, and are arranged so that power is fed to different antenna elements.

Figure 26:
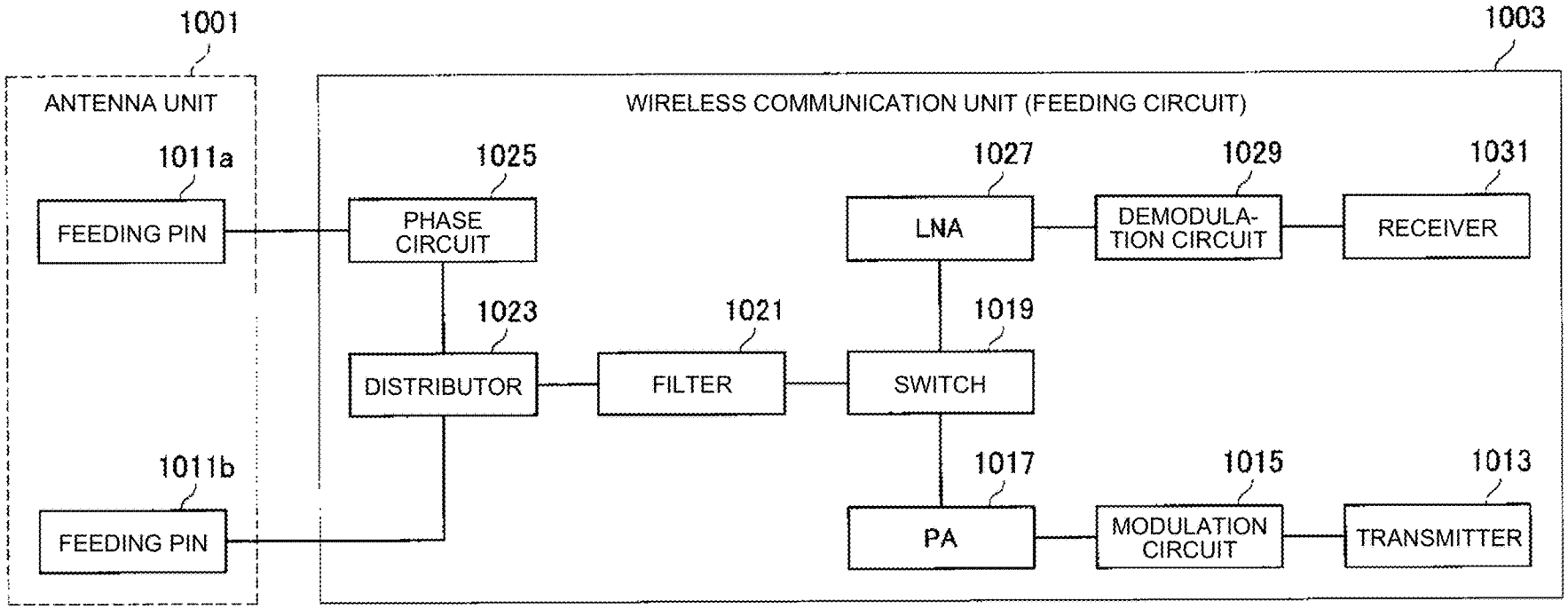
FIG. 26 is a block diagram illustrating an example of a functional configuration of a wireless communication unit that drives the antenna device according to the embodiment.

Further, the wireless communication unit 1003 includes a transmitter 1013, a modulation circuit 1015, a power amplifier (PA) 1017, a switch 1019, a filter 1021, a distributor 1023, and a phase circuit 1025, a low noise amplifier (LNA) 1027, a demodulation circuit 1029, and a receiver 1031 as illustrated in FIG. 26.

The transmitter 1013, the modulation circuit 1015, and the PA 1017 are components for generating a drive signal (in other words, a feeding signal) that drives the antenna unit 1001 in order to transmit a wireless signal corresponding to data to be transmitted from the antenna unit 1001. Specifically, the drive signal is generated by modulating, by the modulation circuit 1015, an electric signal with a desired frequency that is generated by the transmitter 1013 according to the data to be transmitted, and amplifying, by the PA 1017, the modulated electric signal. The generated drive signal is input to the switch 1019.

The switch 1019 is a component for selectively switching a supply destination (in other words, a signal transmission path) of the input electric signal. The switch 1019 controls the signal transmission path so that the drive signal output from the PA 1017 is transmitted to the distributor 1023 via the filter 1021 during an operation related to transmission of a wireless signal. In addition, the switch 1019 controls the signal transmission path so that a reception signal output from the filter 1021 according to a reception result of an antenna unit 1011 is transmitted to the demodulation circuit 1029 via the LNA 1027 during an operation related to reception of a wireless signal.

The filter 1021 passes a signal in a predetermined frequency band among input signals and blocks a signal in another frequency band. As a specific example, the filter 1021 may be configured as a so-called low-pass filter. In such a case, the filter 1021 passes a low frequency component (that is, a signal having a frequency equal to or lower than a threshold) of the input signal and blocks a high frequency component. This makes it possible to remove a so-called noise component included in a signal input to the filter 1021.

The drive signal generated by the transmitter 1013, the modulation circuit 1015, and the PA 101 is input to the filter 1021 via the switch 1019, a noise component is removed by the filter 1021, and then the signal is demultiplexed by the distributor 1023. One of drive signals demultiplexed by the distributor 1023 is supplied to the feeding pin 1011*a* via the phase circuit 1025. Here, the phase circuit 1025 shifts the phase of the input drive signal by 180 degrees. The other drive signal is supplied to the feeding pin 1011*b*. With such a configuration, a phase difference between the drive signal supplied to the feeding pin 1011*a* and the drive signal supplied to the feeding pin 1011*b* is 180 degrees. Then, the drive signal (in other words, the feeding signal) supplied to each of the feeding pins 1011*a* and 1011*b* drives an antenna element of the antenna unit 1001, and a wireless signal corresponding to the drive signal is radiated from the antenna element.

Next, a portion of the wireless communication unit 1003 that is related to reception of a wireless signal will be described, focusing on an operation at the time of the reception. Once the antenna element of the antenna unit 1001 receives a wireless signal, an electric signal (hereinafter, also referred to as a "reception signal") corresponding to the wireless signal is input to the wireless communication unit 1003 via the feeding pins 1011*a* and 1011*b*. Here, the phase of the reception signal input via the feeding pin 1011*a* is shifted by 180 degrees by the phase circuit 1025. The reception signal input from each of the feeding pins 1011*a* and 1011*b* is input to the switch 1019 via the distributor 1023 and the filter 1021. Here, in the filter 1021, for example, a high frequency component (noise component) included in the reception signal may be removed.

In addition, as described above, the switch 1019 controls the signal transmission path so that a reception signal output from the filter 1021 according to a reception result of the antenna unit 1011 is transmitted to the demodulation circuit 1029 via the LNA 1027 during an operation related to reception of a wireless signal. Specifically, the reception signal output from the switch 1019 is amplified by the LNA 1027, demodulated by the demodulation circuit 1029, and then received by the receiver 1031. That is, data corresponding to the reception signal is received.

Note that the above-described configuration is merely an example, and the functional configuration of the wireless communication unit 1003 is not necessarily limited to the example illustrated in FIG. 26 as long as it is possible to implement operations related to transmission and reception of a wireless signal. As a specific example, the antenna unit 1001 and at least some components of the wireless communication unit 1003 may be integrated with each other. Further, as another example, some of the respective components of the wireless communication unit 1003 may be provided outside the wireless communication unit 1003. Further, the function of the wireless communication unit 1003 may be implemented by a plurality of devices (for example, a plurality of chips) operating in cooperation with each other.

Hereinabove, an example of the functional configuration of the wireless communication unit that drives the antenna device according to the embodiment of the present disclosure has been described with reference to FIG. 26, particularly focusing on the portion related to supply of a feeding signal to the antenna device.

3.3. Example: Antenna Characteristic Simulation

Next, as Example, an antenna characteristic simulation result of the antenna device according to the embodiment of the present disclosure will be summarized below.

(Simulation Conditions)

First, simulation conditions will be described. In this Example, similarly to an antenna characteristic simulation of the antenna device 700 according to Comparative Example 1 described above with reference to FIGS. 2 to 5, transmission or reception of a 2.45 GHz wireless signal is assumed, and an antenna characteristic simulation of the antenna device 100 according to the embodiment is performed. Specifically, as the dimensions of the antenna device 100 according to the present embodiment, the width W11 in the X direction is 35 mm, the width L11 in the Y direction is 61 mm, and the thickness H11 in the Z direction is 4 mm. The position of the feeding point of each of the antenna elements 105*a* and 105*b* is adjusted so that the input impedance of each of the antenna elements 105*a* and 105*b* of the antenna device 100 matches 50Ω. Further, the antenna device 100 according to the present embodiment is driven by driving the feeding circuit (for example, the wireless communication unit 1003 illustrated in FIG. 26) under the same conditions as in a case where it is assumed that a 2.45 GHz wireless signal is transmitted or received by the antenna device 700 according to Comparative Example 1.

Under the above conditions, a simulation was performed for each characteristic of the antenna device 100 according to the present embodiment. FIGS. 27 to 33 each illustrate an example of a simulation result for each characteristic of the antenna device 700 according to Comparative Example 1.

(Reflection Characteristic)

Figure 27:
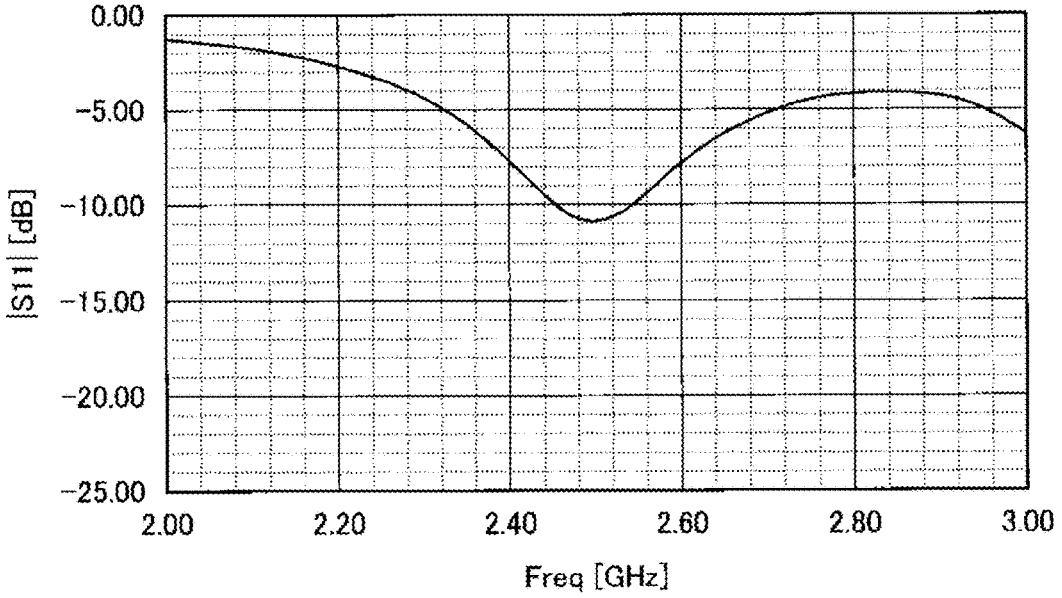
FIG. 27 is a diagram illustrating an example of a reflection characteristic simulation result of an antenna device according to Example of the embodiment.

First, a reflection characteristic simulation result of the antenna device 100 according to Example will be described with reference to FIG. 27. FIG. 27 is a diagram illustrating an example of a reflection characteristic simulation result of the antenna device 100 according to Example of the embodiment of the present disclosure. In FIG. 27, a horizontal axis represents frequency (GHz) and a vertical axis represents reflection coefficient S11 (dB).

As can be seen by comparing the simulation result illustrated in FIG. 27 with the simulation result illustrated in FIG. 6, the antenna device 100 according to Example has a slightly smaller resonance depth, as compared with the antenna device 700 according to Comparative Example 1. However, it is considered that the same characteristic of the antenna device 100 (that is, a characteristic difference between the antenna device 100 and the antenna device 700) is within a range adjustable according to the matching.

(Impedance Characteristic)

Figure 28:
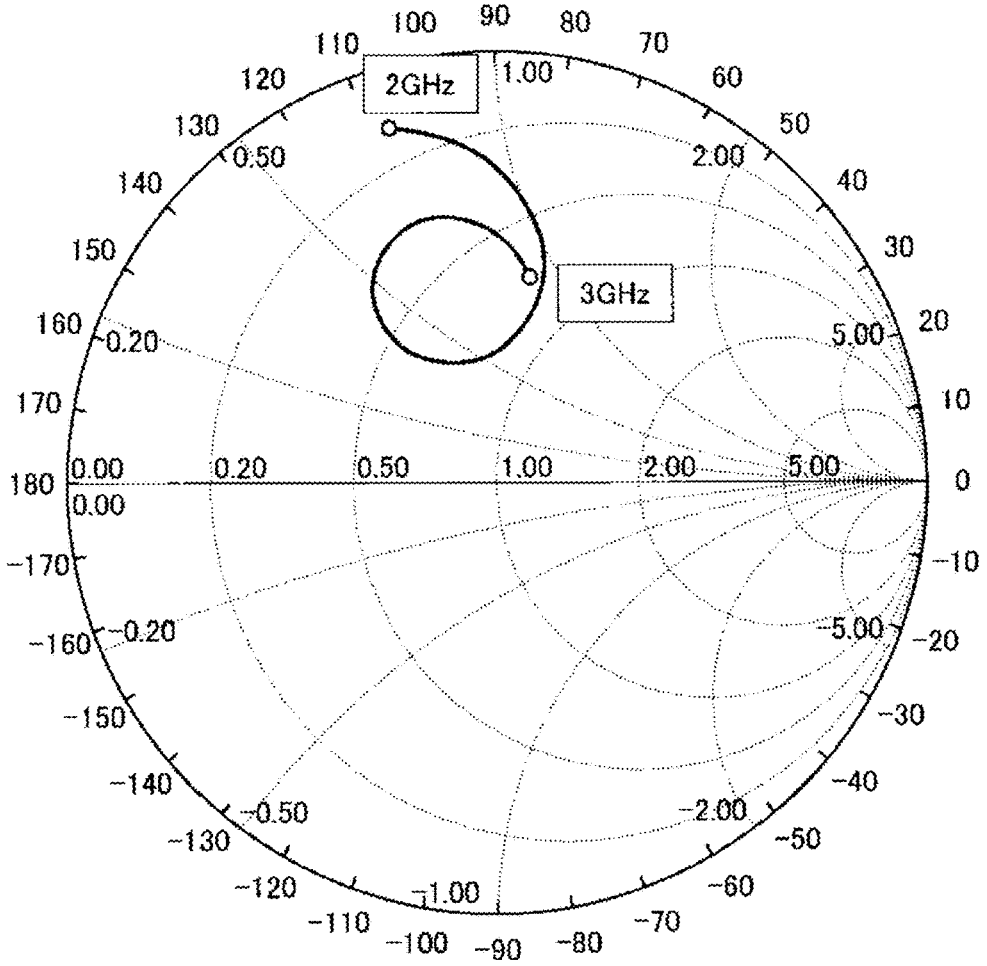
FIG. 28 is a Smith chart illustrating an example of an impedance characteristic simulation result of the antenna device according to Example of the embodiment.

Next, an impedance characteristic simulation result of the antenna device 100 according to Example will be described with reference to FIG. 28. FIG. 28 is a Smith chart illustrating an example of an impedance characteristic simulation result of the antenna device 100 according to Example of the embodiment of the present disclosure. As illustrated in FIG. 28, it can be seen that the antenna device 100 according to Example shows an inductive characteristic.

(Radiation Pattern)

Figure 29:
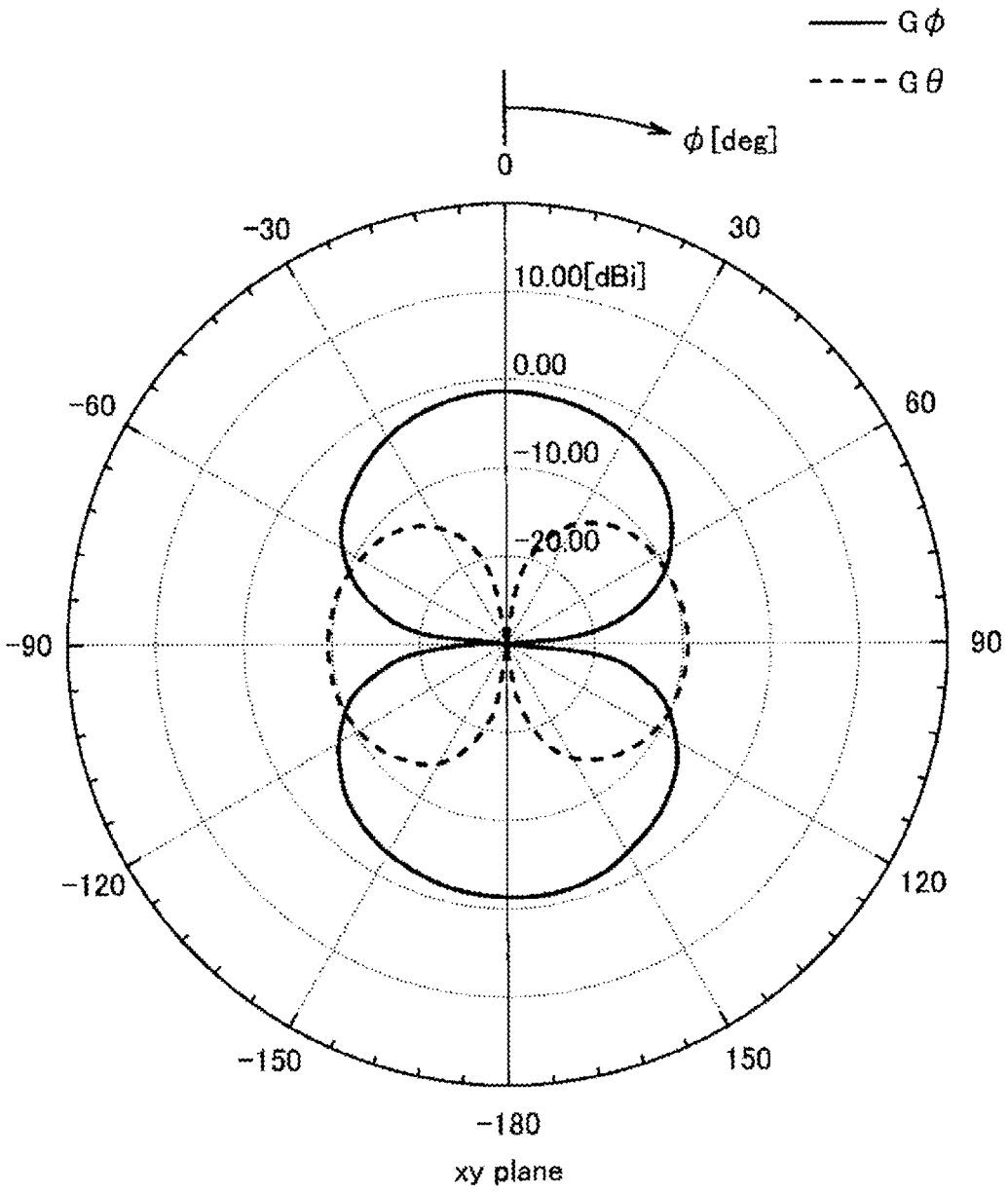
FIG. 29 is a diagram illustrating an example of a radiation pattern simulation result of the antenna device according to Example of the embodiment.
Figure 30:
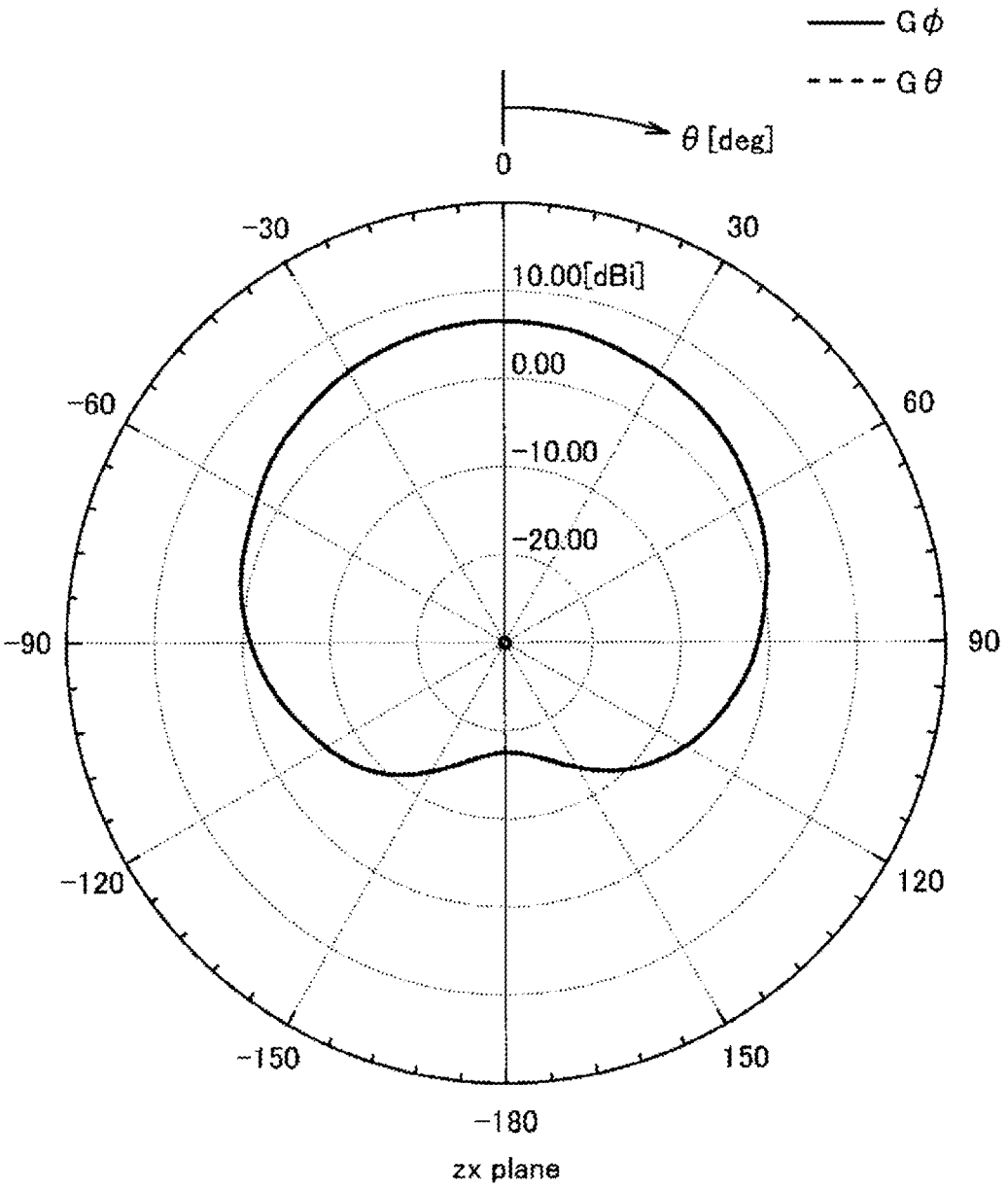
FIG. 30 is a diagram illustrating an example of a radiation pattern simulation result of the antenna device according to Example of the embodiment.
Figure 31:
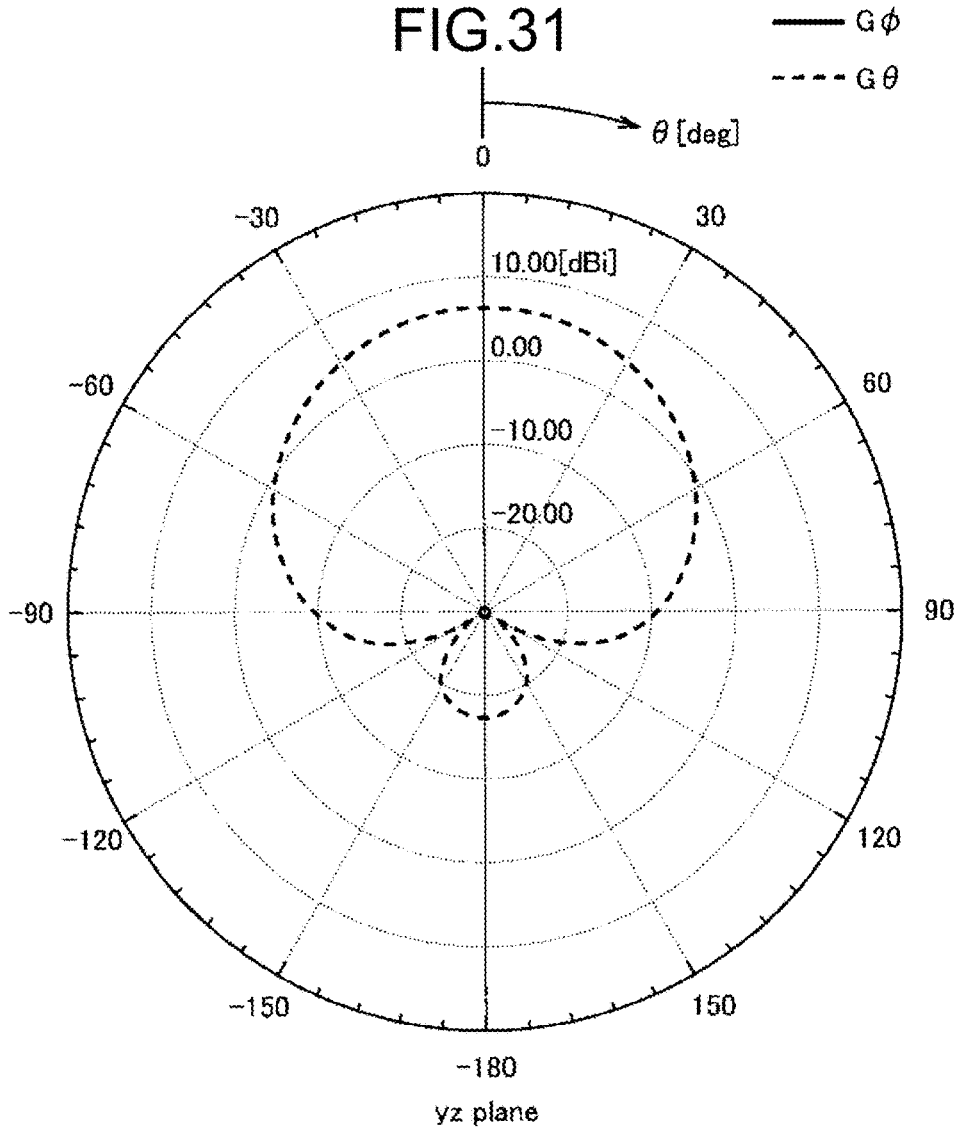
FIG. 31 is a diagram illustrating an example of a radiation pattern simulation result of the antenna device according to Example of the embodiment.

Next, an example of a radiation pattern simulation result of the antenna device 100 according to Example will be described with reference to FIGS. 29 to 31. FIGS. 29 to 31 are diagrams each illustrating an example of the radiation pattern simulation result of the antenna device according to Example of the embodiment of the present disclosure. In each of FIGS. 29 to 31, a circumferential direction represents an angle (deg), a radial direction represents an operation gain (dBi), a solid line represents a θ component of the operation gain, and a broken line represents a ϕ component of the operation gain. Specifically, FIG. 29 illustrates an example of the radiation pattern in a case where the radiation pattern of the antenna device 100 is cut along a plane parallel to an XY plane in FIG. 23. FIG. 30 illustrates an example of the radiation pattern in a case where the radiation pattern of the antenna device 100 is cut along a plane parallel to an XZ plane in FIG. 23. FIG. 31 illustrates an example of the radiation pattern in a case where the radiation pattern of the antenna device 100 is cut along a plane parallel to a YZ plane in FIG. 23.

As can be seen by comparing the simulation results illustrated in FIGS. 29 to 31 with the simulation results illustrated in FIGS. 8 to 10, the radiation pattern of the antenna device 100 according to Example is similar to the radiation pattern of the antenna device 700 according to Comparative Example 1.

(Influence of Proximity to Metal on Characteristics)

Next, simulation results of an influence on characteristics when the antenna device 100 according to Example of the embodiment of the present disclosure is brought close to a metal will be described with reference to FIGS. 32 and 33. Note that a method of the simulation is performed under the same conditions as in a case of the simulation of the antenna device 700 according to Comparative Example 1 and the antenna device 800 according to Comparative Example 2 described above. That is, as illustrated in FIG. 17, a simulation is performed to check, in a case where the metal plate 690 is disposed below an antenna device (that is, the antenna device 100) as a simulation target, how the characteristics of the antenna device are changed depending on a distance d between the antenna device and the metal plate 690. Note that the metal plate 690 is assumed to be an electrically perfect conductor having an infinite size in an XY plane direction. Further, the simulation for each characteristic of the antenna device is performed when the distance d is 0 mm, 10 mm, 20 mm, and 30 mm, respectively.

First, a result of a simulation of a change in reflection characteristic of the antenna device 100 when a metal is brought close to the antenna device will be described with reference to FIG. 32. FIG. 32 is a diagram illustrating an example of a reflection characteristic simulation result of the antenna device according to Example of the embodiment of the present disclosure. Note that a vertical axis and a horizontal axis in FIG. 32 are the same as those in the example illustrated in FIG. 27.

Figure 32:
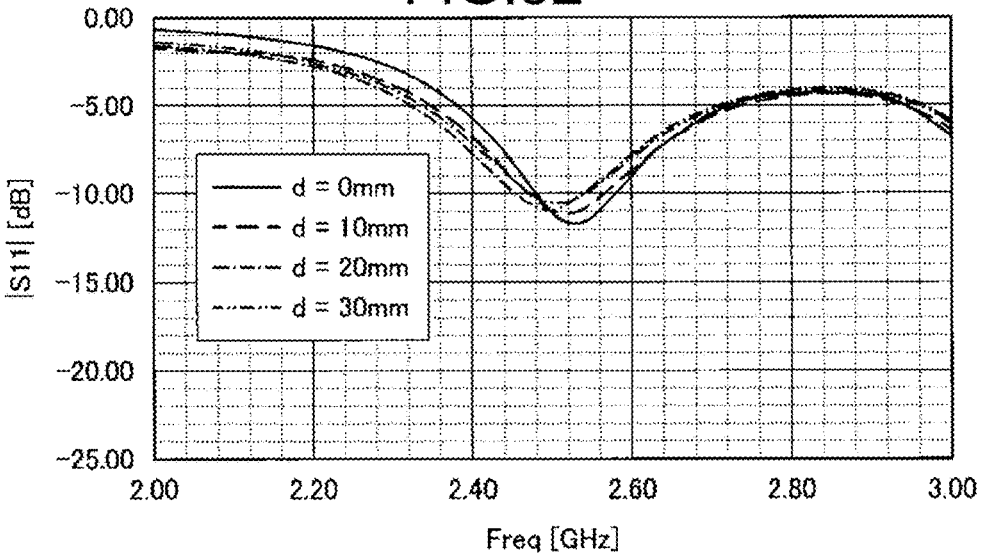
FIG. 32 is a diagram illustrating an example of a reflection characteristic simulation result of the antenna device according to Example of the embodiment.

As illustrated in FIG. 32, it can be seen that, although the characteristic of the antenna device 100 according to the present embodiment is slightly changed in a case where the distance d is 0 mm (that is, a case where the antenna device 100 and the metal plate 690 are in contact with each other), the reflection characteristic of the antenna device 100 according to the present embodiment is hardly changed regardless of proximity to the metal plate 690. In particular, as can be seen by comparing the simulation result illustrated in FIG. 32 with the simulation result illustrated in FIG. 19, a change in reflection characteristic of the antenna device 100 according to Example when a metal is brought close to the antenna device 100 (particularly, a case where distance d=0 mm) is smaller, as compared with the antenna device 800 according to Comparative Example 2.

Next, a result of a simulation of a change in impedance characteristic of the antenna device 100 when a metal is brought close to the antenna device 100 will be described with reference to FIG. 33. FIG. 33 is a Smith chart illustrating an example of an impedance characteristic simulation result of the antenna device according to Example of the embodiment of the present disclosure.

Figure 33:
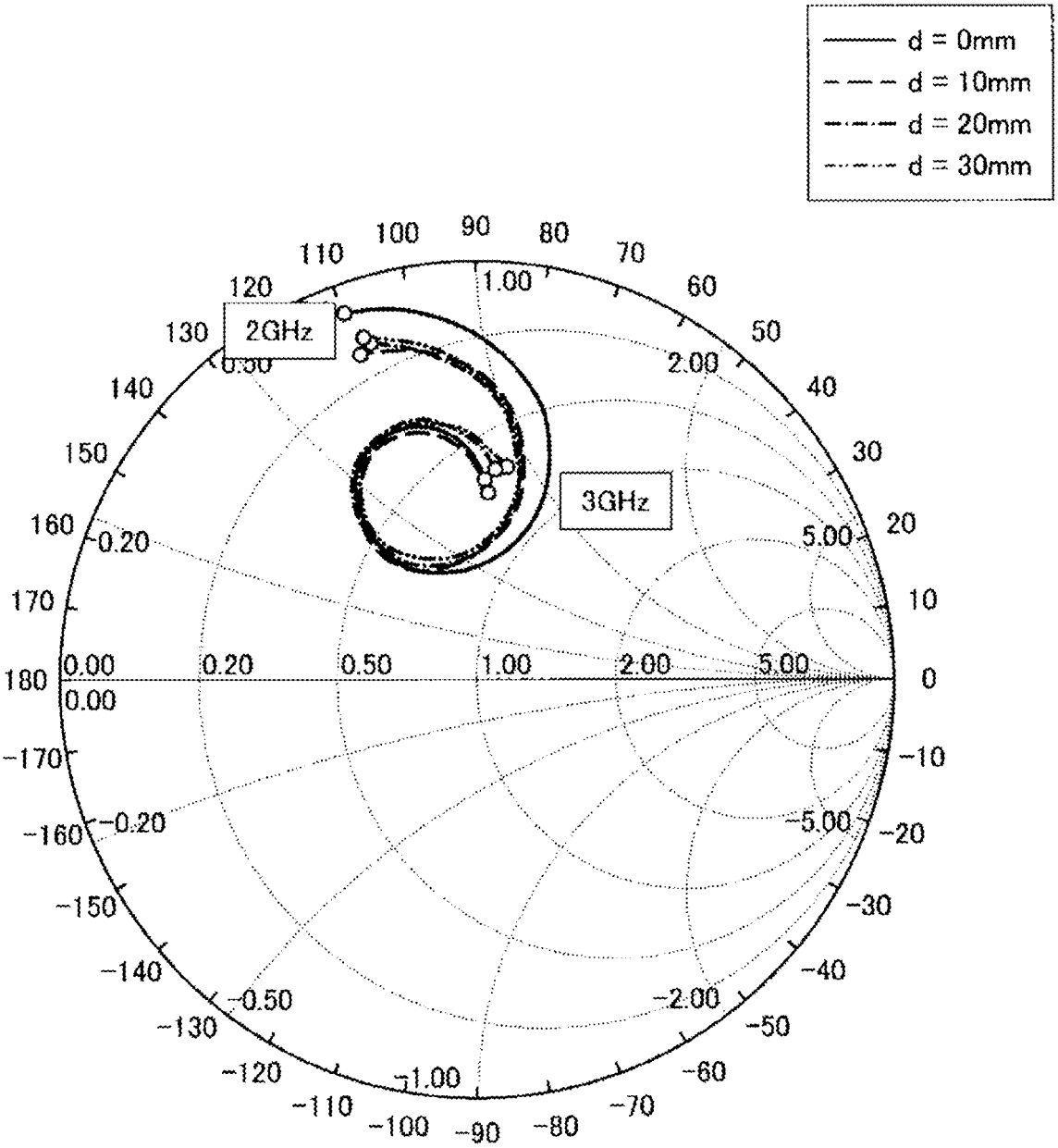
FIG. 33 is a Smith chart illustrating an example of an impedance characteristic simulation result of the antenna device according to Example of the embodiment.

As illustrated in FIG. 33, it can be seen that, although the characteristic of the antenna device 100 according to the present embodiment is slightly changed in a case where the distance d is 0 mm (that is, a case where the antenna device 100 and the metal plate 690 are in contact with each other), the impedance characteristic of the antenna device 100 according to the present embodiment is hardly changed regardless of proximity to the metal plate 690. In particular, as can be seen by comparing the simulation result illustrated in FIG. 32 with the simulation result illustrated in FIG. 21, a change in impedance characteristic of the antenna device 100 according to Example when a metal is brought close to the antenna device 100 (particularly, a case where distance d=0 mm) is smaller, as compared with the antenna device 800 according to Comparative Example 2.

(Evaluation)

As described above, although the matching conditions of the antenna device 100 according to Example are slightly different from those of the antenna device 700 according to Comparative Example 1, the antenna device 100 according to Example can implement the same antenna characteristics as the antenna device 700. Further, the antenna device 100 according to the present embodiment can suppress a change in various characteristics when a metal is brought close to the antenna device 100 to the same extent or more as compared with the antenna device 800 according to Comparative Example 2. Further, in the antenna device 100 according to the present embodiment, it is possible to arrange the feeding portion 109 so that the radiation pattern is not blocked by the feeding portion 109 (for example, the feeding pin or feeding line) in consideration of the configuration characteristics described with reference to FIGS. 23 and 24. Further, similarly to the antenna device 800 according to Comparative Example 2 (so-called patch antenna), the power feeding method of the antenna device 100 according to the present embodiment is the unbalanced power feeding, the antenna device 100 has a high affinity with a general microstrip line. That is, even in a situation where the antenna device is installed in a limited space inside the housing of the communication device, an influence of proximity to a metal can be further reduced, and power can be fed to the antenna element in a more suitable manner.

3.4. Modified Example

Next, as a modified example of the communication device according to the present embodiment, a modified example of the configuration of the antenna device according to the present embodiment will be described below.

Figure 34:
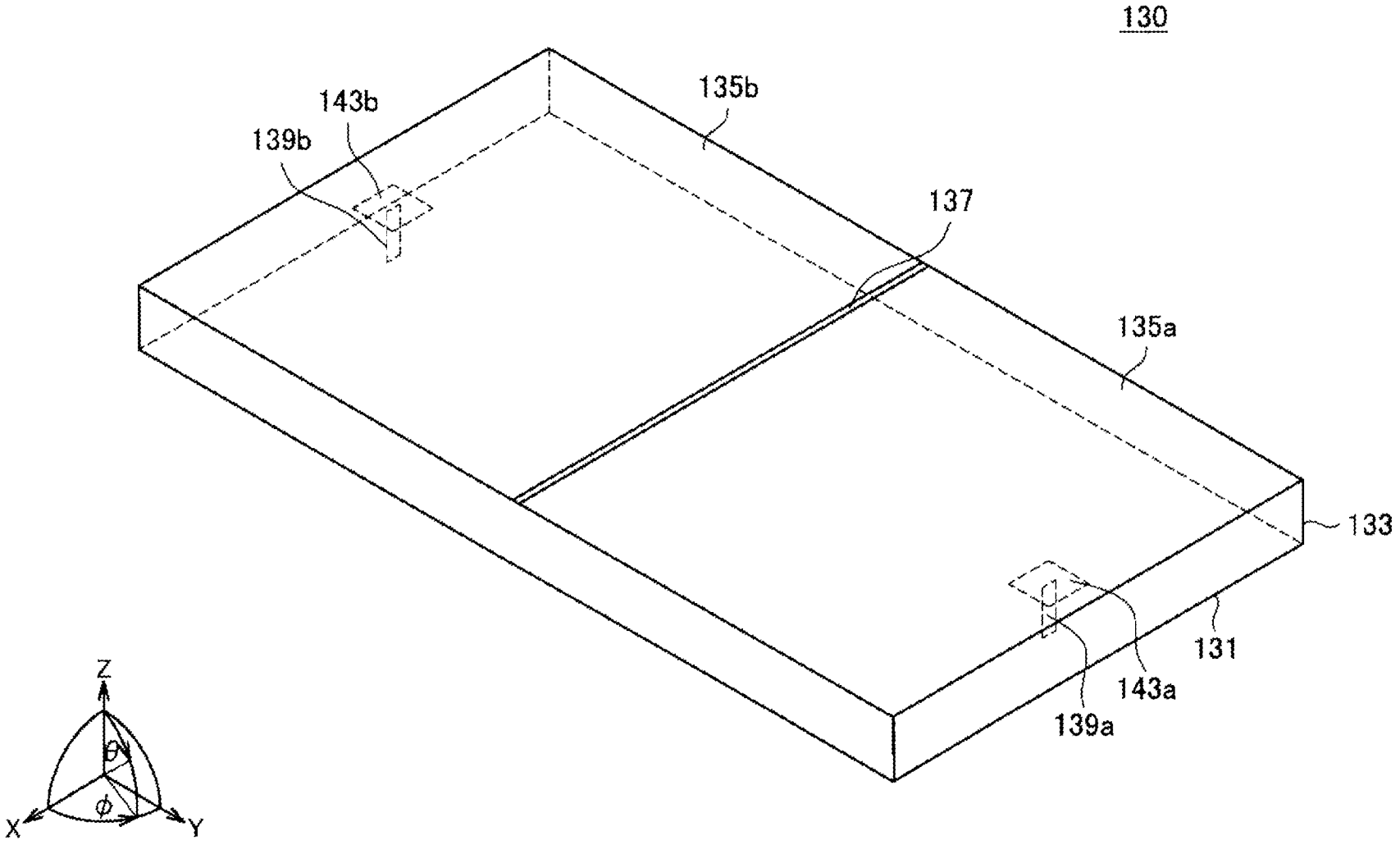
FIG. 34 is a view for describing an example of a configuration of an antenna device according to Modified Example 1.

Modified Example 1: Configuration Example when Non-Contact Power Feeding is Performed First, as Modified Example 1, an example of a configuration of the antenna device according to the present embodiment in a case where the antenna device is configured to perform power feeding by non-contact power feeding will be described. For example, FIG. 34 is a view for describing an example of a configuration of the antenna device according to Modified Example 1, and is a schematic perspective view of the antenna device. Note that, in the following description, the antenna device according to Modified Example 1 may be referred to as an "antenna device 130" when it is particularly distinguished from the antenna device 100 according to the above-described embodiment. An X direction, a Y direction, and a Z direction in FIG. 34 are the same as the X direction, the Y direction, and the Z direction in FIG. 23.

As illustrated in FIG. 34, the antenna device 130 according to Modified Example 1 includes a metal base plate 131, a dielectric substrate 133, antenna elements 135*a* and 135*b*, and feeding portions 139*a* and 139*b*. Note that configurations of the metal base plate 131, the dielectric substrate 133, the antenna element 135*a*, and the antenna element 133*b* are substantially the same as the metal base plate 101, the dielectric substrate 103, the antenna element 105*a*, and the antenna element 105*b* in the antenna device 100 illustrated in FIG. 23. Further, Reference Sign 137 indicates a slit formed between the antenna elements 135*a* and 135*b*, and corresponds to the slit 107 in the antenna device 100 illustrated in FIG. 23. Therefore, hereinafter, the configuration of the antenna device 130 according to Modified Example 1 will be described focusing on a difference from the antenna device 100 according to the above-described embodiment, and a detailed description of the metal base plate 131, the dielectric substrate 133, the antenna elements 135*a* and 135*b*, and the slit 137 that are substantially the same as those of the antenna device 100 is omitted.

As illustrated in FIG. 34, the feeding portion 139*a* includes a pad 143*a*. Specifically, a portion corresponding to a feeding line of the feeding portion 139*a* is electrically connected to the pad 143*a*. Based on such a configuration, a feeding signal is supplied to the pad 143*a* via the portion corresponding to the feeding line of the feeding portion 139*a*, and power is fed from the pad 143*a* to a feeding point of the antenna element 135*a* by non-contact power feeding. Here, the pad 143*a* corresponding to an upper end of the feeding portion 139*a* is positioned below a radiation surface of the antenna element 135*a*.

Similarly, the feeding portion 139*b* includes a pad 143*b*. Specifically, a portion corresponding to a feeding line of the feeding portion 139*b* is electrically connected to the pad 143*b*. Based on such a configuration, a feeding signal is supplied to the pad 143*b* via the portion corresponding to the feeding line of the feeding portion 139*b*, and power is fed from the pad 143*b* to a feeding point of the antenna element 135*b* by non-contact power feeding. Here, the pad 143*b* corresponding to an upper end of the feeding portion 139*b* is positioned below a radiation surface of the antenna element 135*b*.

Figure 35:
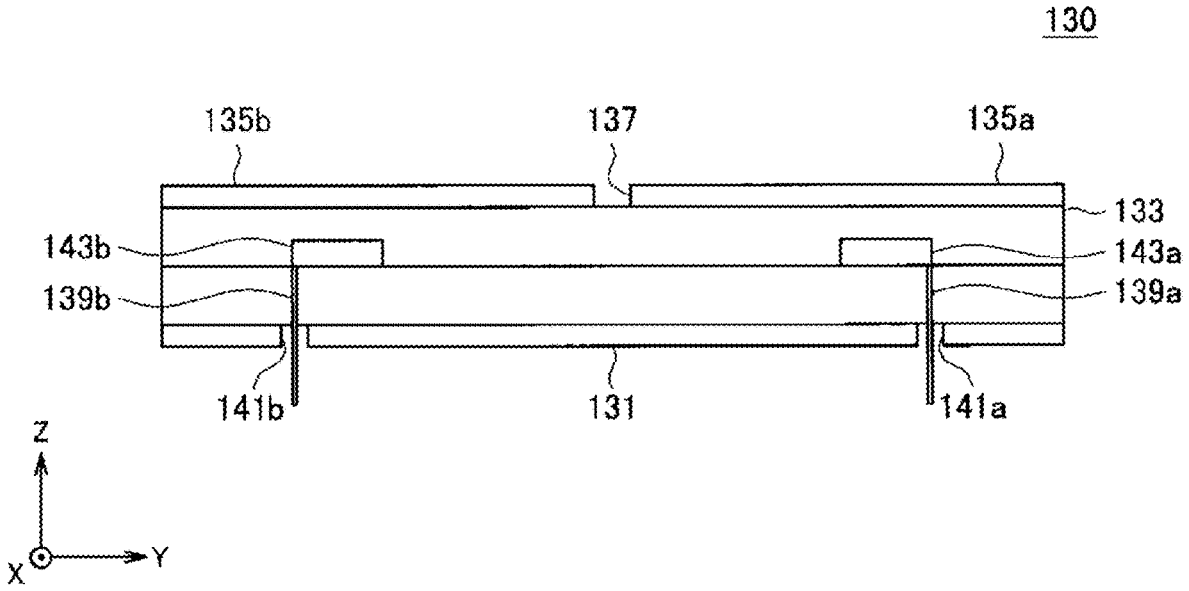
FIG. 35 is a schematic cross-sectional view of the antenna device illustrated in FIG. 34.

Here, an example of a method of arranging the feeding portions 139*a* and 139*b* and the pads 143*a* and 143*b* will be described in more detail with reference to FIG. 35. FIG. 35 is a schematic cross-sectional view of the antenna device 130 illustrated in FIG. 34, and is a cross-sectional view when viewed from the X direction in a case where the antenna device 130 is cut along a plane parallel to a ZY plane including the feeding portions 139*a* and 139*b*.

As illustrated in FIGS. 34 and 35, the pad 143*a* is formed in a substantially flat plate shape. Further, as illustrated in FIG. 35, the pad 143*a* is interposed between the antenna element 135*a* and the metal base plate 131, and is arranged so that an upper surface of the pad 143*a* faces a lower surface of the antenna element 135*a*. Further, a portion corresponding to the feeding line of the feeding portion 139*a* penetrates the metal base plate 131 through a hole portion 141*a* provided in the metal base plate 131 while being electrically separated from the metal base plate 131, and is electrically connected to the lower surface side of the pad 143*a*. Based on such a configuration, as the pad 143*a* and the antenna element 135*a* are capacitively coupled to each other, power feeding from the feeding portion 139*a* (particularly, the pad 143*a*) to the antenna element 135*a* is performed. Note that it is possible to achieve matching of capacitance added at this time by adjusting the dimension of the pad 143*a* and a distance between the pad 143*a* and the antenna element 135*a*, for example.

Similarly, the pad 143*b* is formed in a substantially flat plate shape. Further, the pad 143*b* is interposed between the antenna element 135*b* and the metal base plate 131, and is arranged so that an upper surface of the pad 143*b* faces a lower surface of the antenna element 135*b*. Further, a portion corresponding to the feeding line of the feeding portion 139*b* penetrates the metal base plate 131 through a hole portion 141*b* provided in the metal base plate 131 while being electrically separated from the metal base plate 131, and is electrically connected to the lower surface side of the pad 143*b*. Based on such a configuration, as the pad 143*b* and the antenna element 135*b* are capacitively coupled to each other, power feeding from the feeding portion 139*b* (particularly, the pad 143*b*) to the antenna element 135*b* is performed. Note that it is possible to achieve matching of capacitance added at this time by adjusting the dimension of the pad 143*b* and a distance between the pad 143*b* and the antenna element 135*b*, for example.

Note that a connection relationship between the pad 143*a* and the portion corresponding to the feeding line of the feeding portion 139*a* is not particularly limited. Specifically, in the example illustrated in FIG. 35, the feeding line is electrically connected to an end of the pad 143*a* in the Y direction so that the pad 143*a* and the portion corresponding to the feeding line of the feeding portion 139*a* form an L shape on a YZ plane. Alternatively, the feeding line may be electrically connected to a portion in the vicinity of the center of the pad 143*a* in the Y direction so that the pad 143*a* and the portion corresponding to the feeding line of the feeding portion 139*a* form a T shape on the YZ plane. The same applies to a connection relationship between the pad 143*b* and the portion corresponding to the feeding line of the feeding portion 139*b*.

As described above, as Modified Example 1, an example of the configuration of the antenna device according to the present embodiment in a case where the antenna device is configured to perform power feeding by non-contact power feeding has been described with reference to FIGS. 34 and 35.

Figure 36:
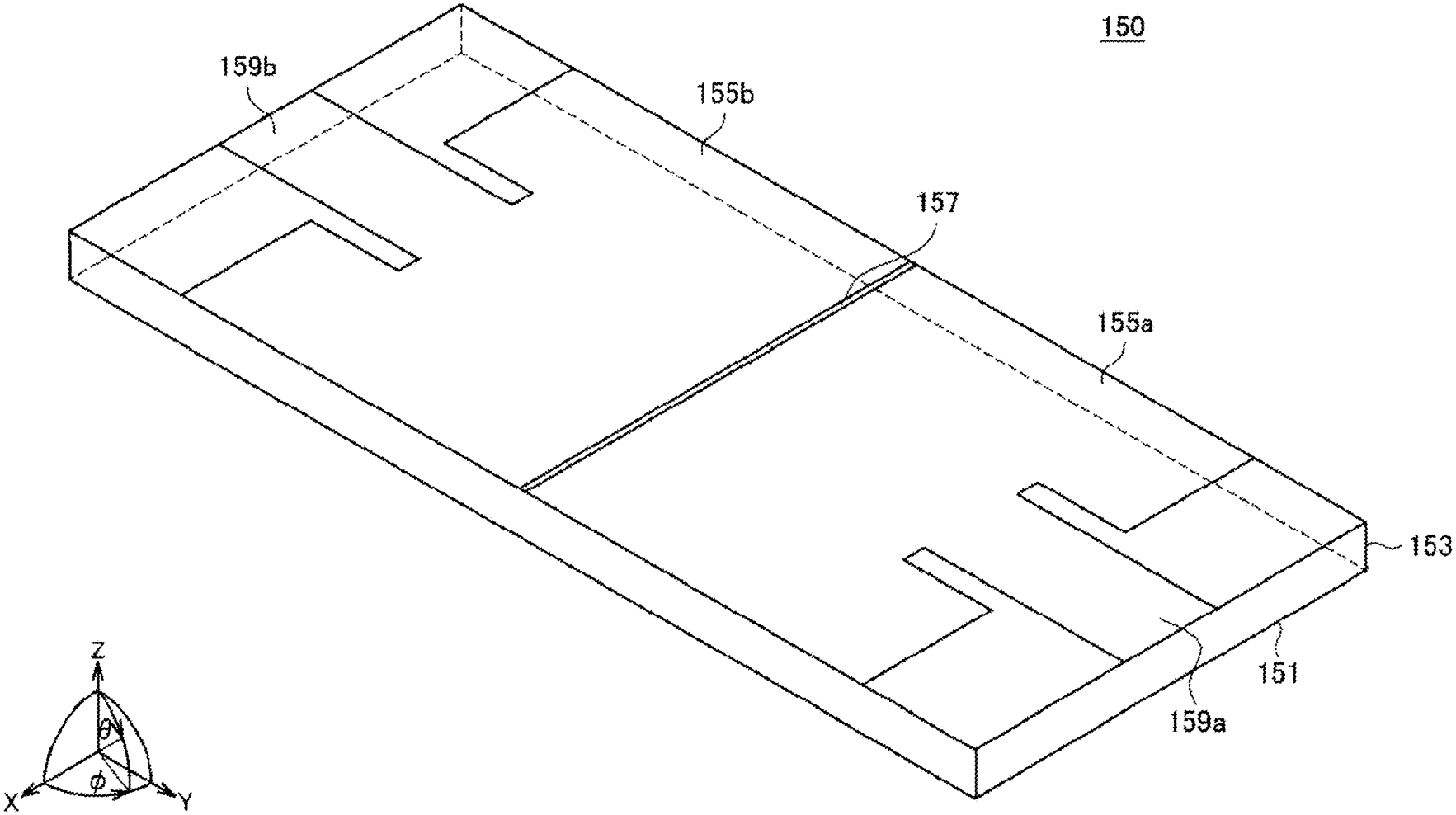
FIG. 36 is a view for describing an example of a configuration of an antenna device according to Modified Example 2.

Modified Example 2: Configuration Example when Power Feeding is Performed on Dielectric Substrate Next, as Modified Example 2, an example of the configuration of the antenna device according to the present embodiment in a case where the antenna device is configured to perform power feeding on a dielectric substrate will be described. For example, FIG. 36 is a view for describing an example of a configuration of the antenna device according to Modified Example 2, and is a schematic perspective view of the antenna device. Note that, in the following description, the antenna device according to Modified Example 2 may be referred to as an "antenna device 150" when it is particularly distinguished from the antenna device 100 according to the above-described embodiment. An X direction, a Y direction, and a Z direction in FIG. 36 are the same as the X direction, the Y direction, and the Z direction in FIG. 23.

As illustrated in FIG. 36, the antenna device 150 according to Modified Example 2 includes a metal base plate 151, a dielectric substrate 153, and antenna elements 155*a* and 155*b*. Note that configurations of the metal base plate 151 and the dielectric substrate 153 are substantially the same as those of the metal base plate 101 and the dielectric substrate 103 in the antenna device 100 illustrated in FIG. 23. Further, Reference Sign 157 indicates a slit formed between the antenna elements 155*a* and 155*b*, and corresponds to the slit 107 in the antenna device 100 illustrated in FIG. 23. Therefore, hereinafter, the configuration of the antenna device 150 according to Modified Example 2 will be described focusing on a difference from the antenna device 100 according to the above-described embodiment, and a detailed description of the metal base plate 151, the dielectric substrate 153, and a slit 157 that are substantially the same as those of the antenna device 100 is omitted.

As illustrated in FIG. 36, the antenna element 155*a* is formed on the dielectric substrate 153 so that a portion of the antenna element 155*a* extends in the +Y direction (that is, a direction along an upper surface of the dielectric substrate 153), and the extending portion serves as a feeding portion. Therefore, hereinafter, the portion of the antenna element 155*a* that is formed so as to extend in the +Y direction is also referred to as a "feeding portion 159*a*" for convenience. That is, on the dielectric substrate 153, the feeding portion 159*a* is electrically connected to a side portion of a portion corresponding to a radiation metal plate of the antenna element 155*a*. Further, the feeding portion 159*a* is arranged so that a position of an upper surface of the feeding portion 159*a* in the Z direction is on substantially the same level as a position of a radiation surface (that is, upper surface) of the antenna element 155*a*, or is on a level lower than the radiation surface (that is, on a side opposite to a direction in which the antenna element 155*a* radiates a wireless signal). Note that, in the Z direction, a direction in which the antenna element 155*a* radiates a wireless signal (that is, upward) corresponds to an example of a "third direction", and a direction (that is, downward) opposite to the direction corresponds to an example of a "fourth direction".

Further, the antenna element 155*b* is formed on the dielectric substrate 153 so that a portion of the antenna element 155*b* extends in the −Y direction (that is, the direction along the upper surface of the dielectric substrate 153), and the extending portion serves as a feeding portion. Therefore, hereinafter, the portion of the antenna element 155*b* that is formed so as to extend in the −Y direction is also referred to as a "feeding portion 159*bv* for convenience. That is, on the dielectric substrate 153, the feeding portion 159*b* is electrically connected to a side portion of a portion corresponding to a radiation metal plate of the antenna element 155*b*. Further, the feeding portion 159*b* is arranged so that a position of an upper surface of the feeding portion 159*b* in the Z direction is on substantially the same level as a position of a radiation surface (that is, upper surface) of the antenna element 155*b*, or is on a level lower than the radiation surface (that is, on a side opposite to a direction in which the antenna element 155*a* radiates a wireless signal).

Note that, for example, at least a part of the feeding portions 159*a* and 159*b* may be configured as a microstrip line. Further, in the example illustrated in FIG. 36, antenna characteristic matching is performed by providing a notch in the vicinity of a portion where the feeding portion 159*a* is provided, in a portion corresponding to the radiation metal plate of the antenna element 155*a*. That is, the antenna characteristic matching may be performed by performing an electromagnetic field analysis using at least some of the depth, the width, and the like of the notch as a parameter. Similarly, the antenna characteristic matching is performed by providing a notch also in the vicinity of a portion where the feeding portion 159*b* is provided, in a portion corresponding to the radiation metal plate of the antenna element 155*b*.

Power is fed to each of the feeding portions 159*a* and 159*b* based on the above configuration. Here, a control is performed so that a phase difference between feeding signals supplied to the feeding portions 159*a* and 159*b*, respectively, is approximately 180 degrees. Note that a method of arranging a feeding circuit that feeds power to the antenna elements 155*a* and 155*b* via the feeding portions 159*a* and 159*b* is not particularly limited. For example, a portion corresponding to the feeding circuit may be arranged on the dielectric substrate 153, similarly to the feeding portions 159*a* and 159*b*. In this case, it is more preferable that the portion corresponding to the feeding circuit is arranged so that a position of an upper surface of the portion in the Z direction is on substantially the same level as a position of a radiation surface (that is, upper surface) of each of the antenna elements 155*a* and 155*b*, or is on a level lower than the radiation surface. It is a matter of course that the above is merely an example, and the position where the portion corresponding to the feeding circuit is arranged is not limited.

Hereinabove, as Modified Example 2, an example of the configuration of the antenna device according to the present embodiment in a case where the antenna device is configured to perform power feeding on the dielectric substrate has been described with respect to FIG. 36.

Modified Example 3: Example of Configuration of Metal Base Plate

Figure 37:
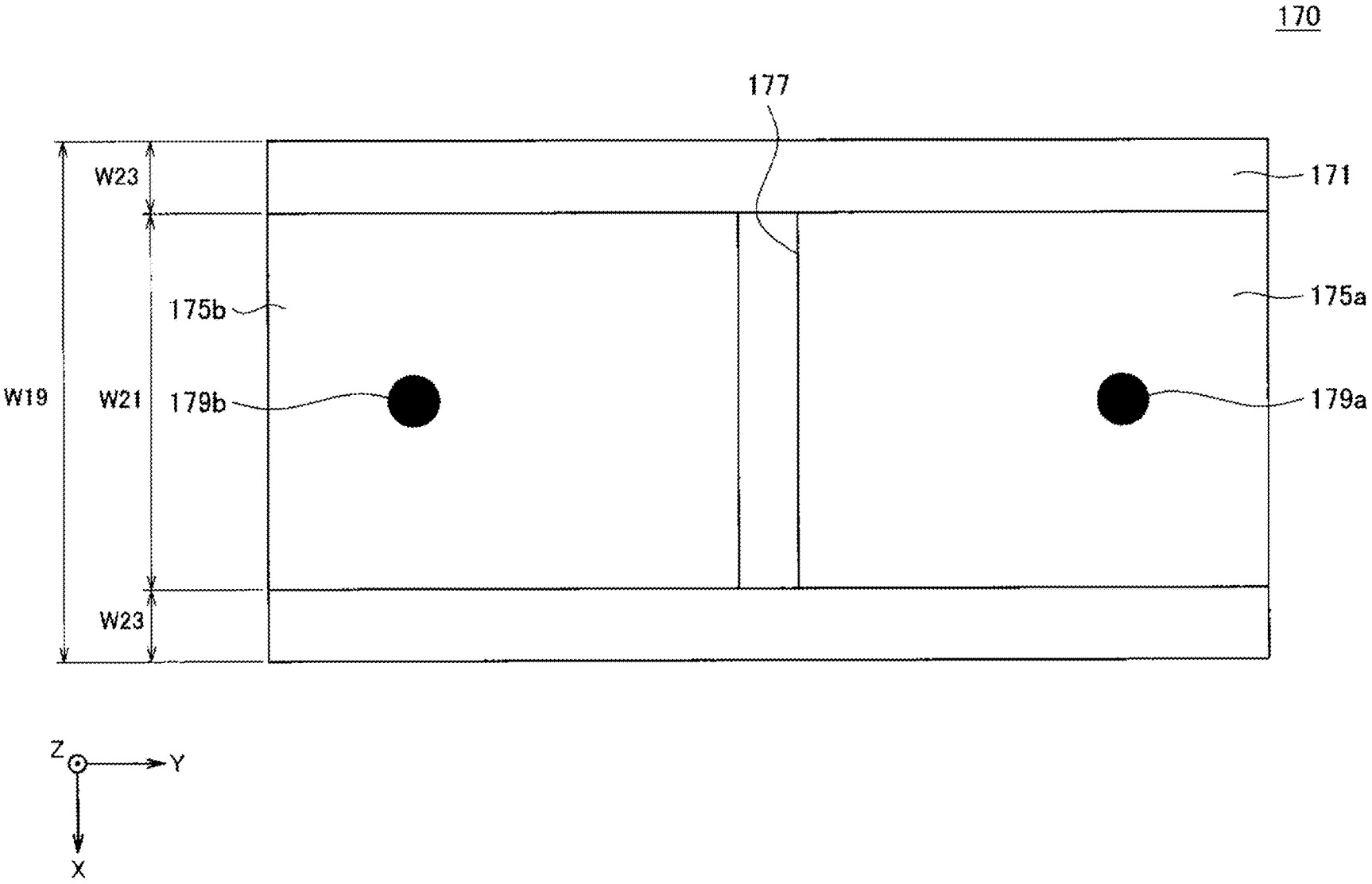
FIG. 37 is a view for describing an example of a configuration of an antenna device according to Modified Example 3.

Next, as Modified Example 3, an example of a configuration of a portion corresponding to the metal base plate of the antenna device according to the present embodiment will be described. For example, FIG. 37 is a view for describing an example of a configuration of the antenna device according to Modified Example 3, and is a schematic plan view of the antenna device when viewed from above (+Z direction). Note that, in the following description, the antenna device according to Modified Example 3 may be referred to as an "antenna device 170" when it is particularly distinguished from the antenna device 100 according to the above-described embodiment. An X direction, a Y direction, and a Z direction in FIG. 37 correspond to the X direction, the Y direction, and the Z direction in FIG. 23, respectively.

In FIG. 37, Reference Sign 171 indicates a portion of the antenna device 170 that corresponds to a metal base plate, and corresponds to the metal base plate 101 in the antenna device 100 described above. Further, Reference Signs 175*a* and 175*b* indicate portions of the antenna device 170 that correspond to antenna elements, and correspond to the antenna elements 105*a* and 105*b* in the antenna device 100 described above, respectively. That is, Reference Sign 177 indicates a slit formed between the antenna elements 175*a* and 175*b*, and corresponds to the slit 107 in the antenna device 100 described above. Further, Reference Signs 179*a* and 179*b* schematically indicate positions of feeding points of the antenna elements 175*a* and 175*b*, respectively.

Further, in FIG. 37, Reference Sign W21 indicates the width of each of the antenna elements 175*a* and 175*b* in the X direction. Further, Reference Sign W19 indicates the width of the metal base plate 171 in the X direction. That is, in the antenna device 170 according to Modified Example 3, the size of the metal base plate 171 on an XY plane is larger than the size of a region on the XY plane in which the antenna elements 175*a* and 175*b* are arranged. Here, the antenna elements 175*a* and 175*b* and the metal base plate 171 are arranged so that the projections of the antenna elements 175*a* and 175*b* in the Z direction are included in the metal base plate 171. Particularly in the example illustrated in FIG. 37, the metal base plate 171 is formed so that the width W19 of the metal base plate 171 in the X direction is larger than the width W21 of each of the antenna elements 175*a* and 175*b* in the X direction.

Note that the width W19 of the metal base plate 171 in the X direction may be appropriately set according to a required specification of the antenna device 170. As a specific example, similarly to the example described above as Example, a case where the width W21 of each of the antenna elements 175*a* and 175*b* in the X direction is 35 mm, the thickness of the metal base plate 171 in the Z direction is 4 mm, and a 2.45 GHz wireless signal is transmitted or received is assumed. In this case, it is preferable that, in each of the +X direction and the −X direction, the width W19 of the metal base plate 171 in the X direction is larger than the width W21 of each of the antenna elements 175*a* and 175*b* in the X direction, and is larger than the thickness of the metal base plate 171 (that is, the width W19 is 4 mm or more). That is, in the example illustrated in FIG. 37, it is more preferable that the metal base plate 171 is formed so that the width of a portion indicated by Reference Sign W23 is equal to or larger than the thickness of the metal base plate 171 in the Z direction.

Hereinabove, as Modified Example 3, an example of the configuration of the portion corresponding to the metal base plate of the antenna device according to the present embodiment has been described with reference to FIG. 37.

Figure 38:
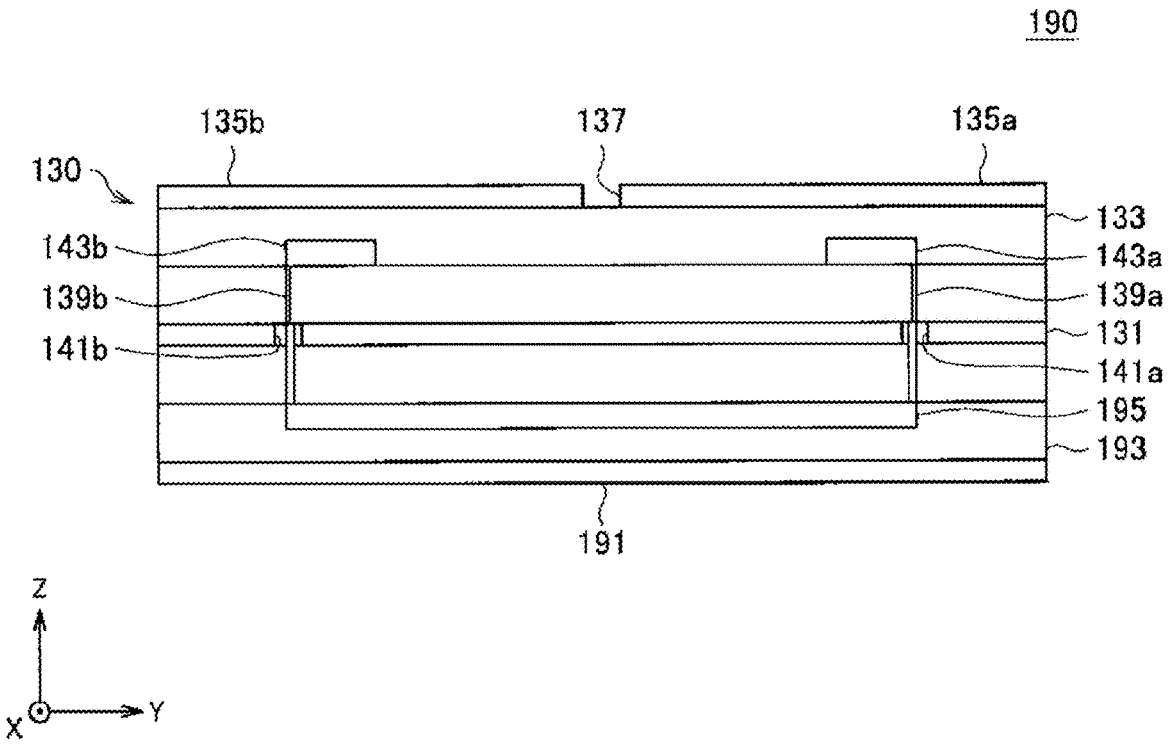
FIG. 38 is a view for describing an example of a configuration of an antenna device according to Modified Example 4.

Modified Example 4: Configuration Example when Feeding Circuit is Integrated Next, as Modified Example 4, an example of a configuration of the antenna device according to the present embodiment and a feeding circuit in a case where the antenna device is integrated with a component corresponding to the feeding circuit will be described. For example, FIG. 38 is a diagram for describing an example of a configuration of the antenna device according to Modified Example 4, and is a schematic cross-sectional view of the antenna device according to Modified Example 4. Note that, in the following description, the antenna device according to Modified Example 4 may be referred to as an "antenna device 190" when it is particularly distinguished from the antenna device 100 according to the above-described embodiment. Similarly to the cross-sectional view illustrated in FIG. 24, the cross-sectional view illustrated in FIG. 38 is a cross-sectional view when viewed from an X direction in a case where the antenna device 190 is cut along a plane parallel to a ZY plane including portions corresponding to the feeding portions 109*a* and 109*b*. That is, the X direction, a Y direction, and a Z direction in FIG. 38 correspond to the X direction, the Y direction, and the Z direction in FIG. 23, respectively.

The example illustrated in FIG. 38 shows, as an example of the configuration of the antenna device 190 according to Modified Example 4, a case where the antenna device 130 according to Modified Example 1 described above is integrated with a component corresponding to a feeding circuit. Specifically, a portion indicated by Reference Sign 130 corresponds to the antenna device 130 described with reference to FIGS. 34 and 35. That is, in FIG. 38, portions denoted by the same Reference Signs as those in FIGS. 34 and 35 indicate the same components as those in FIGS. 34 and 35, and thus a detailed description thereof is omitted.

As illustrated in FIG. 38, the antenna device 190 is configured by integrating the antenna device 130 with a feeding circuit 195 so that the feeding circuit 195 is positioned below the antenna device 130 illustrated in FIGS. 34 and 35. The feeding circuit 195 corresponds to, for example, a portion that feeds power to at least each of the feeding pins 1011*a* and 1011*b* in the wireless communication unit 1003 illustrated in FIG. 26.

Specifically, a substantially plate-shaped dielectric substrate 193 is formed so as to be positioned below the metal base plate 131 (that is, on a side opposite to a side facing the dielectric substrate 133). That is, the metal base plate 131 is arranged above the dielectric substrate 193. Further, a substantially plate-shaped metal plate 191 is provided on the lower surface side of the dielectric substrate 193 so as to cover substantially an entire lower surface of the dielectric substrate 193. Further, the feeding circuit 195 formed in a substantially plate shape (substantially foil shape) is arranged inside the dielectric substrate 193 so as to be interposed between the metal base plate 131 and the metal plate 191. That is, the metal base plate 131, the metal plate 191, the dielectric substrate 193, and the feeding circuit 195 form a structure corresponding to a so-called strip line.

Based on the configuration as described above, a portion corresponding to a feeding line of each of the feeding portions 139*a* and 139*b* that extend to the inside of the dielectric substrate 193 through the hole portions 141*a* and 141*b* formed in the metal base plate 131, respectively, is electrically connected to the feeding circuit 195. As a result, a feeding signal output from the feeding circuit 195 is supplied to the feeding portions 139*a* and 139*b*, and power is fed to the respective antenna elements 135*a* and 135*b* via the feeding portions 139*a* and 139*b*. Further, as described above, it is possible to further reduce, even in a case where a metal is brought close to the lower surface side (−Z direction side) of the antenna device 190, an influence of the metal, by integrating the feeding circuit 195 with the antenna device 130 so as to form the structure corresponding to the strip line. That is, the antenna device according to the present embodiment can be modularized in a more suitable form.

Note that, in the example illustrated in FIG. 38, a case where the antenna device 130 according to Comparative Example 1 is applied has been described as an example, but the configuration of the antenna device 190 according to Modified Example 4 is not necessarily limited. That is, another antenna device (for example, the above-described antenna device 100) can be applied instead of the antenna device 130 as long as power is fed to the antenna element from the lower surface side of the target antenna device.

Hereinabove, as Modified Example 4, an example of the configuration of the antenna device according to the present embodiment and a feeding circuit in a case where the antenna device is integrated with a component corresponding to the feeding circuit has been described with reference to FIG. 38.

4. APPLICATION EXAMPLE

Next, an example of a case where the technology according to the present disclosure is applied to a device other than a communication terminal such as a smartphone will be described as an application example of the communication device to which the antenna device according to the embodiment of the present disclosure is applied.

As described above, in recent years, a technology called IoT that connects various things to a network has attracted attention, and it is assumed that a device other than a smartphone or tablet terminal can also be used for communication. Therefore, for example, by applying the technology according to the present disclosure to various devices configured to be movable, the devices can be implemented in a more suitable form.

Figure 39:
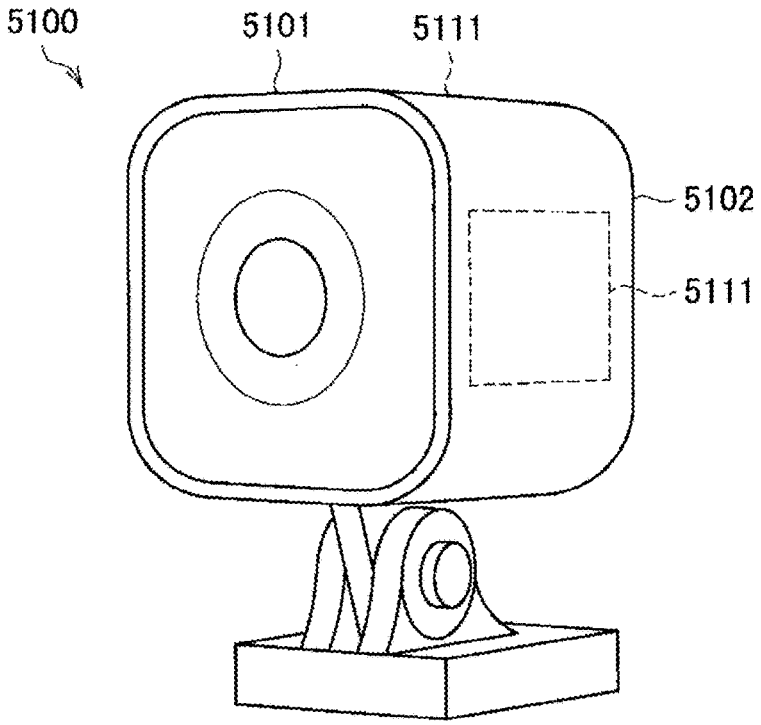
FIG. 39 is a view for describing an application example of the communication device according to the embodiment.

For example, FIG. 39 is a view for describing an application example of the communication device according to the present embodiment, and illustrates an example of a case where the technology according to the present disclosure is applied to a camera device. Specifically, in the example illustrated in FIG. 39, the antenna device according to the embodiment of the present disclosure is held so as to be positioned in the vicinity of each of surfaces 5101 and 5102 that face different directions among outer surfaces of a housing of a camera device 5100. For example, Reference Sign 5111 schematically indicates the antenna device according to the embodiment of the present disclosure. With such a configuration, the camera device 5100 illustrated in FIG. 39 can transmit or receive a wireless signal propagating in a direction that substantially coincides with a normal direction of each of the surfaces 5101 and 5102, for example. It is needless to say that the antenna device 5111 may be provided not only on the surfaces 5101 and 5102 illustrated in FIG. 39, but also on other surfaces.

Figure 40:
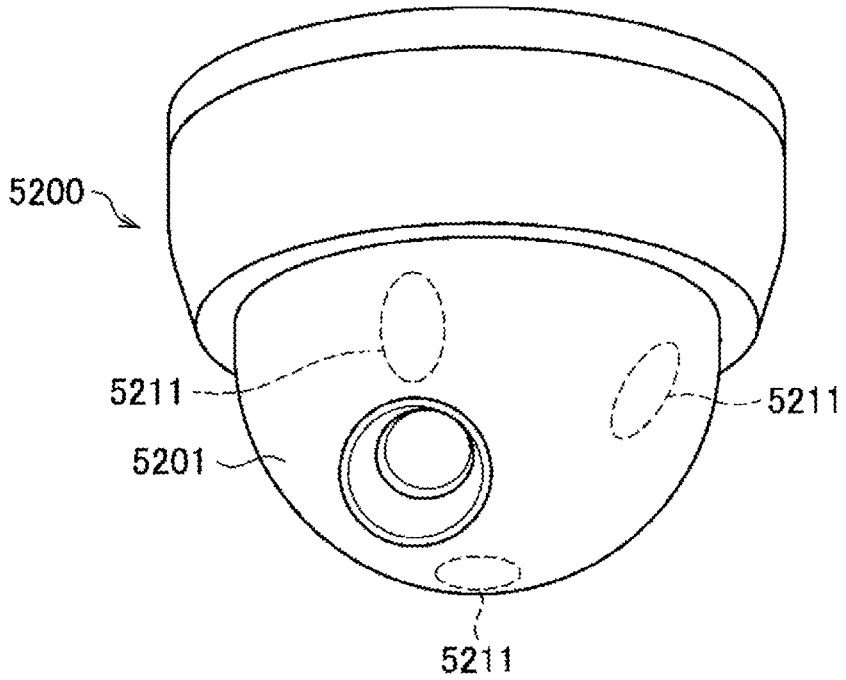
FIG. 40 is a view for describing an application example of the communication device according to the embodiment.

Further, the technology according to the present disclosure can be applied to an unmanned aerial vehicle called a drone. For example, FIG. 40 is a view for describing an application example of the communication device according to the present embodiment, and illustrates an example of a case where the technology according to the present disclosure is applied to a camera device installed on a lower portion of a drone. Specifically, in a case of a drone flying in a high place, it is preferable to be able to transmit or receive a wireless signal from below in each direction. Therefore, for example, in the example illustrated in FIG.

40, the antenna device according to the embodiment of the present disclosure is held so as to be positioned in the vicinity of each of portions that face different directions in an outer surface 5201 of a housing of a camera device 5200 installed on a lower portion of a drone. For example, Reference Sign 5211 schematically indicates the antenna device according to the embodiment of the present disclosure. Although not illustrated in FIG. 40, the antenna device 5211 may be provided not only in the camera device 5200, but also in various portions of the housing of the drone itself, for example. Also in this case, the antenna device 5211 is preferably provided on, in particular, the lower side of the housing.

Note that, as illustrated in FIG. 40, in a case where at least a part of the outer surface of the housing of the target device is a curved surface, the antenna device 5211 is preferably held in the vicinity of a plurality of partial regions at positions where normal directions are intersect with each other or mutually twisted, among partial regions in the curved surface. With such a configuration, the camera device 5200 illustrated in FIG. 40 can transmit or receive a wireless signal propagating in a direction that substantially coincides with a normal direction of each partial region.

Note that the examples described with reference to FIGS. 39 and 40 are merely examples, and application of the technology according to the present disclosure is not particularly limited as long as it is a device that performs communication using a wireless signal.

Figure 41:
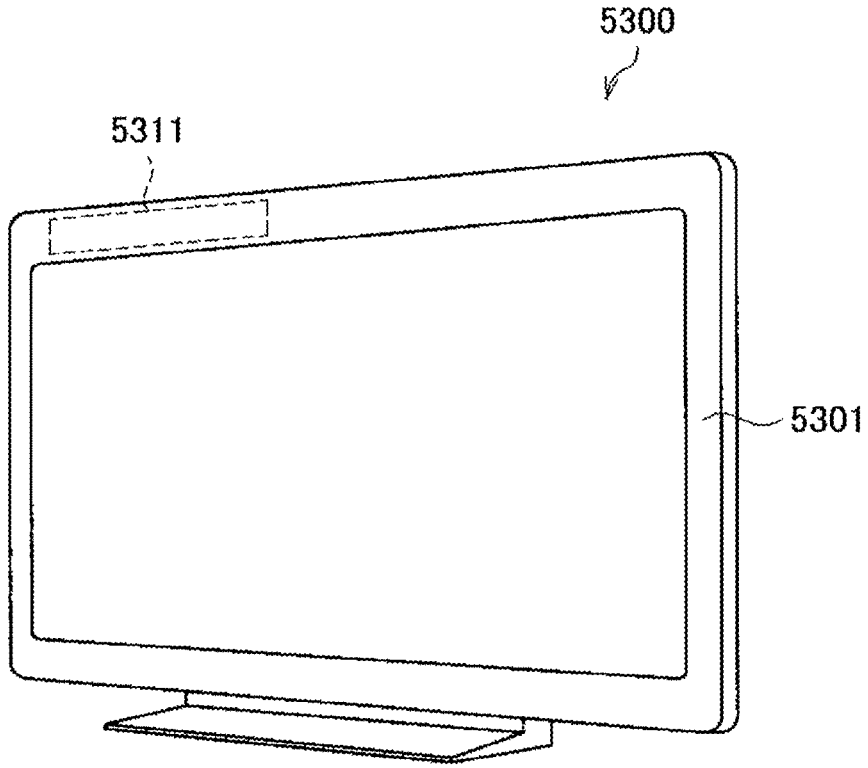
FIG. 41 is a view for describing an application example of the communication device according to the embodiment.
Figure 42:
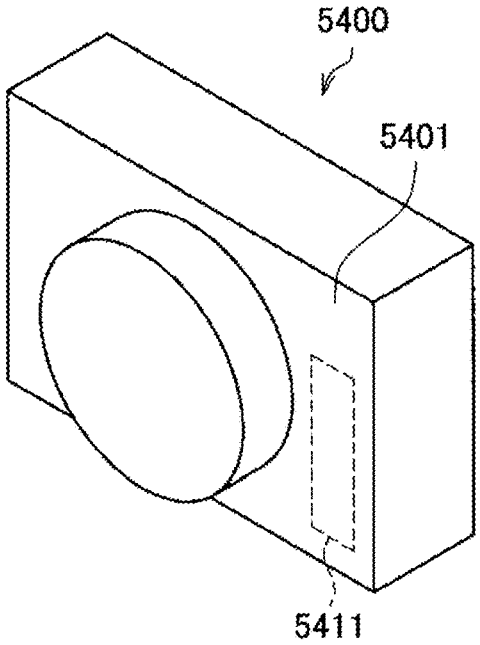
FIG. 42 is a view for describing an application example of the communication device according to the embodiment.
Figure 43:
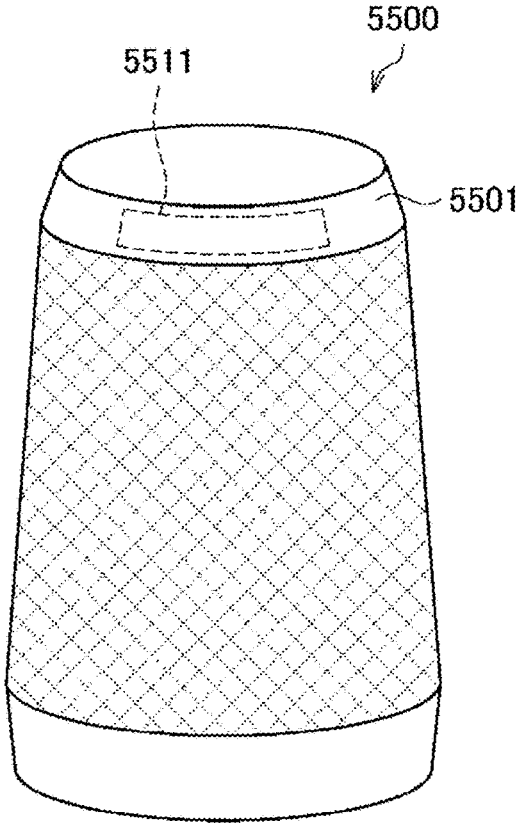
FIG. 43 is a view for describing an application example of the communication device according to the embodiment.

FIGS. 41 to 43 are views for describing application examples of the antenna device according to the present embodiment, and each illustrate an example of a case where the antenna device according to the present embodiment is applied to a device other than the communication device such as a so-called smartphone.

Specifically, FIG. 41 illustrates an example in which the antenna device according to the present embodiment is provided in a housing of a display device 5300 such as a so-called display. In FIG. 41, Reference Sign 5311 schematically indicates the antenna device according to the embodiment of the present disclosure. Specifically, in the example illustrated in FIG. 41, the antenna device 5311 is arranged so as to be positioned in the vicinity of a front surface 5301 where a display panel is arranged, in the housing of the display device 5300. Here, it is more preferable that the antenna device 5311 is arranged at a position where the antenna device 5311 does not interfere with each device for displaying an image on the display panel. Thereby, in the example illustrated in FIG. 41, the antenna device 5311 can transmit or receive a wireless signal propagating in a direction that substantially coincides with a normal direction of the front surface 5301.

Further, FIG. 42 illustrates an example in which the antenna device according to the present embodiment is provided in a housing of an image capturing device 5400 such as a so-called digital still camera. In FIG. 42, Reference Sign 5411 schematically indicates the antenna device according to the embodiment of the present disclosure. Specifically, in the example illustrated in FIG. 42, the antenna device 5411 is arranged so as to be positioned at a part of a portion of the housing of the image capturing device 5400 that is different from a portion where a user's hand is put when the user grips the housing of the image capturing device 5400. More specifically, in the example illustrated in FIG. 42, the antenna device 5411 is arranged at a position different from a position where a lens is arranged, in a front surface 5401 of the housing of the image capturing device 5400. That is, it is more preferable that the antenna device 5411 is arranged at a position where the antenna device 5411 does not interfere with a component related to image capturing, such as a lens or an image sensor. Thereby, in the example illustrated in FIG. 42, the antenna device 5411 can transmit or receive a wireless signal propagating in a direction that substantially coincides with a normal direction of the surface 5401.

Further, FIG. 43 illustrates an example of a case where the antenna device according to the present embodiment is provided in a housing of an acoustic output device 5500 such as a so-called speaker (for example, smart speaker). In FIG. 43, Reference Sign 5511 schematically indicates the antenna device according to the embodiment of the present disclosure. Specifically, in the example illustrated in FIG. 43, the acoustic output device 5500 includes the housing having a substantially cylindrical shape, and the antenna device 5511 is arranged so as to be positioned in the vicinity of a part of a side surface 5501 of the housing. Here, it is more preferable that the antenna device 5511 is arranged at a position where the antenna device 5511 does not interfere with a component related to output of sound. Thereby, in the example illustrated in FIG. 42, the antenna device 5511 can transmit or receive a wireless signal propagating in a direction that substantially coincides with a normal direction of a portion of the side surface 5501 that is near a portion where the antenna device 5511 is arranged.

Hereinabove, examples of a case where the technology according to the present disclosure is applied to a device other than a communication terminal such as a smartphone have been described with reference to FIGS. 39 to 43 as application examples of the communication device to which the antenna device according to the embodiment of the present disclosure is applied.

5. CONCLUSION

As described above, the antenna device according to the embodiment of the present disclosure includes a substantially-flat-plate-shaped dielectric substrate, a metal base plate, substantially-flat-plate-shaped first and second antenna elements, and first and second feeding portions. The metal base plate is arranged on a first surface of the dielectric substrate. The first antenna element and the second antenna element are arranged on a second surface of the dielectric substrate that is opposite to the first surface and on an opposite side of the dielectric substrate from the metal base plate, so that a slit is formed. The first feeding portion feeds power to the first antenna element. The second feeding portion feeds power to the second antenna element. Further, a phase difference between feeding signals supplied to the first feeding portion and the second feeding portion, respectively, is approximately 180 degrees. The communication device according to the present embodiment includes the above-described antenna device according to the present embodiment.

With the above configuration, the antenna device according to the embodiment of the present disclosure can further reduce a change in various characteristics when a metal is brought close to the antenna device. Further, with the configuration characteristics described above, the antenna device according to the present embodiment can perform so-called unbalanced power feeding, the degree of freedom in a case of providing the feeding portion in a form in which a radiation pattern is not blocked by the feeding portion (for example, feeding line) is increased, and the antenna device also has a high affinity with a general microstrip line. That is, with the antenna device according to the present embodiment, even in a situation where the antenna device is installed in a limited space inside the housing of the communication device, an influence of proximity to a metal can be further reduced, and power can be fed to the antenna element in a more suitable manner.

The preferred embodiments of the present disclosure have been described above in detail with reference to the accompanying drawings, but the technical scope of the present disclosure is not limited to such examples. It is obvious that a person having ordinary knowledge in the technical field of the present disclosure can derive various changes or modifications within the scope of the technical idea described in the claims, and it is understood that the changes or modifications also naturally fall within the technical scope of the present disclosure.

Further, the effects described in the present specification are merely explanatory or illustrative, and are not limitative. That is, the technology according to the present disclosure may have other effects that are apparent to those skilled in the art from the description of the present specification, in addition to or instead of the above effects.

Note that the following configurations also fall within the technical scope of the present disclosure.

(1)

An antenna device comprising:

a substantially-flat-plate-shaped dielectric substrate;

a metal base plate arranged on a first surface of the dielectric substrate;

substantially-flat-plate-shaped first and second antenna elements arranged on a second surface of the dielectric substrate that is opposite to the first surface and on an opposite side of the dielectric substrate from the metal base plate so that a slit is formed;

a first feeding portion that feeds power to the first antenna element; and a second feeding portion that feeds power to the second antenna element, wherein a phase difference between feeding signals supplied to the first and second feeding portions, respectively, is approximately 180 degrees.

(2)

The antenna device according to (1), wherein the first and second antenna elements are arranged so as to be electrically separated from each other.

(3)

The antenna device according to (1) or (2), wherein the first and second feeding portions are arranged so that a first direction in which the slit extends, and a second direction from one of feeding points corresponding to the first and second feeding portions, respectively, toward the other feeding point are substantially orthogonal to each other.

(4)

The antenna device according to any one of (1) to (3), wherein each of the first and second feeding portions is arranged so that a position of a third-direction-side end in a third direction in which a wireless signal is radiated from each of the first and second antenna elements is on substantially the same level as a radiation surface of each of the first and second antenna elements, or is on a level that is more toward a fourth direction than the radiation surface is, the fourth direction being opposite to the third direction.

(5)

The antenna device according to (4), wherein at least one of the first feeding portion or the second feeding portion is arranged so as to be positioned on a fourth-direction side of one of the first and second antenna elements that is a power feeding target of the at least one feeding portion.

(6)

The antenna device according to (5), wherein at least one of the first feeding portion or the second feeding portion is arranged so as to penetrate through the metal base plate while being electrically separated from the metal base plate.

(7)

The antenna device according to (5) or (6), wherein at least one of the first feeding portion or the second feeding portion is electrically connected to a surface of one of the first and second antenna elements that is a power feeding target of the at least one feeding portion, the surface being opposite to the radiation surface.

(8)

The antenna device according to (5) or (6), wherein at least one of the first feeding portion or the second feeding portion includes a pad arranged so as to face a surface of one of the first and second antenna elements that is a power feeding target of the at least one feeding portion, the surface being opposite to the radiation surface, and performs power feeding to the one antenna element by capacitive coupling.

(9)

The antenna device according to (4), wherein at least one of the first feeding portion or the second feeding portion is arranged on the first surface of the dielectric substrate.

(10)

The antenna device according to any one of (1) to (9), wherein a position of a feeding point of one of the first and second antenna elements that is a power feeding target of at least one of the first feeding portion or the second feeding portion is determined depending on input impedance to be matched.

(11)

The antenna device according to (10), wherein a distance between the feeding point and the slit is determined depending on the input impedance to be matched.

(12)

The antenna device according to any one of (1) to (11), wherein the first and second antenna elements are arranged so that a width of the slit is smaller than ½ of a wavelength of a wireless signal transmitted or received to or from the first and second antenna elements.

(13)

The antenna device according to (12), wherein the first and second antenna elements are arranged so that the width of the slit is 1/40 or less of the wavelength of the wireless signal transmitted or received to or from the first and second antenna elements.

(14)

The antenna device according to any one of (1) to (13), wherein a radiation surface of each of the first and second antenna elements, each of which a width in a direction orthogonal to a direction in which the slit extends is substantially equal to a length Ly shown below when the wavelength of the transmitted or received wireless signal is $\lambda$ and relative permittivity of the dielectric substrate is $\varepsilon_r$, are arranged.

$$L_y = 0.4\lambda/\sqrt{\varepsilon_r}$$

(15)

The antenna device according to (14), wherein the first and second antenna elements are arranged so that a width of the slit is 1/10 or less of the length of the one side of the radiation surface having a shape that is substantially the same as a square.

(16)

The antenna device according to any one of (1) to (15), wherein the metal base plate is formed so that a width of the metal base plate in a direction in which the slit extends is larger than that of each of the first and second antenna elements.

(17)

The antenna device according to any one of (1) to (16), further comprising a feeding circuit that supplies the feeding signal to at least one of the first feeding portion or the second feeding portion, wherein the feeding circuit is arranged so as to be positioned on an opposite side of the metal base plate from the dielectric substrate.

(18)

The antenna device according to (17), wherein the feeding circuit is arranged in the dielectric substrate formed so as to be interposed between the metal base plate and another flat-plate-shaped metal plate different from the metal base plate.

(19)

A communication device comprising:

an antenna device; and a communication unit that transmits or receives a wireless signal via the antenna device, wherein the antenna device includes:

a substantially-flat-plate-shaped dielectric substrate;

a metal base plate arranged on a first surface of the dielectric substrate;

substantially-flat-plate-shaped first and second antenna elements arranged on a second surface of the dielectric substrate that is opposite to the first surface and on an opposite side of the dielectric substrate from the metal base plate so that a slit is formed;

a first feeding portion that feeds power to the first antenna element; and a second feeding portion that feeds power to the second antenna element, and a phase difference between feeding signals supplied to the first and second feeding portions, respectively, is approximately 180 degrees.

REFERENCE SIGNS LIST

100 ANTENNA DEVICE
101 METAL BASE PLATE
103 DIELECTRIC SUBSTRATE
105*a*, 105*b* ANTENNA ELEMENT
107 SLIT
109*a*, 109*b* FEEDING PORTION
111*a*, 111*b* HOLE PORTION
1000 COMMUNICATION DEVICE
1001 ANTENNA UNIT
1003 WIRELESS COMMUNICATION UNIT
1005 COMMUNICATION CONTROL UNIT
1007 STORAGE UNIT
1011 ANTENNA UNIT
1011*a*, 1011*b* FEEDING PIN
1013 TRANSMITTER
1015 MODULATION CIRCUIT
1017 PA
1019 SWITCH
1021 FILTER
1023 DISTRIBUTOR
1025 PHASE CIRCUIT
1027 LNA
1029 DEMODULATION CIRCUIT
1031 RECEIVER

The invention claimed is:

1. An antenna device comprising:

a substantially-flat-plate-shaped dielectric substrate;

a metal base plate arranged on a first surface of the dielectric substrate;

substantially-flat-plate-shaped first and second antenna elements arranged on a second surface of the dielectric substrate that is opposite to the first surface and on an opposite side of the dielectric substrate from the metal base plate so that a slit is formed;

a first feeding portion that feeds power to the first antenna element; and a second feeding portion that feeds power to the second antenna element, wherein a phase difference between feeding signals supplied to the first and second feeding portions, respectively, is approximately 180 degrees, wherein a distance between a feeding point of one of the first and second antenna elements and the slit is determined depending on an input impedance to be matched.

2. The antenna device according to claim 1, wherein the first and second antenna elements are arranged so as to be electrically separated from each other.

3. The antenna device according to claim 1, wherein the first and second feeding portions are arranged so that a first direction in which the slit extends, and a second direction from one of feeding points corresponding to the first and second feeding portions, respectively, toward the other feeding point are substantially orthogonal to each other.

4. The antenna device according to claim 1, wherein each of the first and second feeding portions is arranged so that a position of a third-direction-side end in a third direction in which a wireless signal is radiated from each of the first and second antenna elements is on substantially the same level as a radiation surface of each of the first and second antenna elements, or is on a level that is more toward a fourth direction than the radiation surface is, the fourth direction being opposite to the third direction.

5. The antenna device according to claim 4, wherein at least one of the first feeding portion or the second feeding portion is arranged so as to be positioned on a fourth-direction side of one of the first and second antenna elements that is a power feeding target of the at least one feeding portion.

6. The antenna device according to claim 5, wherein at least one of the first feeding portion or the second feeding portion is arranged so as to penetrate through the metal base plate while being electrically separated from the metal base plate.

7. The antenna device according to claim 5, wherein at least one of the first feeding portion or the second feeding portion is electrically connected to a surface of one of the first and second antenna elements that is a power feeding target of the at least one feeding portion, the surface being opposite to the radiation surface.

8. The antenna device according to claim 5, wherein at least one of the first feeding portion or the second feeding portion includes a pad arranged so as to face a surface of one of the first and second antenna elements that is a power feeding target of the at least one feeding portion, the surface being opposite to the radiation surface, and performs power feeding to the one antenna element by capacitive coupling.

9. The antenna device according to claim 4, wherein at least one of the first feeding portion or the second feeding portion is arranged on the first surface of the dielectric substrate.

10. The antenna device according to claim 1, wherein a position of a feeding point of one of the first and second antenna elements that is a power feeding target of at least one of the first feeding portion or the second feeding portion is determined depending on input impedance to be matched.

11. The antenna device according to claim 1, wherein the first and second antenna elements are arranged so that a width of the slit is smaller than ½ of a wavelength of a wireless signal transmitted or received to or from the first and second antenna elements.

12. The antenna device according to claim 11, wherein the first and second antenna elements, each of which a width in a direction orthogonal to a direction in which the slit extends is substantially equal to a length Ly shown below when the wavelength of the transmitted or received wireless signal is X and relative permittivity of the dielectric substrate is $\varepsilon_r$, are arranged so that the width of the slit is 1/40 or less of the wavelength of the wireless signal transmitted or received to or from the first and second antenna elements, $$L_y=0.4\lambda/\sqrt{\{\text{square root over}(\varepsilon_r)\}}.$$

13. The antenna device according to claim 1, wherein a radiation surface of each of the first and second antenna elements has a shape that is substantially the same as a square having one side of which a length is substantially equal to ¼ of a wavelength of a wireless signal to be transmitted or received.

14. The antenna device according to claim 13, wherein the first and second antenna elements are arranged so that a width of the slit is 1/10 or less of the length of the one side of the radiation surface having a shape that is substantially the same as a square.

15. The antenna device according to claim 1, wherein the metal base plate is forted so that a width of the metal base plate in a direction in which the slit extends is larger than that of each of the first and second antenna elements.

16. The antenna device according to claim 1, further comprising a feeding circuit that supplies the feeding signal to at least one of the first feeding portion or the second feeding portion, wherein the feeding circuit is arranged so as to be positioned on an opposite side of the metal base plate from the dielectric substrate.

17. The antenna device according to claim 16, wherein the feeding circuit is arranged in the dielectric substrate formed so as to be interposed between the metal base plate and another flat-plate-shaped metal plate different from the metal base plate.

18. A communication device comprising:

an antenna device; and a communication unit that transmits or receives a wireless signal via the antenna device, wherein the antenna device includes:

a substantially-flat-plate-shaped dielectric substrate;

a metal base plate arranged on a first surface of the dielectric substrate;

substantially-flat-plate-shaped first and second antenna elements arranged on a second surface of the dielectric substrate that is opposite to the first surface and on an opposite side of the dielectric substrate from the metal base plate so that a slit is formed;

a first feeding portion that feeds power to the first antenna element; and a second feeding portion that feeds power to the second antenna element, and a phase difference between feeding signals supplied to the first and second feeding portions, respectively, is approximately 180 degrees, wherein a distance between a feeding point of one of the first and second antenna elements and the slit is determined depending on an input impedance to be matched.

* * * * *